US006692417B2

(12) United States Patent
Burrell

(10) Patent No.: US 6,692,417 B2
(45) Date of Patent: Feb. 17, 2004

(54) MULTI-LEVEL, PORTABLE AND VERSATILE EXERCISE APPARATUS

(76) Inventor: Travis Burrell, 3520 Hughes Ave., #112, Los Angeles, CA (US) 90034

( * ) Notice: Subject to any disclaimer, the term of this patent is extended or adjusted under 35 U.S.C. 154(b) by 246 days.

(21) Appl. No.: 09/897,089

(22) Filed: Jul. 2, 2001

(65) Prior Publication Data

US 2003/0004042 A1 Jan. 2, 2003

(51) Int. Cl.[7] ..... A63B 26/00
(52) U.S. Cl. ..... 482/142; 482/141; 482/66
(58) Field of Search ..... 482/66, 132, 141, 482/142, 148, 24; 135/66, 67

(56) References Cited

U.S. PATENT DOCUMENTS

| | | | | |
|---|---|---|---|---|
| 2,666,640 | A | | 1/1954 | Jennings, Sr. |
| 2,673,737 | A | | 3/1954 | Daniels |
| 2,817,387 | A | | 12/1957 | Blake |
| 3,077,347 | A | | 2/1963 | Nova |
| 3,421,529 | A | | 1/1969 | Vestal |
| 3,521,881 | A | | 7/1970 | Schaevitz |
| 3,540,724 | A | | 11/1970 | Hunter |
| 3,679,203 | A | | 7/1972 | Grana |
| 3,688,789 | A | | 9/1972 | Bunch |
| 3,707,284 | A | | 12/1972 | Waldeck |
| 3,709,487 | A | | 1/1973 | Walker |
| 3,749,400 | A | | 7/1973 | Stoffel |
| 3,857,563 | A | | 12/1974 | Azara |
| 3,945,389 | A | | 3/1976 | Smith |
| 4,126,308 | A | | 11/1978 | Crumley |
| 4,232,863 | A | | 11/1980 | Roach |
| D265,575 | S | | 7/1982 | Lunford |
| 4,456,248 | A | | 6/1984 | Smith |
| 4,477,074 | A | * | 10/1984 | Bushnell |
| 4,494,750 | A | | 1/1985 | Smith |
| 4,518,002 | A | | 5/1985 | Battiston, Sr. et al. |
| 4,638,995 | A | | 1/1987 | Wilson |
| 4,666,154 | A | | 5/1987 | Lipscomb et al. |
| 4,777,973 | A | | 10/1988 | Nakajima |
| 4,826,151 | A | | 5/1989 | Nuredin |
| 4,907,794 | A | * | 3/1990 | Rose |
| 4,927,138 | A | | 5/1990 | Ferrari |
| 4,995,412 | A | | 2/1991 | Hirn et al. |
| 5,004,229 | A | | 4/1991 | Lind |
| 5,029,850 | A | | 7/1991 | Van Straaten |
| 5,074,549 | A | | 12/1991 | Harvey |
| 5,096,187 | A | | 3/1992 | Marples |
| 5,106,079 | A | | 4/1992 | Escobedo et al. |

(List continued on next page.)

*Primary Examiner*—Jerome W. Donnelly

(57) ABSTRACT

An exercise apparatus that includes a cross brace having a first end and an opposing second end, first and second side frames pivotally attached to the opposite ends of the cross brace, a bungee cord with handle having opposite ends received in openings in the bottom horizontal braces of the side frames, and at least four rollers secured to the front vertical supports of the side frames and. The cross brace has a pair of spaced apart rigid mid bars joined to and extending perpendicularly downward from the cross brace. Each side frame has a top horizontal brace support acting as a handle bar, a bottom horizontal brace support too acting as handle having an opening defined therethrough, a front vertical support linking the top horizontal brace support to the bottom horizontal brace support, and a rear vertical support linking the front vertical support to the bottom horizontal brace support. The first side frame and the second side frame are pivotable with respect to the cross brace to open and closed positions and can be locked in those positions. The bungee cord includes a handle and seat attachment secured thereto. The rollers include a tubular portion having an opening therein, a wheel housing with a wheel rotatably mounted thereto, and a locking member received in the opening in the tubular portion for locking the rollers in first and second positions.

19 Claims, 71 Drawing Sheets

U.S. PATENT DOCUMENTS 5,197,931 A 3/1993 Wroclawsky
5,205,748 A 4/1993 Petersheim
5,255,696 A 10/1993 Leonard
5,275,187 A 1/1994 Davis
5,279,533 A 1/1994 Yin et al.
5,290,209 A * 3/1994 Wilkinson
5,302,164 A 4/1994 Austin
5,403,258 A 4/1995 Hill
5,579,793 A 12/1996 Gajewski et al.
5,653,668 A 8/1997 Wilkinson
5,669,860 A 9/1997 Reyes
5,807,211 A * 9/1998 Berryhill
5,810,702 A 9/1998 Wilkinson
5,897,470 A 4/1999 Chen
5,961,430 A * 10/1999 Zuckerman
6,071,217 A 6/2000 Barnett
6,203,473 B1 3/2001 Atwood
6,206,812 B1 3/2001 Nizamuddin
6,248,048 B1 6/2001 Zuckerman et al.
6,440,046 B1 * 8/2002 Tholkes

* cited by examiner

Fig. 4
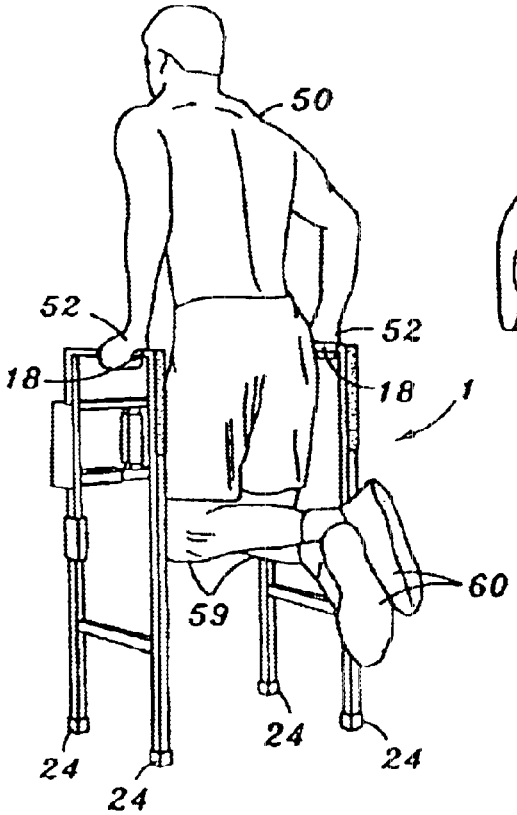
Fig. 5
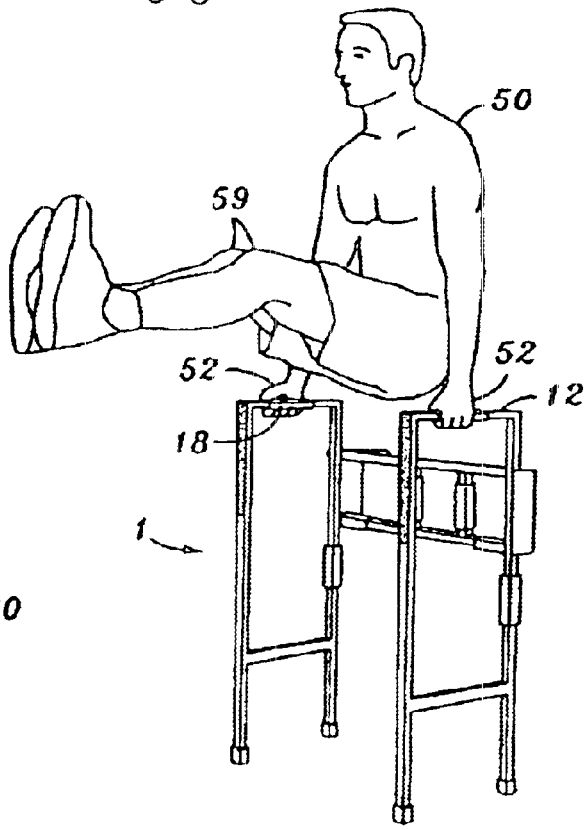
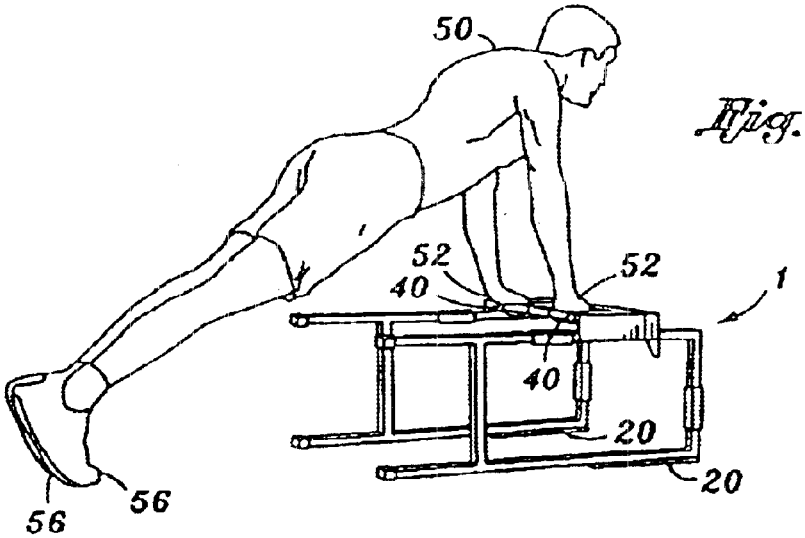
Fig. 6

Fig. 5A
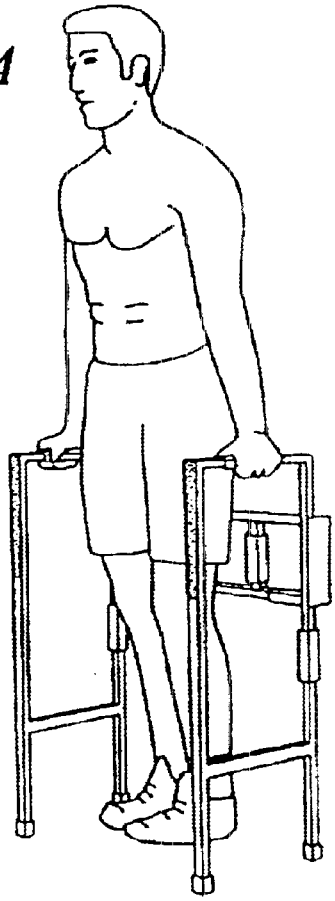
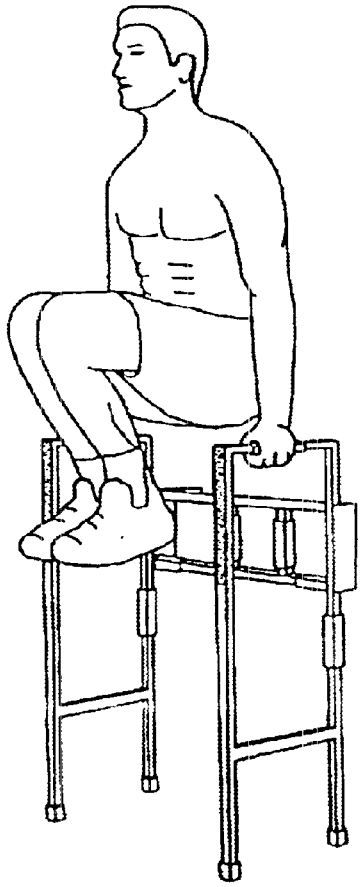
Fig. 5B

Fig. 10B
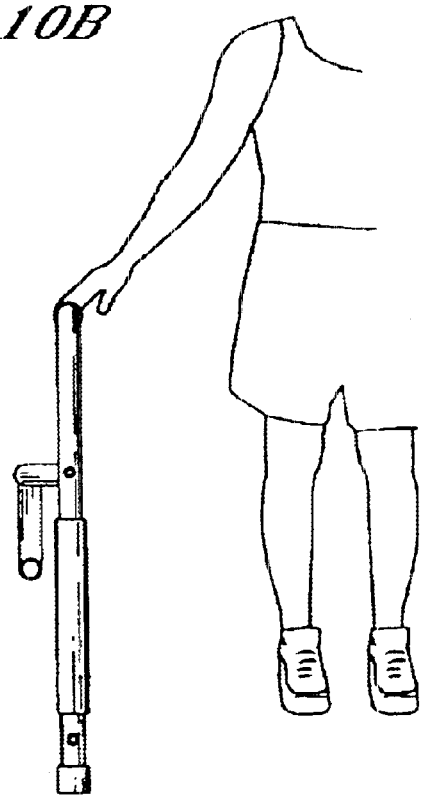
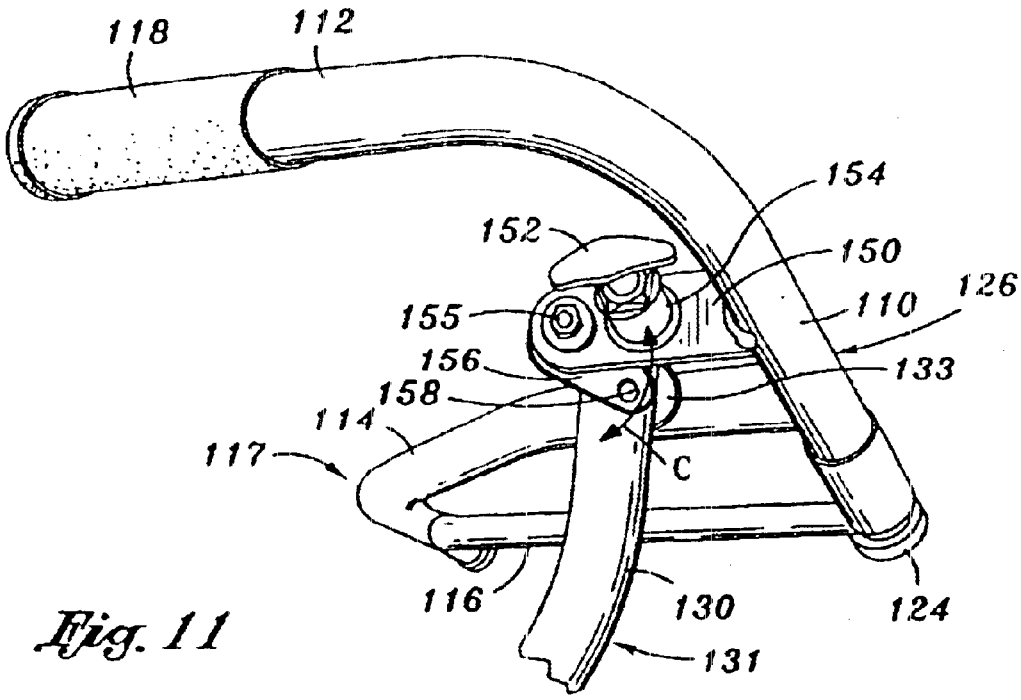
Fig. 11

Fig. 24
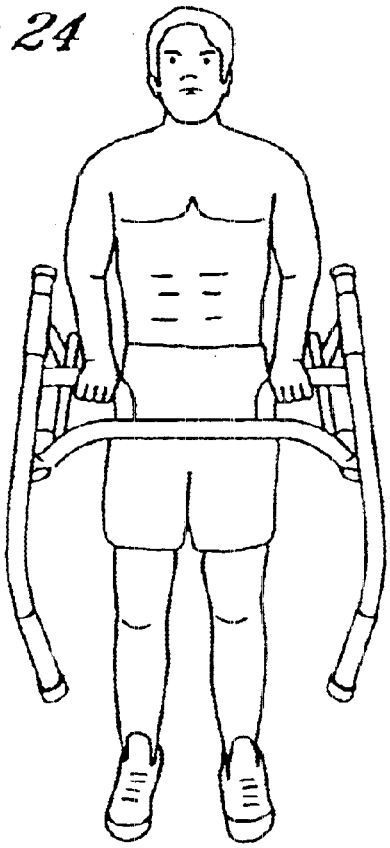
Fig. 25
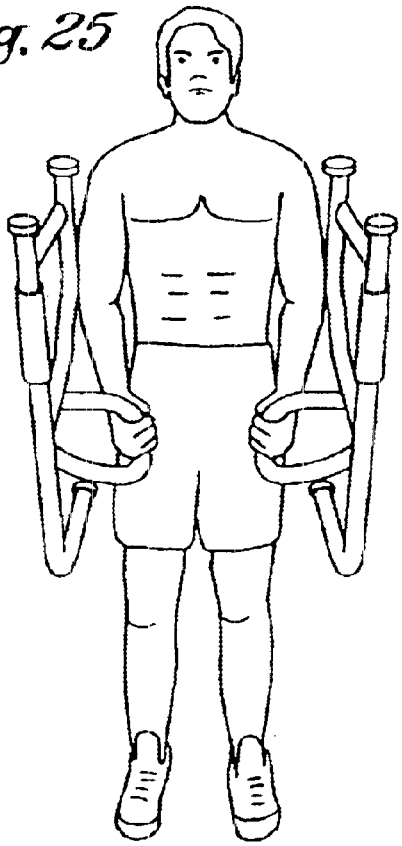
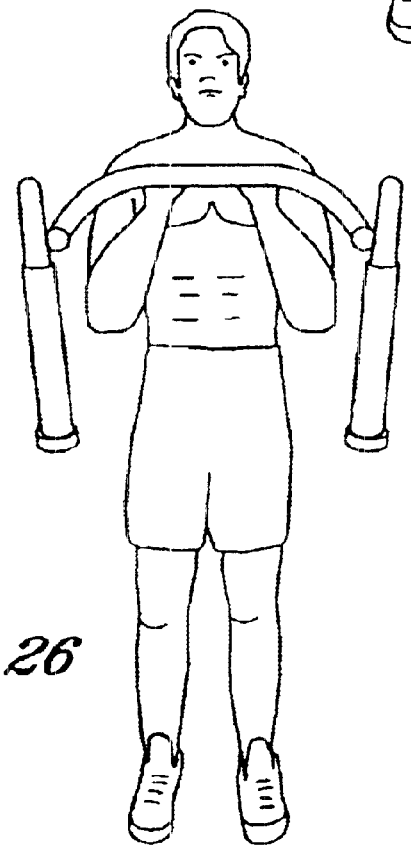
Fig. 26

Fig. 74c
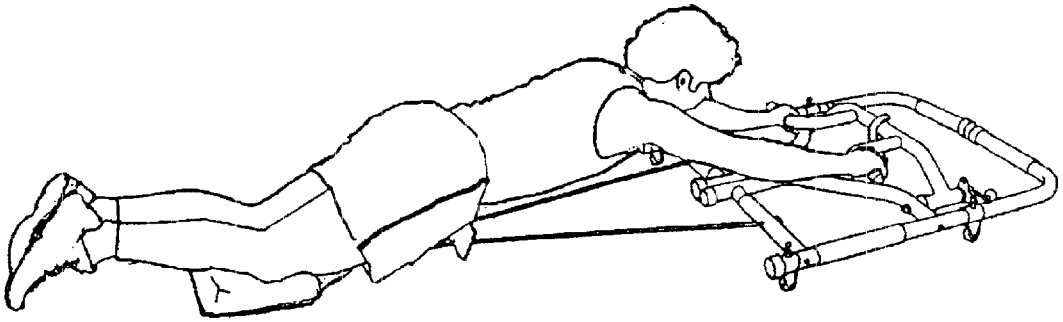
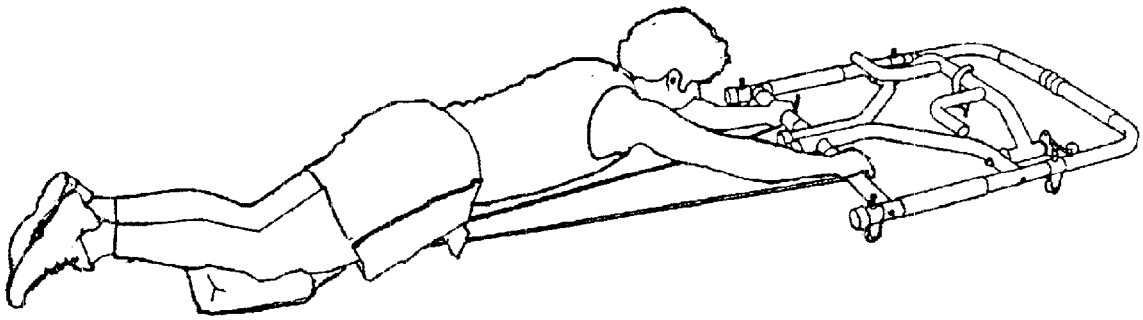
Fig. 74d

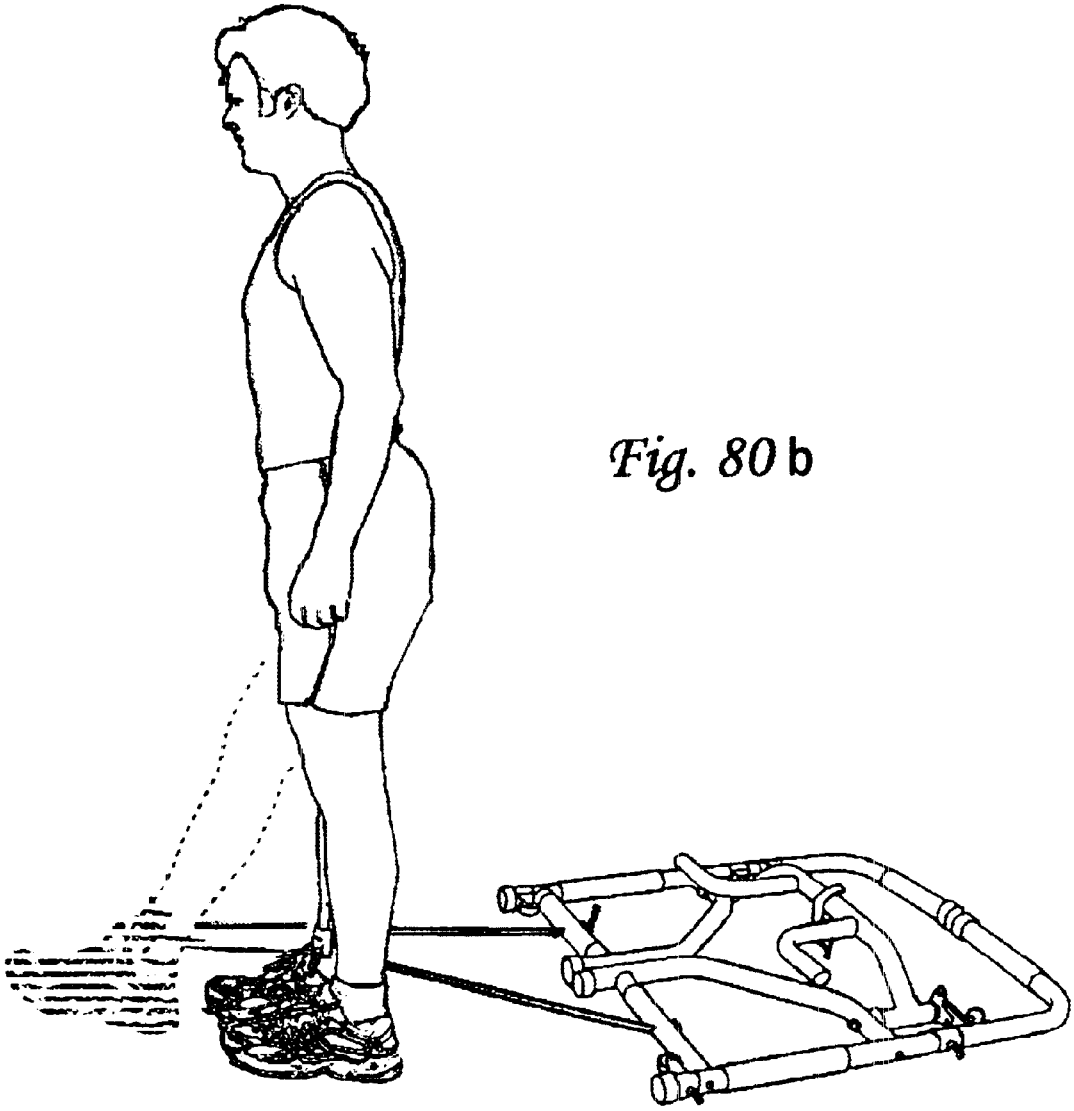
*Fig. 80* b

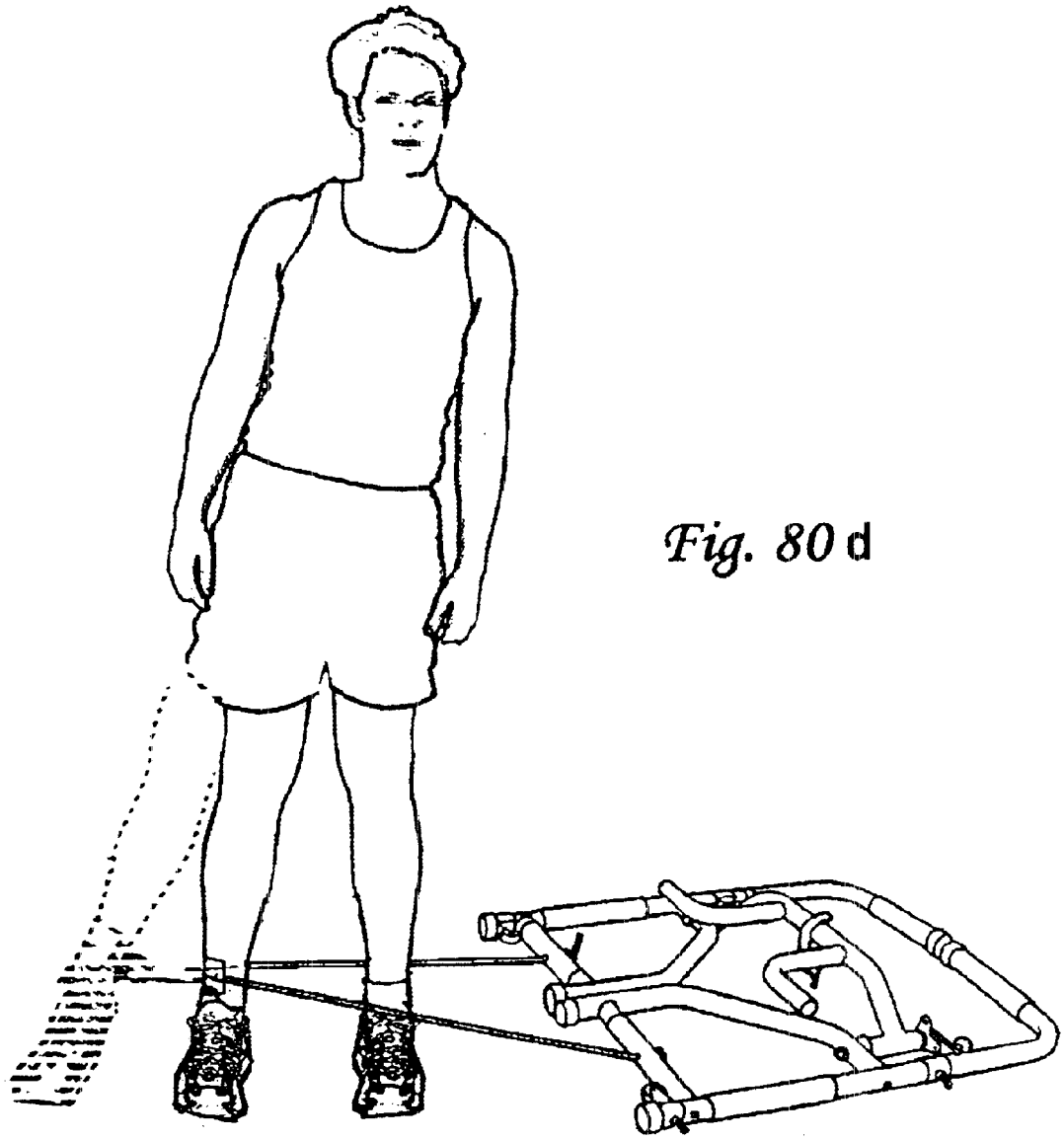
*Fig. 80* d

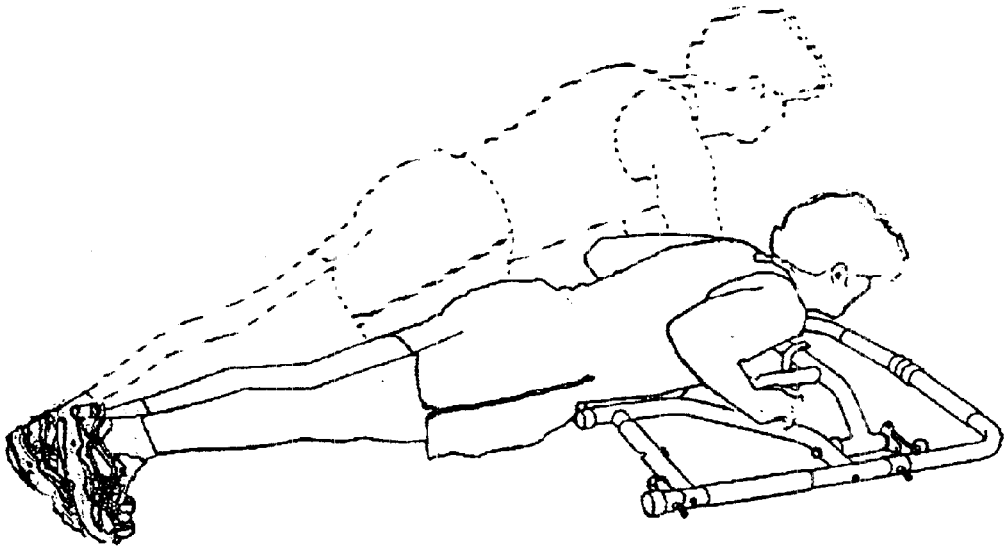
*Fig. 81*
*Fig. 82*
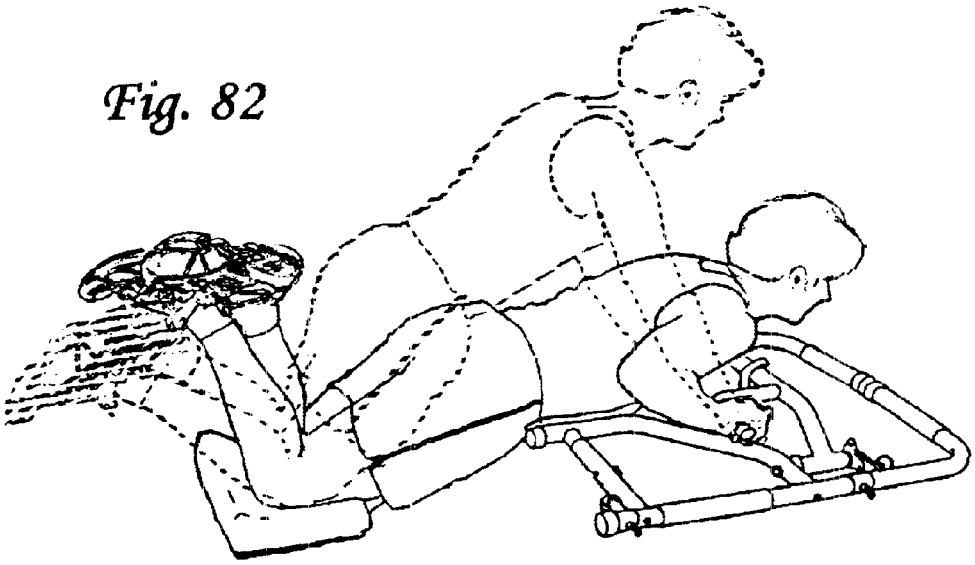

MULTI-LEVEL, PORTABLE AND VERSATILE EXERCISE APPARATUS

FIELD OF THE INVENTION

This invention relates generally to exercise devices, and more particularly to a portable, foldable isometric exercise apparatus that is useful in carrying out a wide variety of upper-body and abdominal exercises.

BACKGROUND OF THE INVENTION

Recent studies and articles in the popular media have reported that regular exercise is beneficial to health and longevity. As a result, membership gyms have become very popular among those seeking an exercise regimen. However, it is often difficult to maintain a regular exercise routine when visits to a gym are inconvenient or impossible, due to, for example, traveling or working. Thus, it is desired to be able to exercise in the convenience of one's home, office, temporary workplace, hotel room, etc., using a lightweight and portable exercise apparatus that can be stored and transported readily.

One of the best forms of exercise to improve muscle tone and strength, as well as to increase overall fitness, is isometric weight training, in which the exerciser may use his or her own body weight as resistance against muscular movement. For example, a number of common upper-body and abdominal exercises utilize isometric resistance, including dips and push-ups for upper-body muscular development, and leg or knee raises for abdominal muscles.

Isometric exercise apparatus are generally advantageous in that they do not necessitate the implementation of moving parts or supplemental weights for their utility, or a second person to spot the user. However, isometric exercise apparatus are nevertheless typically quite heavy and bulky and are usually not portable. In addition, these apparatus are commonly incorporated into expensive multi-station gyms which occupy a substantial area of floor space. Accordingly, such exercise devices are often ill-suited to home or office use because of their bulk and their non-portability.

Prior attempts to provide portable exercise apparatus have largely failed to solve the aforementioned problems, due to a variety of reasons. Such known apparatus have often been highly specialized and limited to one orientation, thereby permitting the exercise of only a single discrete portion of an individual's anatomy. For example, apparatus consisting of fixed, high-mounted horizontal parallel bars allow the user to perform traditional full-body dips and leg or knee raises, but do not facilitate other varieties of dip exercises which isolate certain muscle groups (such as "tricep dips," where a user performs dip with his/her arms behind the back, while maintaining the back of his/her heels on the floor) or multiple variations of pushups of any kind. Another prior art example is the simple push-up bar which does not allow the user to perform full-body dips or knee raises to exercise his/her abdominal muscles. In addition, the portability of some prior art apparatus has required that assembly/disassembly of numerous component parts, use of tools making the devices difficult and time-consuming to use. Further, many of the portable exercise devices in the prior art have lacked sufficient stability or sturdiness.

SUMMARY OF THE PREFERRED EMBODIMENTS

In view of the foregoing disadvantages of prior art exercise equipment, the present invention provides a compact, lightweight exercise apparatus preferably utilizing a pair of side frames, each of which is pivotally connected to a front cross race. The side frames are advantageously pivotable from an extended or unfolded position, to a collapsed or folded position in which the side frames are folded against and roughly parallel to the cross brace. In this manner, the apparatus can be easily folded for ease of transport and storage during periods of non-use. The present invention also provides a sturdy and stable apparatus which may be positioned in either a horizontal or a vertical orientation to permit a wide variety of exercises.

In accordance with a preferred embodiment of the present invention, a foldable exercise apparatus which may be pivotally collapsed is provided. When folded, the apparatus may be stored or transported using a minimum of space; when extended, the apparatus may be used for exercise on almost any flat surface, indoors or outdoors. The apparatus is most preferably capable of being oriented either horizontally or vertically, thereby permitting the user to perform numerous exercises, including dips, push-ups and leg or knee raises, and variations thereof. Preferably, the apparatus when placed in its vertical orientation is supported by at least four vertical support legs, two legs extending downward from each side frame.

In one aspect of this embodiment, the apparatus is pivotally foldable by use of a hinge connected to each side frame which may further be locked in an extended position, thereby providing stability during use. Preferably, this locking is provided by a locking pin or similar means which may be inserted through a hole in a hinge plate into a corresponding receiving hole provided in the cross brace.

In another aspect of this embodiment, the apparatus is constructed of square steel tubing with brace supports, thereby providing sturdy construction. Preferably, the tubing comprising the apparatus frame is welded for strength and durability.

In a further aspect of this embodiment, multiple handgrips are placed at various locations on the apparatus for proper positioning of the user's hands and to provide comfort during exercise. Preferably, the handgrips are made from foam rubber or other suitable material which provides cushioning and a non-slip surface.

In yet another aspect of this embodiment, elastomeric footpads or cups are provided at the bottom ends of the vertical support legs when the apparatus is in its vertical orientation, so as to prevent sliding of the apparatus along the floor during use.

In accordance with another aspect of the present invention there is provided a foldable exercise apparatus comprising first and second side frames pivotable between open and closed positions, and at least two rollers secured to the apparatus. In a preferred embodiment, the exercise apparatus includes a cross brace having a first end and an opposing second end, and a bungee cord secured to the apparatus. The first and second side frames are pivotally attached to the opposite ends of the cross brace. The cross brace has a pair of spaced apart rigid mid bars joined to and extending perpendicularly downward from the cross brace. The first and second side frames each include a front vertical support and are pivotable with respect to the cross brace to open and closed positions. Each side frame has a top horizontal handle bar cantilevered off of the front vertical support and the first and second side frames can be locked in the open or closed positions.

Preferably, the rollers are pivotable between a first position and a second position and include a tubular portion with a wheel rotatably mounted thereto and a locking member for locking the rollers in the first and second positions.

In accordance with yet another aspect of the present invention there is provided an exercise apparatus that includes a cross brace having a first end and an opposing second end, first and second side frames pivotally attached to the opposite ends of the cross brace, a bungee cord having opposite ends received in openings in the bottom horizontal braces of the side frames, and at least four rollers secured to the front vertical supports of the side frames and. The cross brace has a pair of spaced apart rigid mid bars joined to and extending perpendicularly downward from the cross brace. Each side frame has a top horizontal brace support acting as a handle bar, a bottom horizontal brace support having an opening defined therethrough, a front vertical support linking the top horizontal brace support to the bottom horizontal brace support, and a rear vertical support linking the front vertical support to the bottom horizontal brace support. The first side frame and the second side frame are pivotable with respect to the cross brace to open and closed positions and can be locked in those positions. The bungee cord includes a seat attachment secured thereto. The rollers include a tubular portion having an opening therein, a wheel housing with a wheel rotatably mounted thereto, and a locking member received in the opening in the tubular portion for locking the rollers in first and second positions.

In accordance with yet another aspect of the present invention there is provided a method for performing an ab roll using an apparatus that includes a cross brace having a opposing first and second ends, first and second side frames pivotally connected to the opposite ends of the cross brace, and two rollers extending from each side frame. The method includes the steps of folding the first and second side frames into a folded position, placing the rollers on a generally flat surface, placing the user's knees on the generally flat surface, grasping the apparatus, and rolling the apparatus forwardly. In a preferred embodiment, the method also includes the steps of pivoting the rollers from a non-contact position to a contact position and locking the side frames into the folded position. In another preferred embodiment the apparatus further includes a bungee cord having a seat attachment secured thereto, and the method further includes the step of placing the seat attachment between the user's knees and the generally flat surface, and stretching the bungee cord when the apparatus is rolled forwardly.

In accordance with yet another aspect of the present invention there is provided a foldable exercise apparatus including first and second side frames pivotable between open and closed positions, and a bungee cord secured to at least one of the bottom horizontal braces of the first and second side frames.

Other related objects will be apparent from the following drawings and description of a preferred embodiment of the invention, and the claims appended thereto.

BRIEF DESCRIPTION OF THE DRAWINGS

FIG. 4 is a rear perspective view illustrating use of the embodiment of FIG. 1 in its vertical orientation for performing traditional or regular dips;

FIG. 5 is a rear perspective view illustrating use of the embodiment of FIG. 1 in its vertical orientation for performing straight leg raises;

FIGS. 5*a* and 5*b* are front perspective views showing a similar use for knee raises;

FIG. 6 is a side perspective view illustrating use of the embodiment of FIG. 1 in its horizontal orientation for performing traditional or regular push-ups;

FIG. 10*b* is a side view thereof;

FIG. 11 is a top perspective view of the pivot arm shown in FIG. 8;

FIGS. 15–26 show the apparatus of FIG. 8 in use.

FIGS. 39–82 show the apparatus of FIG. 27 in use.

DETAILED DESCRIPTION OF THE PREFERRED EMBODIMENTS

Figure 1:
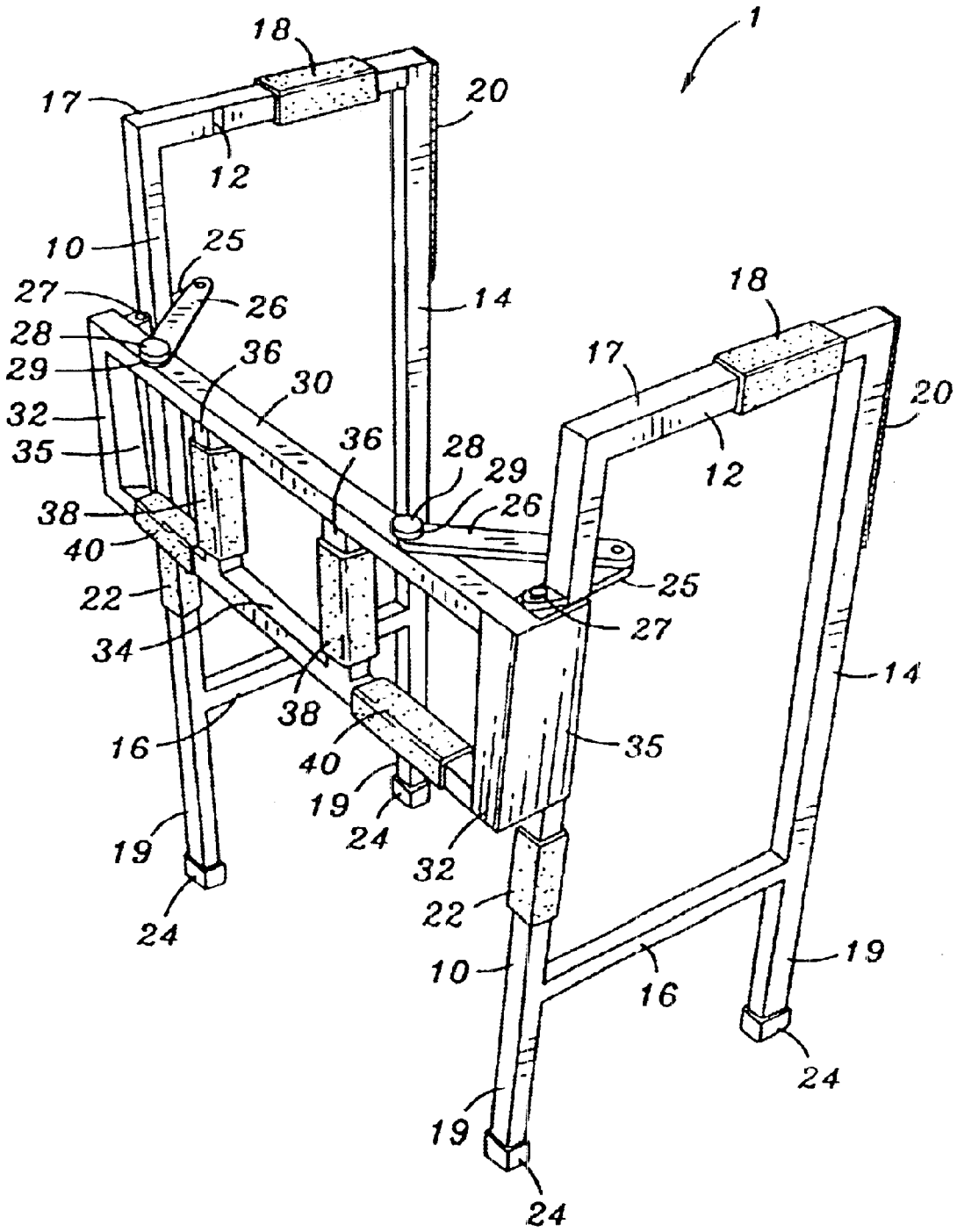
FIG. 1 is a front perspective view of an extended (unfolded) exercise apparatus in a vertical orientation according to one embodiment of the present invention.

With reference now to the drawings in which like reference numerals are used for like or similar parts throughout the several views, there is shown in FIG. 1 a front perspective view of one embodiment of an exercise apparatus, generally designated by the reference numeral 1, in accordance with the present invention. It will be appreciated that terms such as "vertical," "horizontal," "left," "right," "top," "bottom," "up," "down" "side," "inwardly," "outwardly," "up," and "down" and other positionally descriptive terms used hereinbelow are used merely for ease of description and refer to the orientation of the components when the exercise apparatus 1, 100 or 200 is in the vertically upright position shown for example in FIGS. 8 and 27. It should be understood that any orientation of the elements described herein is within the scope of the present invention. These positionally descriptive terms are not intended to limit the scope of the claims are the orientation in which the exercise apparatus 1 can be used for exercises.

In FIG. 1, the exercise apparatus 1 has a pair of side frames 17 pivotally connected to a front cross brace 31 which bridges the side frames. Each of the side frames 17 has a generally rectangular configuration, illustrated in FIG. 1 as defined by a front vertical support 10 and a rear vertical support 14 in a generally parallel coextensive relationship relative to one another, and a top horizontal brace support 12 and a bottom horizontal brace support 16 fixedly and orthogonally mounted to vertical supports 10 and 14. The bottom brace supports 16 are preferably a larger size (1½ "as opposed to 1" for the other sections), and welded into place. The top horizontal brace support 12 on each of the side frames preferably is made of a thicker wall tubing, for added reinforcement.

The side frames 17 and the front cross brace 31 are preferably made from metal tubing, although solid metal rods, as well as other suitable materials such as plastic or fiberglass, may be substituted. It is preferred that the metal tubing be square steel tubing for rigidity and strength, although other suitably rigid metals such as aluminum and other tubing shapes may be used. It is particularly preferred that joints in the metal tubing be welded for durability, although other methods of attachment such as gluing or bolting may be used. It is also contemplated within the scope of the present invention that supports 10, 12 and 14 may consist of a unitary, generally U-shaped tube or rod, bridged by bottom horizontal brace support 16.

When positioned in a vertical orientation, the side frames 17 may optionally have, as shown in FIG. 1, vertical support legs 19 extending downward from each of the vertical supports 10 and 14. The vertical support 19 generally provide more stale support for the apparatus on uneven or non-flat surfaces than horizontal brace support 16. The support legs 19 may consist of separate extensions which are, for example, welded onto vertical supports 10 and 14, or may simply be made by using longer vertical supports 10 and 14 that extend downward beyond horizontal brace support 16.

Preferably, the vertical support legs 19 have at their bottom ends footpads 24 to provide frictional engagement of the support legs 19 with a supportive surface contacted by the footpads 24, so as to prevent or minimize sliding of the apparatus 1 across a floor during use. The footpads 24 are preferably made of rubber, although other suitable elastomeric and like materials may be used. The footpads 24 may be simply friction-fitted over the ends of vertical support legs 16. Optionally, however, the footpads 24 may be attached to the end of support legs 19 by threaded rods or screws, or other equivalent means, as to allow vertical adjustment of individual legs to provide stable support on uneven surfaces.

The front cross brace 31 is pivotally connected to side frames 17 such that the side frames when extended are transverse to a project rearward from the cross brace. The side frames 17, when fully extended, are approximately perpendicular to the cross brace 31. In the embodiment illustrated in FIG. 1, the cross brace 31 is generally rectangular in configuration and consists of top horizontal cross support 30, bottom horizontal cross support 34, and a pair of vertical cross supports 32. Preferably, the front cross brace 31 also has a pair of medial cross supports 36 which bridge horizontal cross supports 30 and 34. Attached or affixed to the sideward faces of vertical cross supports 32 are side plates 35 which extend rearward approximately orthogonal to the plane defined by cross brace 31. The side plates 35 prevent side frames 17 from pivoting significantly beyond an orthogonal position relative to the cross brace 31 when the side frames are extended for use. The side plates 35 provide lateral stability and also help to prevent accidental pinching by covering the hinge areas.

In the embodiment illustrated in FIG. 1, each of the side frames 17 is pivoted about a pivot point 27 to which is attached a hinge member consisting of hinge plates 25 and 26. Each of hinge plates 26 has near its distal end a through-hole 29 which may be aligned, when the apparatus is extended, with a receiving hole 33 (shown in FIG. 7) which is located on the top face of horizontal cross support 30. Upon unfolding of the apparatus to its extended position, locking pin 28 may be inserted through through-hole 29 and into receiving hole 33 to lockingly engage the side frames in their extended position. Insertion of the locking pin 28 prevents inadvertent folding or collapse of the side frames 17 during use and provides a stable and sturdy apparatus for exercise. Removal of the locking pins 28 permits folding of the apparatus for storage or transport. Although the embodiment in FIG. 1 illustrates a hinge pivot, other suitable pivot designs may be utilized.

Figure 7:
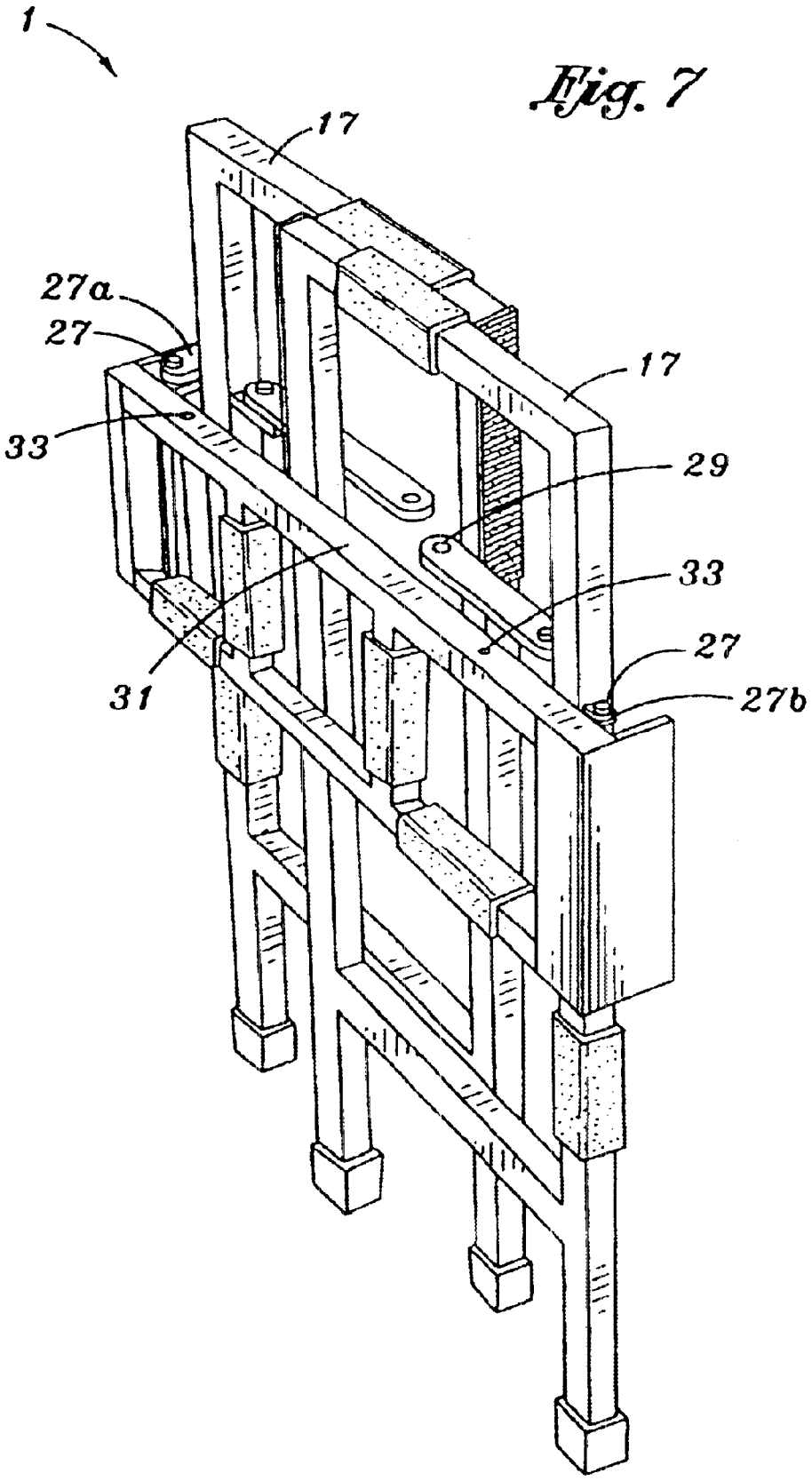
FIG. 7 is a front perspective view of the embodiment of FIG. 1 shown in a folded state for storage or transportation during periods of non-use.

As shown in FIGS. 1 and 7, to allow the side frames to fold flat against each other, the right side pivot point 27 is located behind the left side pivot point by an amount approximately equal to the width of the vertical support 10. This is achieved by making the right side pivot tabs or arms 27*a* longer than the left side pivot tabs or arms 27*b*, as best shown in FIG. 7.

The top horizontal supports 12 include a pair of handgrips 18 or similar means which may be grasped by the user during exercise. In similar fashion, front vertical supports 10 includes handgrips 22 or similar means, bottom horizontal cross support 24 includes handgrips 40 and medial cross supports 36 includes handgrips 38. In each instance, the handgrips are located on the apparatus I so as to provide proper hand positioning by the user while performing the various exercises permitted by the apparatus. Appropriate hand positions for each of the exercises is illustrated in FIGS. 2 through 6, which are more fully described below.

The handgrips preferably provide a non-slip grip and cushioning for the users comfort. Suitable materials for the handgrips include rubber, urethane and other foams, and similar materials. The handgrips are attached using known techniques.

Figure 2:
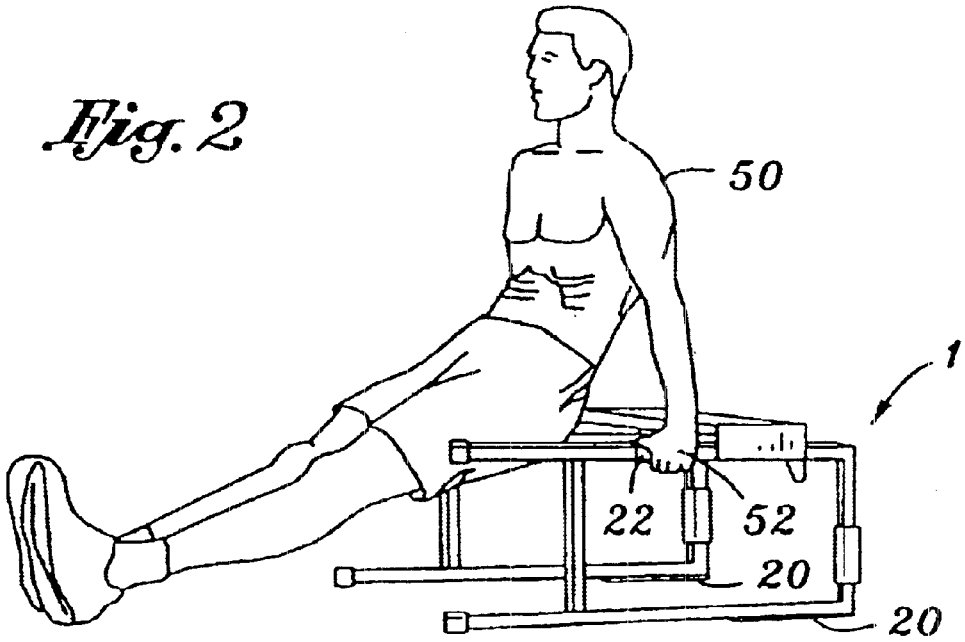
FIG. 2 is a side perspective view illustrating use of the embodiment of FIG. 1 in a horizontal orientation for performing one variation of tricep dips known as "little dips" or side tricep dips.
Figure 3:
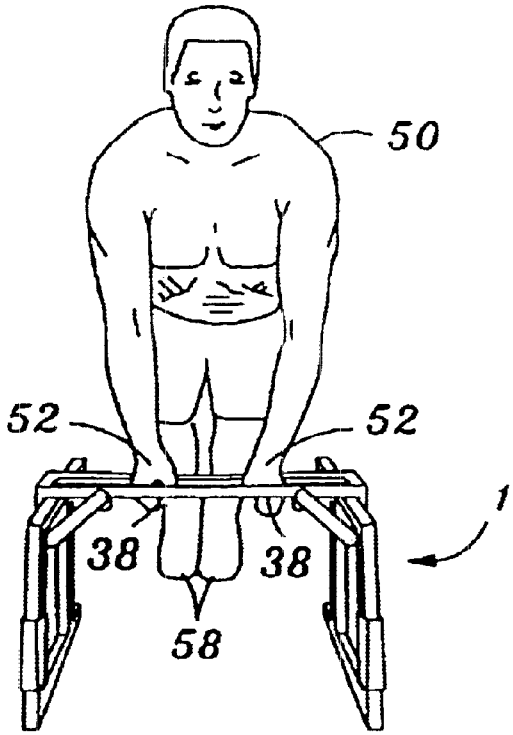
FIG. 3 is a top perspective view illustrating use of the embodiment of FIG. 1 in its horizontal orientation for performing one variation of push-ups known as close parallel-grip push-ups.

Optionally, rubber or other non-slip strips 20 are affixed proximal the top ends of the rear faces of rear vertical supports 14 so as to prevent or minimize sliding of the apparatus 1 during use in its horizontal orientation. In the horizontal orientation, the non-slip strip 20 makes tact with the floor or other supporting surface. The non-slip strip 20 also helps to protect the apparatus surface finish and to prevent scratching or scuffing of the supporting surface during use. Exercises which may be performed using the apparatus in its horizontal orientation are illustrated in FIGS. 2, 3, and 6, which are more fully described below. The apparatus is preferably finished with a textured powder coating (as opposed to an anodized finished).

Referring now to FIG. 2, the apparatus 1 may be positioned in a horizontal orientation to facilitate certain isometric exercises. In the horizontal orientation, non-slip strips 20 provide stable contact of the apparatus with the supporting surface. In FIG. 2, a person 50 is illustrated performing one variation of a tricep dip exercise known as "little dips" or "seated dips." These "little dips" are similar to regular dips but are made easier by offsetting body weight via having the feet on the ground. In this exercise, the person's hands 52 grasp handgrips 22 for support. In performing tricep dips, the person 50 raises and lowers (dips) his or her body about a pivot point defined by the person's heels 56. Tricep dips target development of the tricep and pectoral muscle groups. Traditional (or rear) tricep dips, in which the user's hands are placed behind the back, may be performed by simply grasping instead handgrips 40 which are located on cross brace 31 (see FIG. 1). Traditional tricep dips are performed in the same general fashion as "little dips" but more effectively isolate and target the tricep muscles.

Figure 2A:
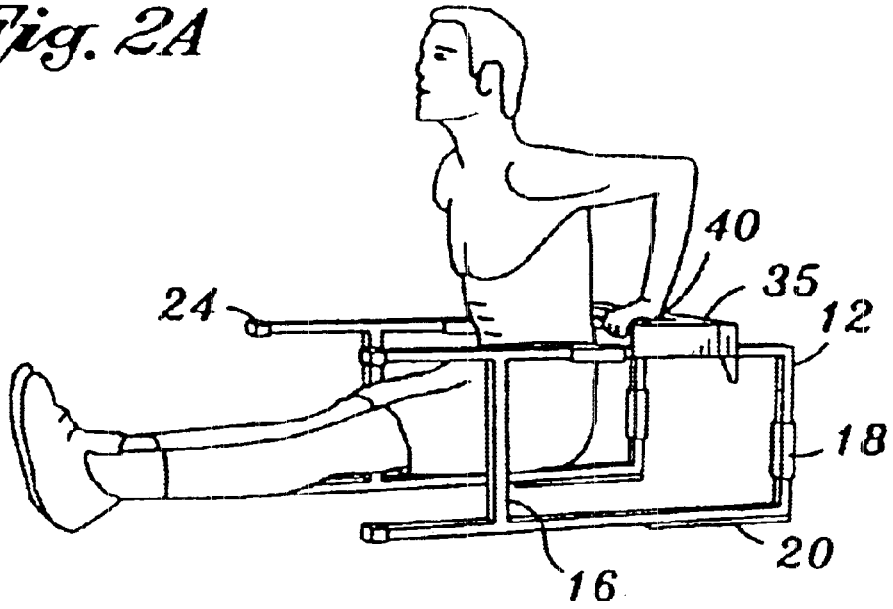
FIGS. 2*a* and 2*b* are front perspective views showing a similar use for back tricep dips.
Figure 2B:
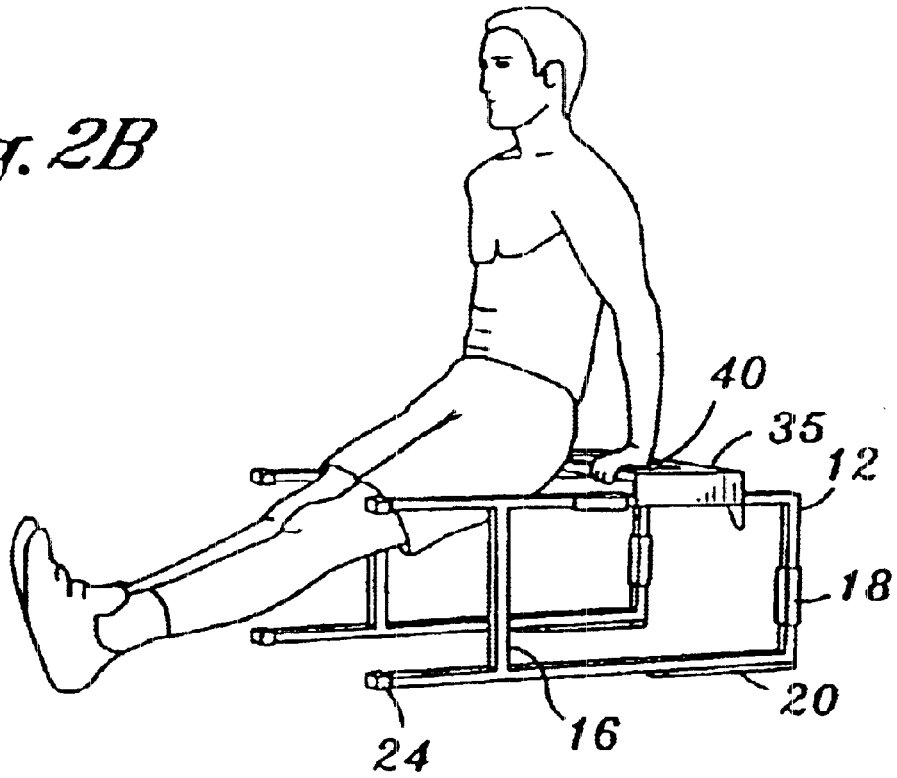

As shown in FIGS. 2*a* and 2*b*, the users hands may also grasp the grips 40, thereby positioning the users hands behind the users back, to perform back tricep dips in a similar manner.

Figure 3A:
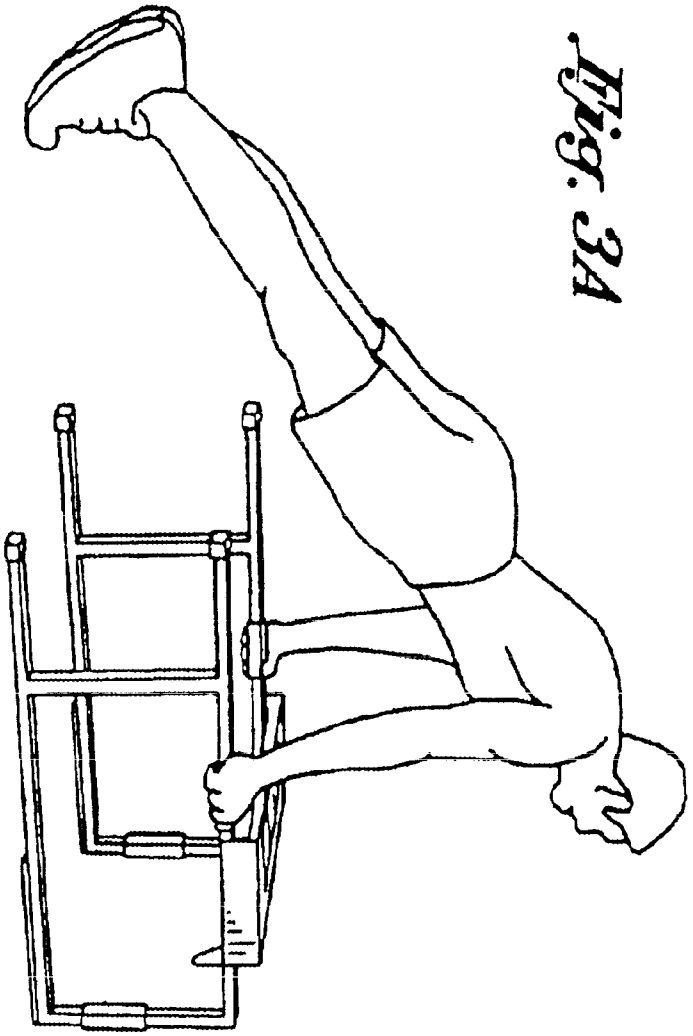
FIGS. 3*a* and 3*b* are side perspective views showing a similar use for wide parallel grip push-ups.
Figure 3B:
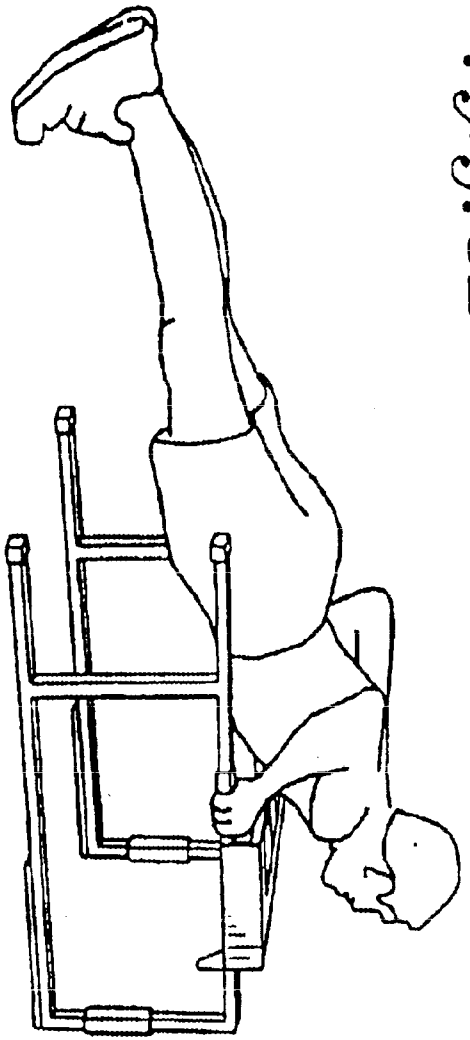

Referring now to FIG. 3, there is shown a person 50 performing one variation of push-ups using the exercise apparatus 1. While grasping handgrips 38 with his or her hands 52, the person 50 raises and lowers his or her body about a pivot point defined by the person's toes 58. This exercise works and develops the triceps, the middle pectorals and the deltoids. Wide parallel grip push-ups, as shown in FIGS. 3*a* and 3*b*, work the outer pectorals, as well as the front deltoids and triceps, and are performed by using handgrips 22 (see FIG. 1). Traditional or regular push-ups may be performed by using instead handgrips 40, and are illustrated in FIG. 6 described below.

Referring now to FIG. 4, there is shown a person 50 performing traditional or regular full-body dips using the exercise apparatus 1 in its vertical orientation. While grasping handgrips 18 with his or her hands 52, the person 50 raises and lowers his or her (preferably entire) body weight by maintaining knees 59 in a bent position so as to keep feet 60 from touching or making contact with the floor or other supporting surface. Regular dips work and develop the tricep and pectoral muscle groups and, secondarily, lats.

Referring now to FIG. 5, there is shown a person 50 performing straight leg raises. In this exercise, handgrips 18 are grasped while facing away from the cross brace, and the person 50 lifts his or legs until approximately orthogonal to his or her torso while maintaining knees 59 substantially extended throughout the leg raise. The straight leg raise works and develops the abdominal muscles. A variation, knee raises, as shown in FIGS. 5*a* and 5*b* may be performed by raising the legs while keeping knees 59 bent. Knee raises work and develop the lower abdominal muscles, and are easier to perform than straight leg raises.

Referring now to FIG. 6, there is shown a person 50 performing traditional or regular push-ups by placement of the hands 52 on handgrips 40. Traditional push-ups provide development of the entire pectorals and also target the front deltoids and the triceps.

While FIGS. 2 through 6 illustrate certain common exercises, it will be understood that variations and combinations of these exercises are also contemplated. In addition, these exercises may be performed with supplemental weights, e.g., ankle weights or belt weights.

Referring now to FIG. 7, there is illustrated the exercise apparatus 1 in a folded or collapsed state. To permit folding of the apparatus, locking pin 28 (not shown) has been removed from receiving hole 33 and through-hole 29. After removal of the locking pin, side frames 17 are pivoted about pivot points 27 until the side frames 17 are folded against and roughly parallel to cross brace 31. The locking pin 28 can be stored in the receiving hole 33. When folded the apparatus may easily be stored or transported.

The apparatus 1 is preferably made of welded steel tube construction. This design provides sufficient rigidity for the apparatus to reliably be used to perform exercises which generate substantial loads on the apparatus, without significant bending, wobbling, or deflection. The parallel alignment of the front and rear vertical supports 10 and 14 provides the preferred geometry for the handgrips when the apparatus 1 is in the prone position as shown for example in FIG. 2. Referring to FIGS. 5*a* and 7, as the apparatus 1 rises only to about the users hip region, and because the apparatus is readily folded, it can easily fit into the trunk of a car, into a closet, behind a door, or under a bed.

Turning to FIGS. 8–11, a second embodiment 100 has a pair of side frames 117 pivotally attached to a cross brace 131. Each side frame 117 has a front vertical support 110 of having a handle bar 112. A rear support 114 extends outwardly and downwardly from a middle position of the front vertical support 110. A horizontal brace 116 extends from a lower position of the front vertical support 110 to a lower and rear position on the rear support 114. Footpads 124 are attached to the bottom ends of the front vertical support 110 and rear support 114. Each rear support 114 has a horizontal section 161 adjoining the front vertical support 110, an angled section 162, extending downwardly at an angle from the horizontal section 161, and adjoining a vertical section 163.

Figure 8:
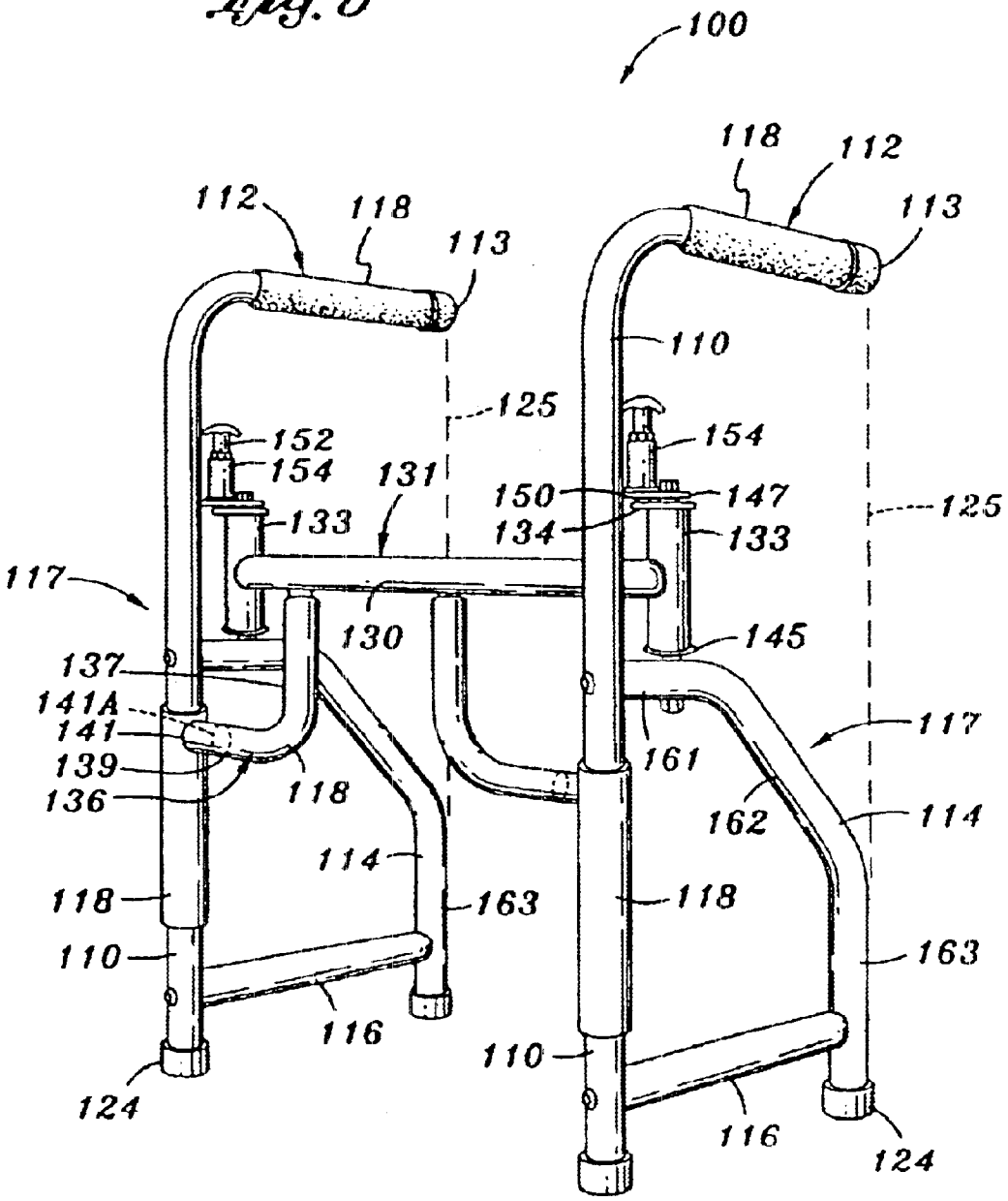
FIG. 8 is a front perspective view of the second embodiment in the unfolded or erected position.
Figure 9:
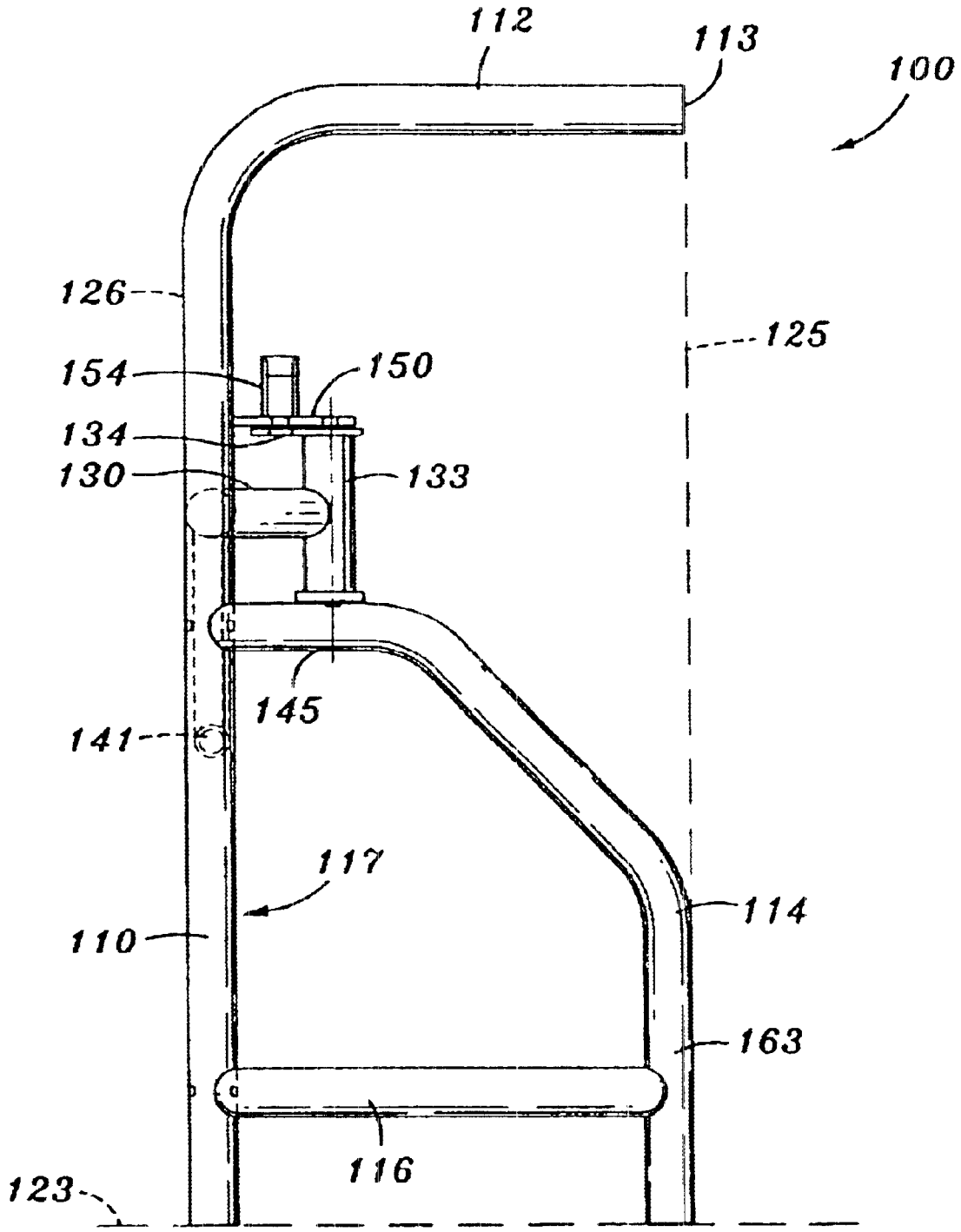
FIG. 9 is a side elevation view thereof.

Referring to FIGS. 8 and 9, the back ends 113 of the handle bars 112 are preferably co-planer with the back surface of the vertical section 163 of the rear support 114, thereby defining a back plane 125, on which the apparatus 100 can rest.

Similarly, the footpads 124, or the bottom ends of the front vertical supports 110 and vertical sections 163 of the rear supports 114 are coplanar, and define a foot plane 123. The handle bar 112 is preferably parallel to the horizontal brace 116 and the foot plane 123. The handle bar 112 is also preferably perpendicular to the vertical section 163 and back plane 125. The front surface of the front vertical supports 110 forms a front plane 126, parallel to the back plane 125, and perpendicular to the foot plane 123.

Figure 12:
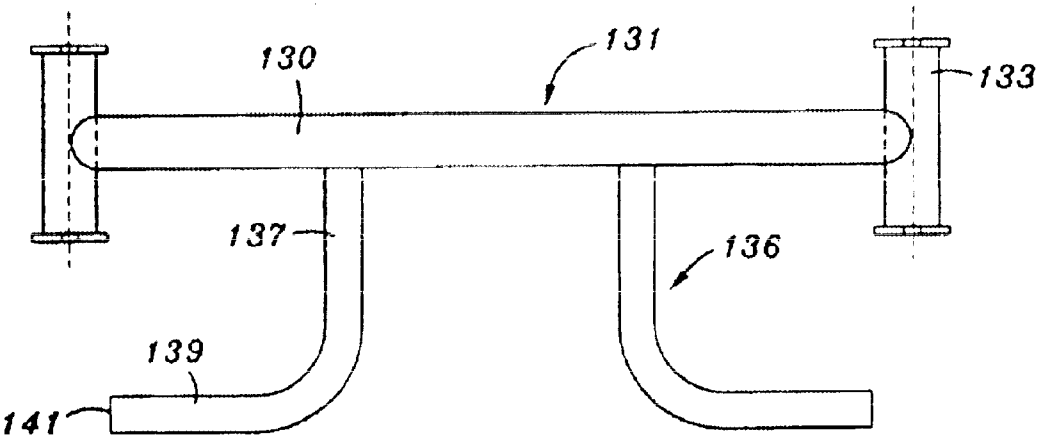
FIG. 12 is a front view of the cross support shown in FIG. 8.

Referring to FIGS. 8 and 12–14, the cross brace 131 includes a horizontal cross support 130 having end tubes 133 attached at its ends. Right angle mid-bars 136 are attached to an extend down from the cross support 130. The mid-bars 136 each have a vertical or first mid-bar section 137 and a second or horizontal mid-bar section 139 extending at right angles to the first mid-bar section 137. The mid-bars 136 are equally spaced apart from the end tubes 133, as shown in FIG. 12.

The ends 141 of the horizontal mid-bar sections 139 are dimensioned so that, as shown in FIG. 8, with the apparatus 100 in the unfolded or erected condition, the mid-bar ends 141 touch the front vertical supports 110, or handgrips 118 provided on the front vertical supports 110.

Referring to FIGS. 8 and 11, a pivot arm 150 is attached to each front vertical support 110. A pivot pin 155 extends through the pivot arm 150, to form an upper pivot joint 147 between the pivot arm 150 and the end tube 133, on each of the side frames 117. The pivot pin 155 extends through the end tube 133, and through the vertical section 163 of the rear support 114 on each side frame 117, to form a lower pivot joint 145, between each side frame 117 and the cross brace 131.

As shown in FIG. 11, a quick release lock pin 152 extends through a pin holder 154 and into a first (open position) hole (not shown) on a tube arm 156 attached on top of the end tube 133. The pin 152 is spring biased downwardly into the tube arm 156. A folded or closed position hole 158 extends through the tube arm 156 on the same radius from the pivot pin 155 as the first hole.

Handgrips 118 formed of rubber or other cushioning material, are attached to the handle bars 112, mid-bars 136, and to the lower section of the front vertical supports 110, as shown in FIG. 8.

Figure 15:
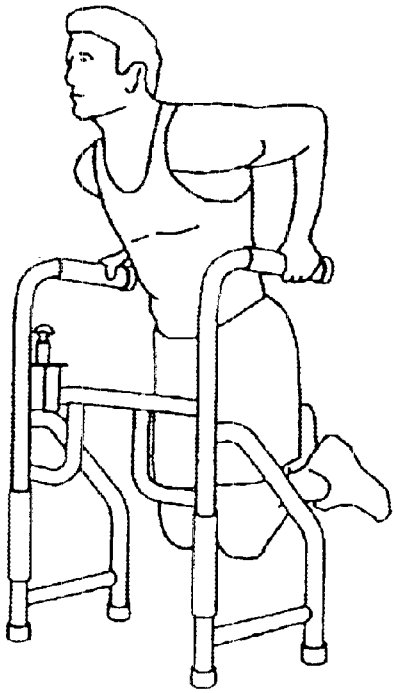
Figure 16:
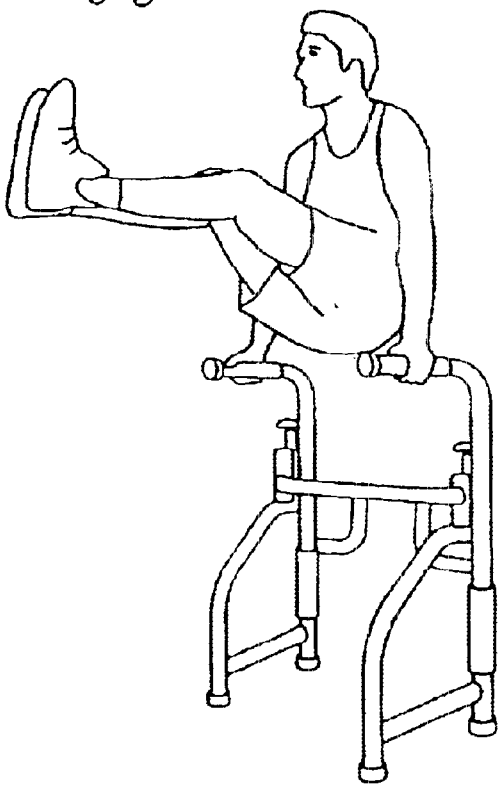
Figure 17:
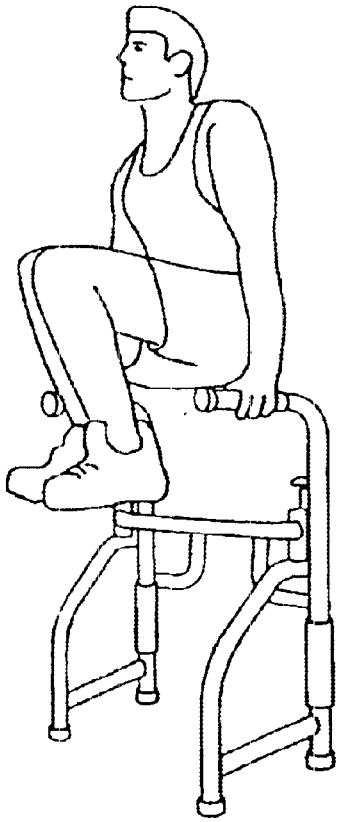

In use, the apparatus 100 operates in a manner similar to the first embodiment 1, as shown in FIGS. 1–7. As shown in FIG. 8, with the apparatus 100 in the unfolded or erected and vertically upright position, the apparatus 100 is useful for performing traditional or regular dips, as shown in FIG. 15; for performing straight leg raises, as shown in FIG. 16; or for use in performing knee raises, as shown in FIG. 17, with the users hands on the handlebars 112.

Figure 18:
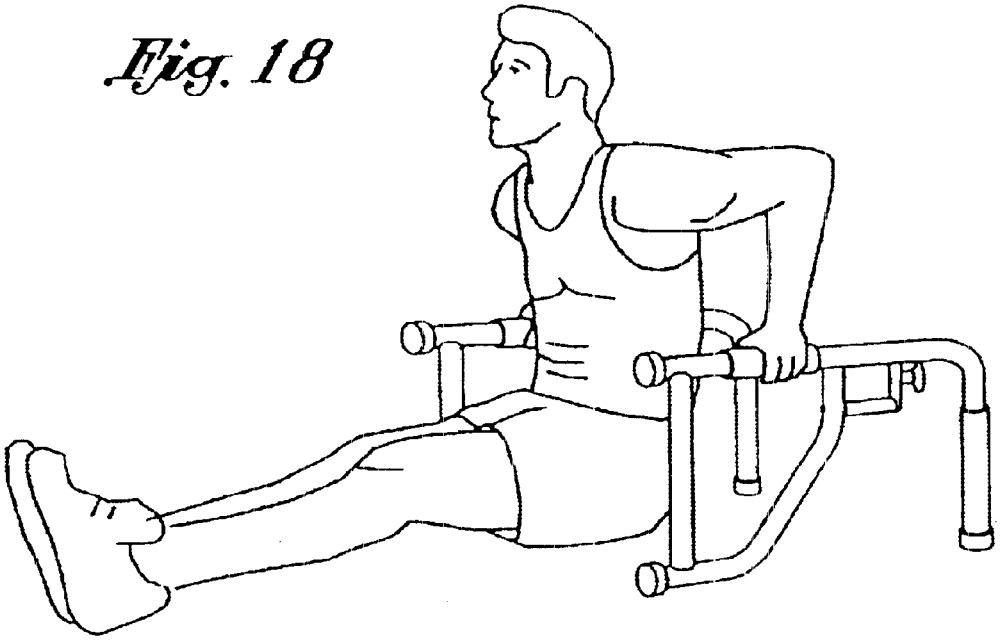
Figure 19:
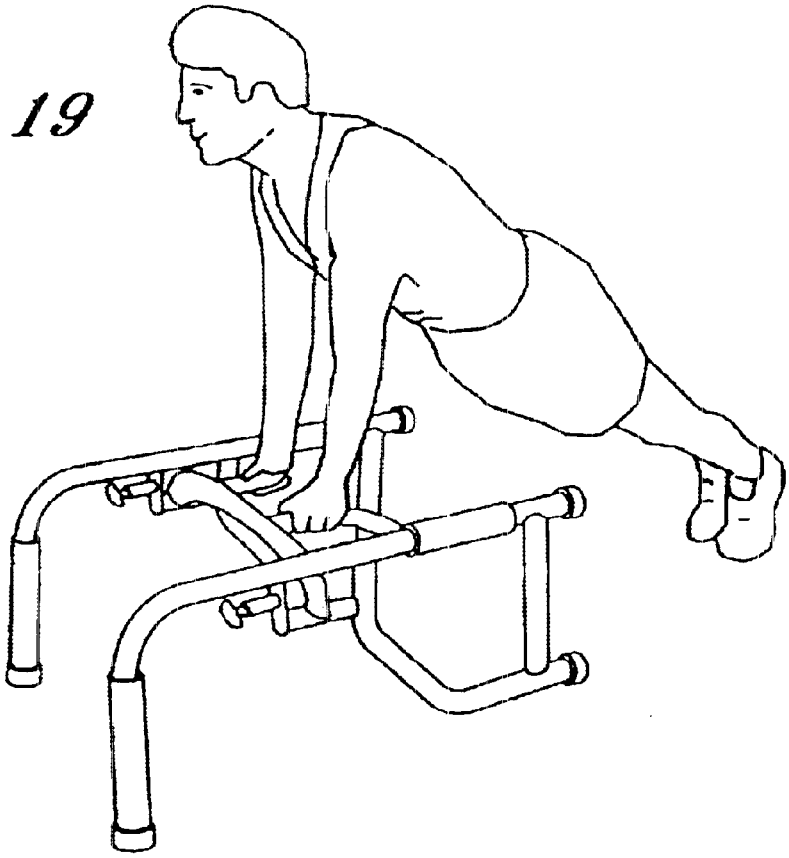
Figure 20:
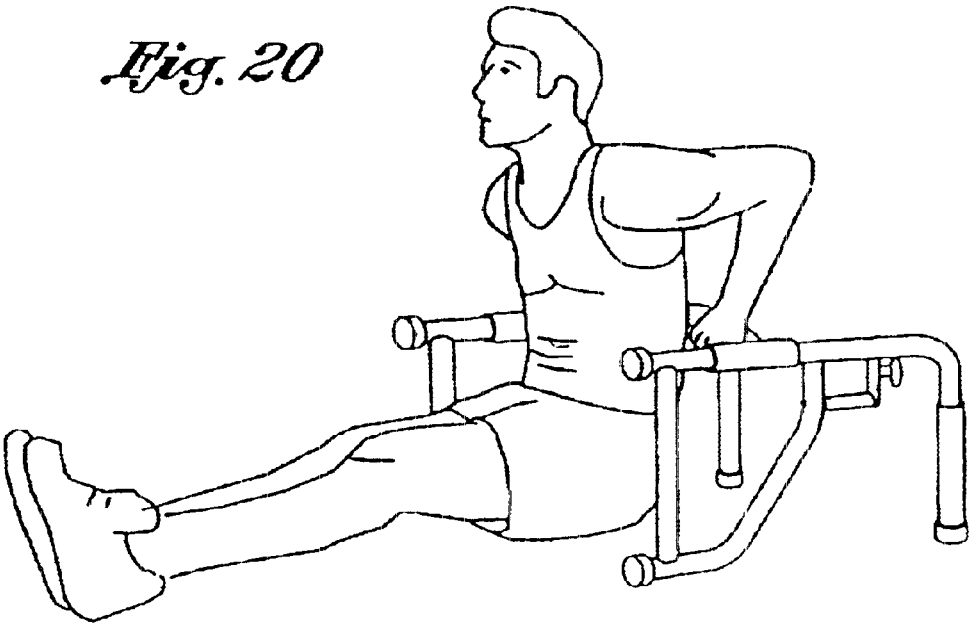
Figure 21:
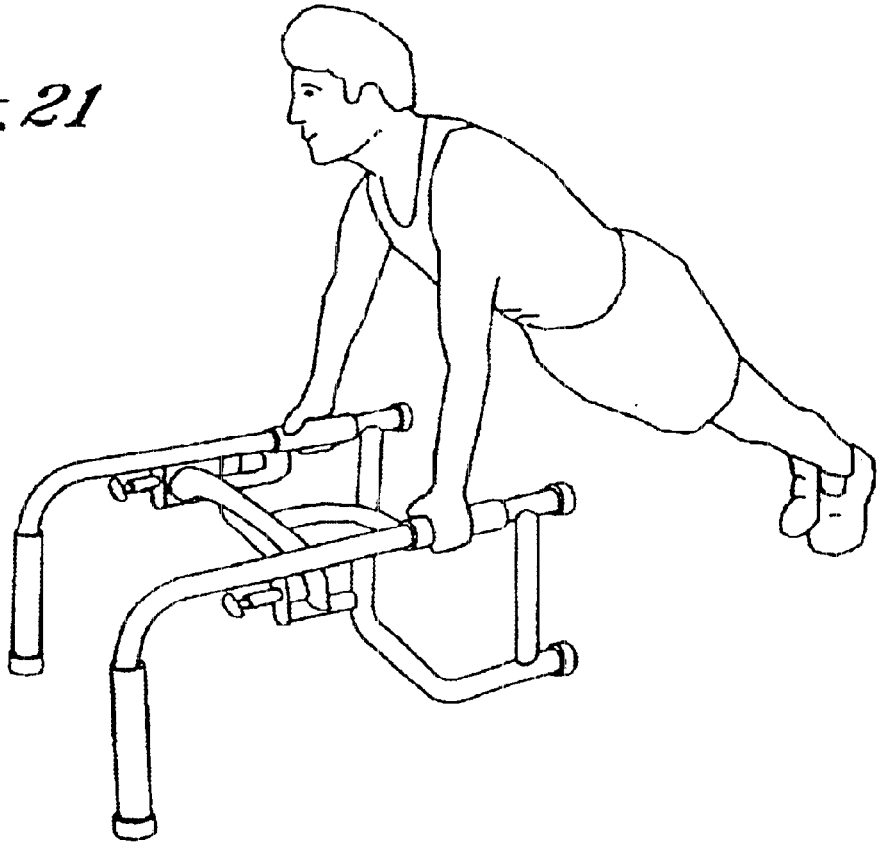
Figure 22:
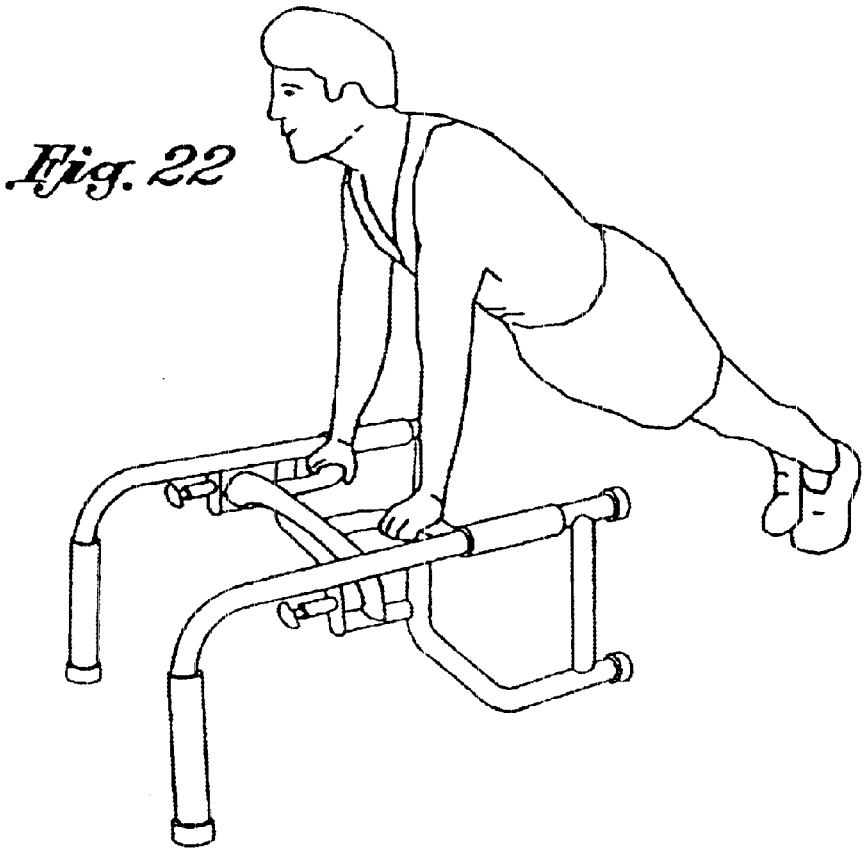
Figure 23:
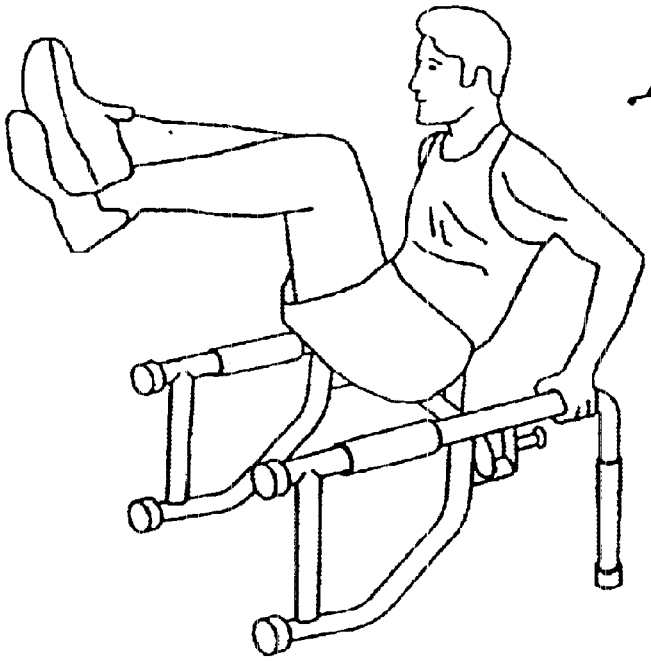

With the apparatus 100 in the unfolded or erected position, and with the back plane 125 supported on the floor, the apparatus 100 is useful for performing a variation of tricep dips known as "little dips" or "seated dips", as shown in FIG. 18 with the user's hands on the handgrips 118 on the front vertical supports; for performing a variation of pushups known as close parallel grip push-ups, as shown in FIG. 19, with the user's hands on the vertical section 137 of the mid bars; for performing back tricep dips, as shown in FIG. 20, with the user's hands on the horizontal sections 139 of the mid-bars 136; for performing wide parallel grip push-ups, with the user's hands on the handgrips 118 on the front vertical supports 110, as shown in FIG. 21; or for performing traditional or regular push-ups, with the user's hands on the horizontal sections 139 of the mid-bars 136, as shown in FIG. 22; or for performing abdominal crunches, with the user's hands on the upper section of the front vertical supports, just below the handle bars, as shown in FIG. 23. When resting between abdominal crunch sets, the user sits on the cross brace 13. The exercising movements shown in FIGS. 15–22 are further illustrated with reference to FIGS. 2*a*, 2*b*, 3*a*, 3*c*, 5*a* and 5*b*.

As shown in FIGS. 24–26, the apparatus 100 can be lifted off of the ground to perform regular curls (as shown in FIG. 24); hammer curls (as shown in FIG. 25); and military presses, as shown in FIG. 26. FIG. 26 shows that the side frames force the user's elbows in which better isolates the muscles used. In addition, with the user's hands on the vertical sections 137, the apparatus is balanced to facilitate military presses, i.e., the center of gravity (vertically) is substantially positioned along a horizontal axis extending through the vertical sections 137.

For storage or transportation, the lock pins 152 are pulled up and out of the holes in the tube arms 156. The side frames 117 are then free to pivot relative to the cross brace 131. The side frames 117 are moved in the direction of the arrow C, as shown in FIG. 11, to the fully folded position shown in FIG. 10. The lock pin 152 is then re-inserted into the folded position hole 158 in each tube arm 156, thereby locking the side frames 117 into the folded position.

Figure 10A:
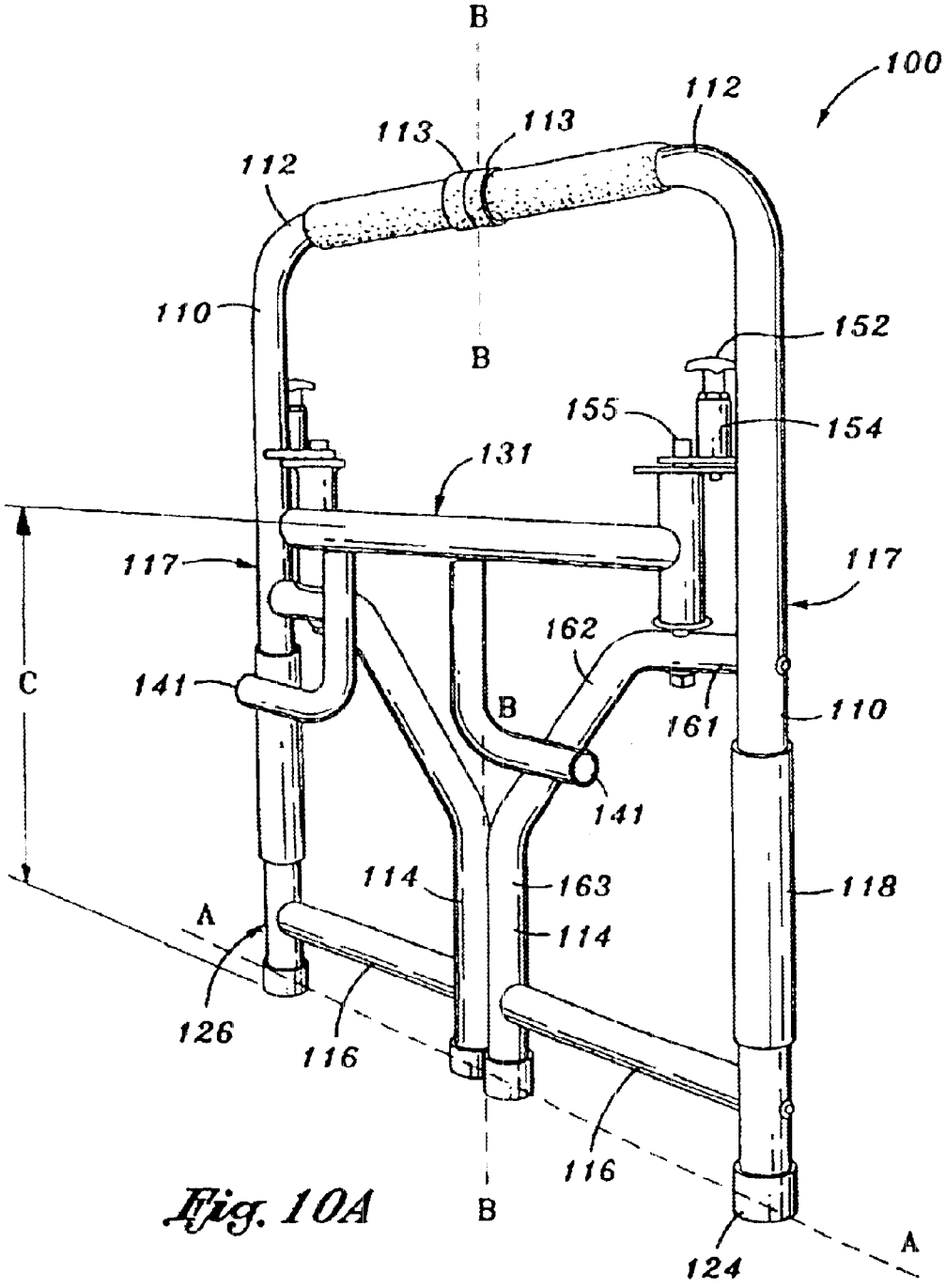
FIG. 10*a* is a perspective view thereof showing the second embodiment in the folded position for storage or transportation.
Figure 13:
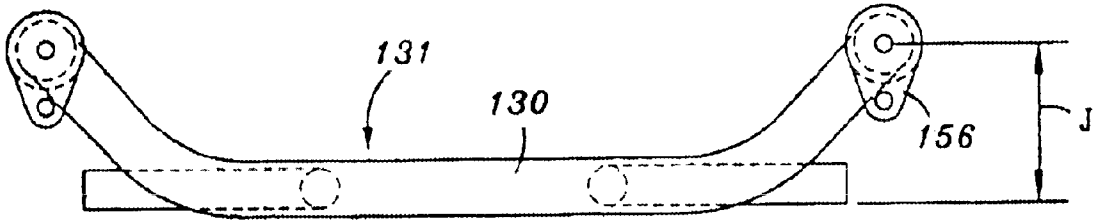
FIG. 13 is a top view thereof.
Figure 14:
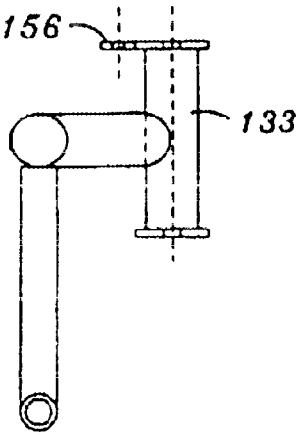
FIG. 14 is a side view thereof.

Referring to FIG. 10, with the apparatus in the folded position as shown, the handle bar ends 113 are adjacent or touching each other, along Line B—B. Similarly, the vertical sections 163 of the rear supports 114 on each side frame 117 (or the footpads 123 on the vertical sections 163) are adjacent to or touching each other, along Line B—B. As a result, the apparatus 100 is compact when folded. As shown in FIG. 10B, when folded, the side frames lie in a single plane, and the only part of the apparatus 100 projecting out of that plane is the cross brace, which protrudes above the side frames by dimension J in FIG. 13, i.e., from 2–8 inches, and preferably by about 5 inches.

The dimension C from the foot plane 123 to the cross support 130 is dimensioned so that, for most users, the apparatus 100 can be carried by lifting the cross brace 131, and holding the apparatus 100 at the user's side, without the footpads 124 touching the floor, for easy carrying.

In an alternative embodiment, the mid-bar ends 141A are shortened, so that they do not touch the handgrips 118 on the front vertical supports 110, as shown in phantom in FIG. 8.

Figure 27:
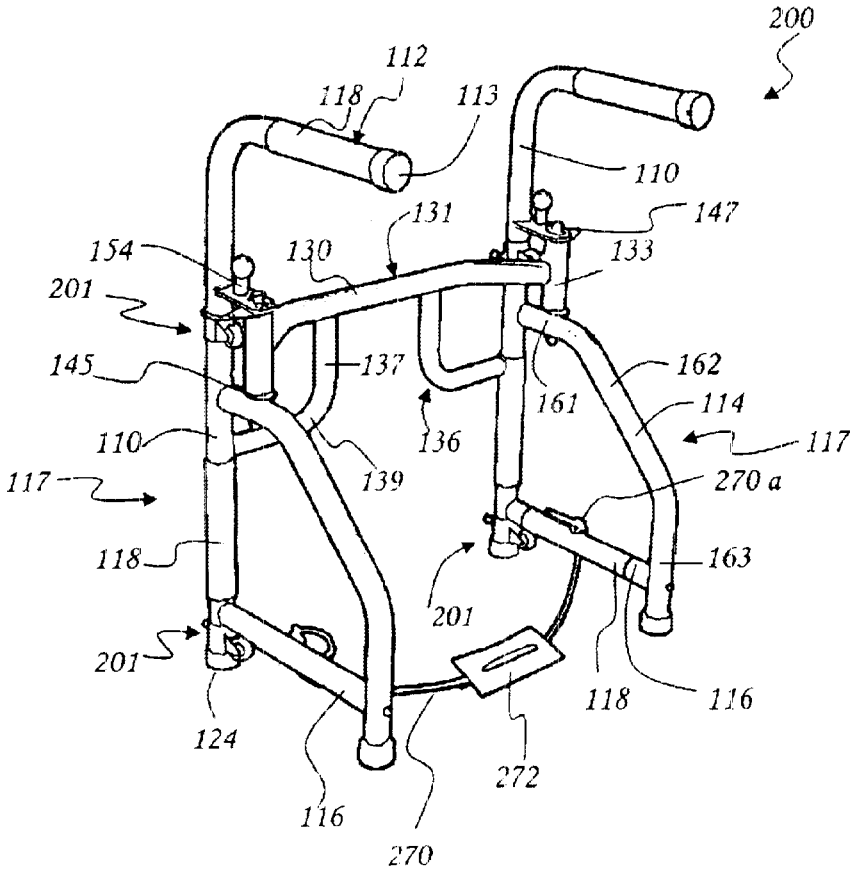
FIG. 27 is a perspective view of the third embodiment in the unfolded or erected position.
Figure 28:
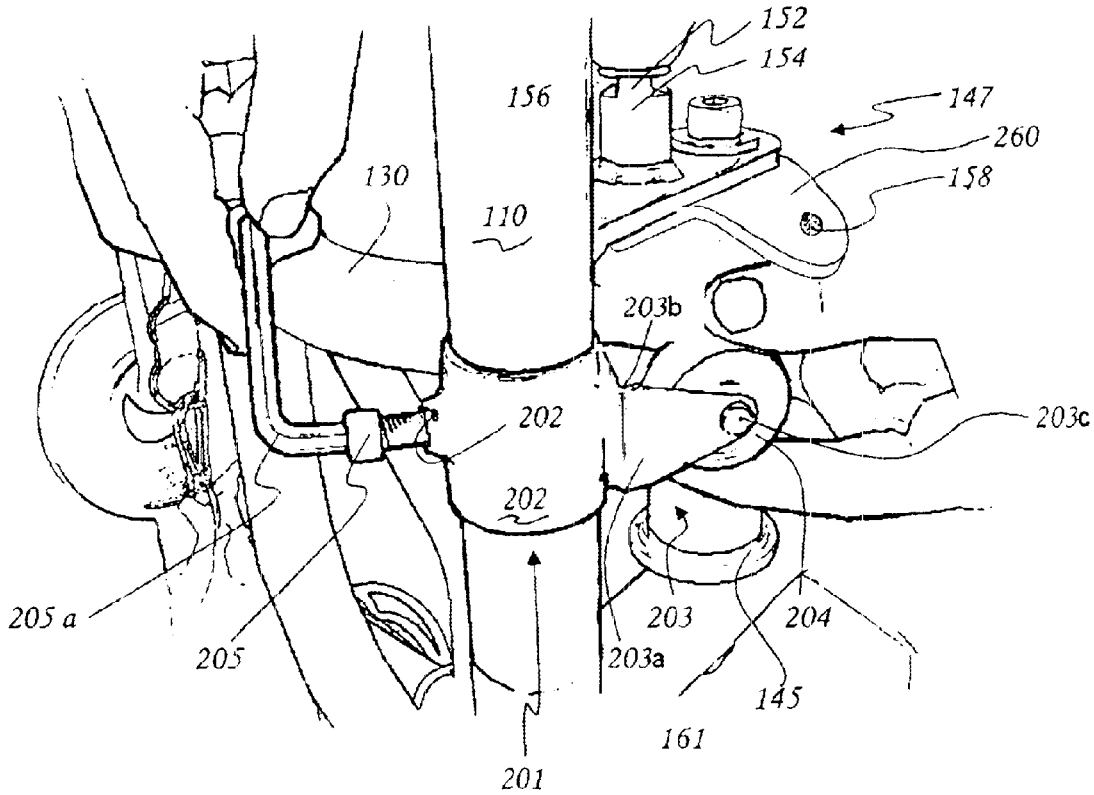
FIG. 28 is a detailed perspective view thereof showing the locking member being engaged so as to pivot the roller from a non-contact to a contact position.
Figure 29:
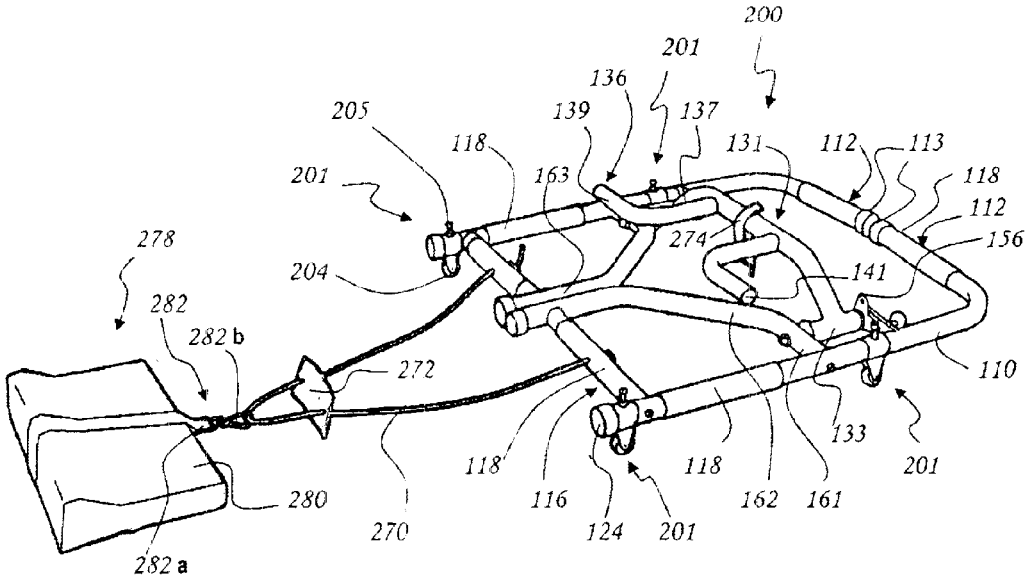
FIG. 29 is a perspective view of the third embodiment in the folded position for storage or transportation and showing the rollers in the contact position.

Turning to FIGS. 27–34, a third embodiment 200 includes rollers 201 for performing exercises, such as ab rolls and leg presses and for aiding in the portability of the apparatus. FIG. 27 shows the third embodiment in an unfolded or erect position. As best shown in FIG. 28, the rollers 201 include a tubular portion 202 that is received on one of the tubes that make up the apparatus 200, a wheel housing 203, a wheel 204 and a locking member 205. In a preferred embodiment, the apparatus includes four rollers 201, two each that are received on the front vertical supports 110 as shown in FIG. 29. The rollers 201 are spaced apart on the front vertical supports 110, thereby providing a wide wheel base and providing stability to the apparatus 200 when it is used for ab rolls or leg presses, described more fully below. In a preferred embodiment the distance L between the rollers 201 on opposite front vertical supports 110 is between about 20" and 30". Most preferably, the wheel base is approximately 26".

Figure 30:
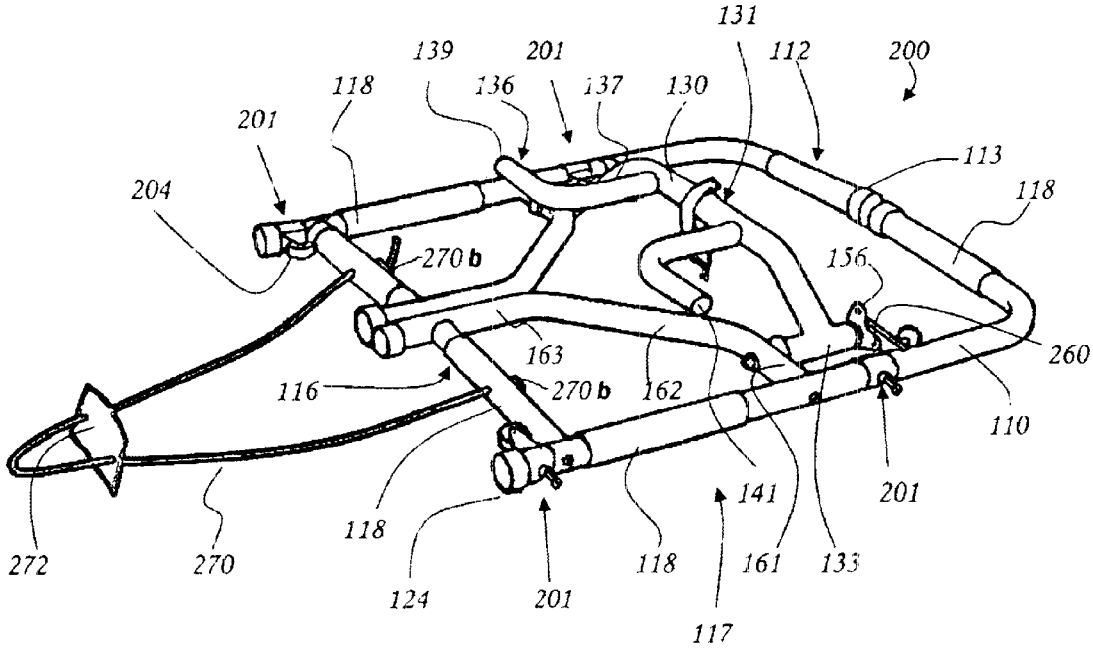
FIG. 30 is a perspective view thereof in the folded position for storage or transportation and showing the rollers in a non-contact position.

Referring again to FIG. 28, the tubular portion 202 has an opening 202*a* defined therethrough that receives the locking member 205. In a preferred embodiment, the opening 202*a* is threaded, and the locking member 205 is a bolt that can be turned in and out to engage front vertical support 110. The locking member 205 enables the rollers 201 to be pivotable between a contact or first position (where the wheels 204 contact the floor when the device is in the laid on the ground), as shown in FIG. 29, and a non-contact of second position (where the wheels 204 contact the floor when the device is in the laid on the ground), as shown in FIG. 30. To lock the rollers 201 in either the contact or the non-contact position the locking member 205 is tightened firmly against the front vertical support 110. In a preferred embodiment, the front vertical support 110 includes detents defined therein for receiving the end of the locking member 205. The detents correspond to the contact and non-contact positions. To pivot the roller 201 into the other position, the locking member 205 is loosened, the roller 201 is pivoted, and the locking member 205 is retightened against the front vertical support 110 (and in the detent, if present).

The wheel housing 203 includes a pair of opposed triangular portions 203*a*, 203*b* that are affixed to the tubular portion 202. The apex of the triangular portions is spanned by an axle 203*c* on which the wheel 204 is rotatably mounted. It will be understood that any configuration for rotatably mounting the wheel 204 to the tubular portion 202 is within the scope of the present invention.

As shown in FIG. 28, the locking member 205 is preferably an alien bolt that can be tightened using an alien wrench 205*a*. However, if the locking member 205 is threaded it can alternatively have a cantilevered portion for tightening the locking member 205 without the use of a separate tool. It will be appreciated that any threaded bolt or method for locking the rollers 201 in place can be used provided the rollers 201 are pivotable between contact and non-contact positions. For example, in an alternative embodiment, the locking member 205 may be biased inwardly by a spring where it engages a hole or detent in the tube (similar to operation of pin 152 as described above). To rotate the roller 201, the locking member 205 is pulled outwardly to overcome the spring force, pivoted and released, where the locking member 205 engages a second hole.

In the contact position, the wheel 204 and wheel housing 203 typically extend in a direction substantially perpendicular to the front and back planes 126, 125, and in the non-contact position, the wheel 204 and wheel housing 203 typically extend in a direction substantially parallel to the front and back planes.

Figure 34:
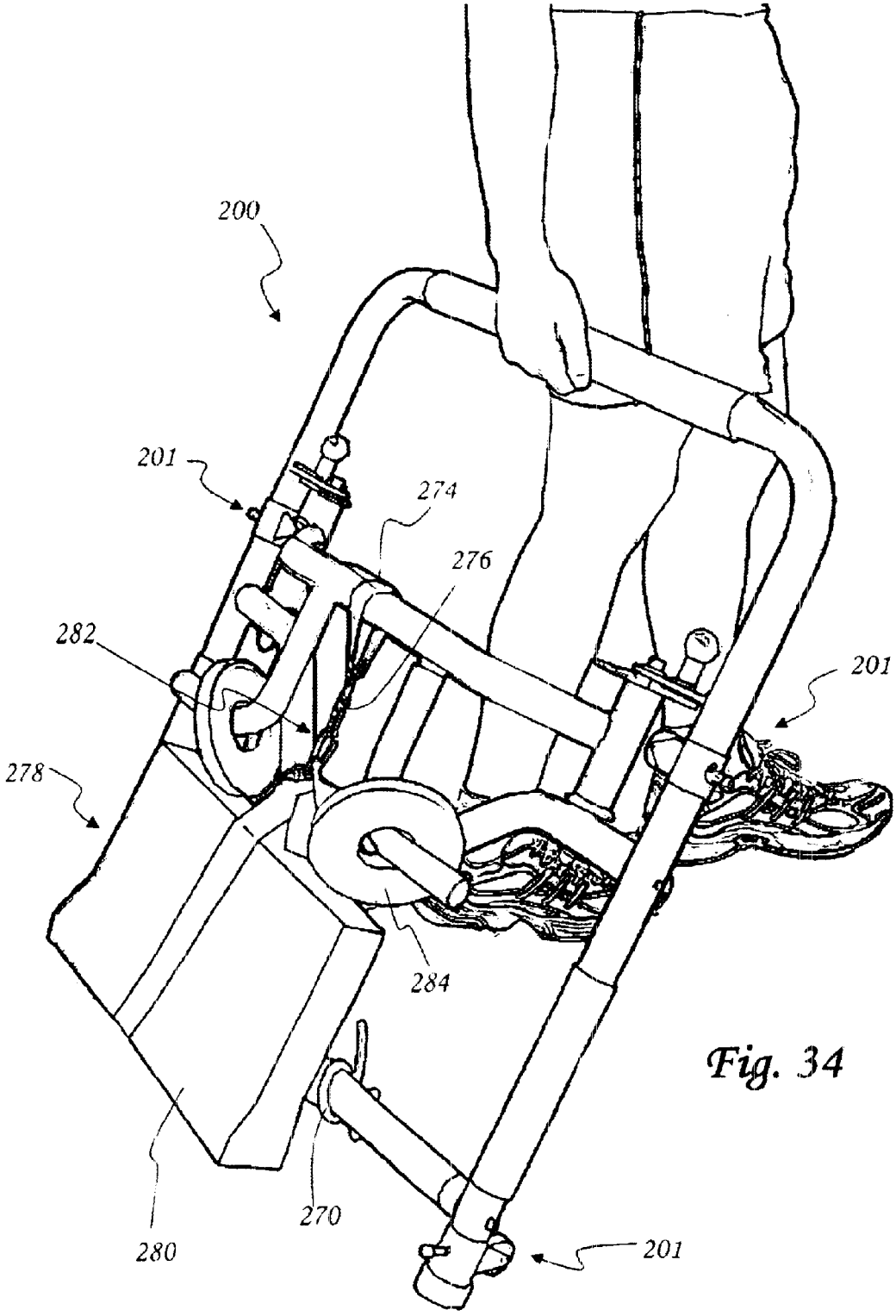
FIG. 34 is a perspective view thereof in the folded position for storage or transportation showing the rollers in a contact position and a user pulling the apparatus

In the contact position the wheels 204 generally contact the floor when the apparatus is placed on the floor, whether in the folded or unfolded position, or whether the back plane 125 or front plane 126 is supported on the floor. As shown in FIG. 34, in the contact position, the bottom wheels 204 also contact the ground when the apparatus 200 is oriented at an angle. This increases the portability of the apparatus 200, thereby allowing the user to pull and roll the apparatus 200 while walking.

In the non-contact position, the rollers 201 are pivoted inwardly or outwardly so that they will not contact the ground when the apparatus 200 is placed on the ground whether in the folded or unfolded position, or whether the back plane 125 or front plane 126 is supported on the floor.

A preferred contact position is shown in FIG. 29. In this position, the rollers 201 are positioned so that when the apparatus 200 is in the folded position and is supported on the floor so that the cross brace 131 is not in contact with the floor, the wheels contact the ground, thereby allowing the apparatus 200 to roll, as shown in FIGS. 72–74*d*.

Figure 31:
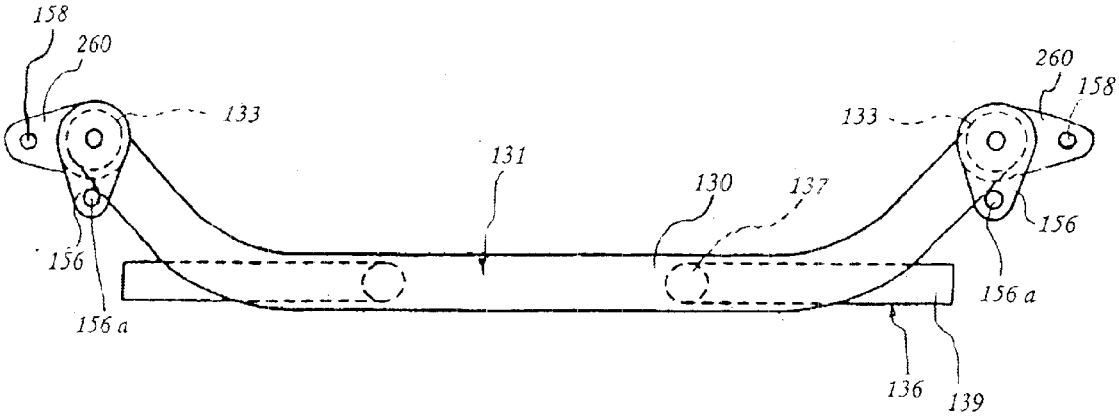
FIG. 31 is a top view thereof showing the cross brace and the locking lip.

As shown in FIG. 31, a second tube arm 260 is provided to hold the side frames 117 in place when the apparatus 200 is in the folded position. Without the second tube arm 260, the side frames 117 would drag the ground during the performance of ab roll exercises and leg presses. The tube arm 260, also aids in portability, by securing the side frames 117 in place. As described above, The quick release lock pin 152 extends through a pin holder 154 and into a first (open position) hole 156*a* on a tube arm 156 attached on top of the end tube 133. The pin 152 is spring biased downwardly into the tube arm 156. A folded or closed position hole 158 extends through the tube arm 156 on the same radius from the pivot pin 155 as the first hole. In another embodiment, tube arm 156 and second tube arm 260 can be formed as a unitary piece.

Referring to FIGS. 27, 29, 30, and 32–33, apparatus 200 includes a bungee cord 270 (bungee) secured thereto. Preferably, the bungee 270 is secured to the horizontal braces 116, as shown in the figures. However, it will be understood that the bungee 270 can be secured to any piece of tubing on the apparatus 200 and those skilled in the art will be able to modify the placement of the bungee cord hh as necessary.

Figure 32A:
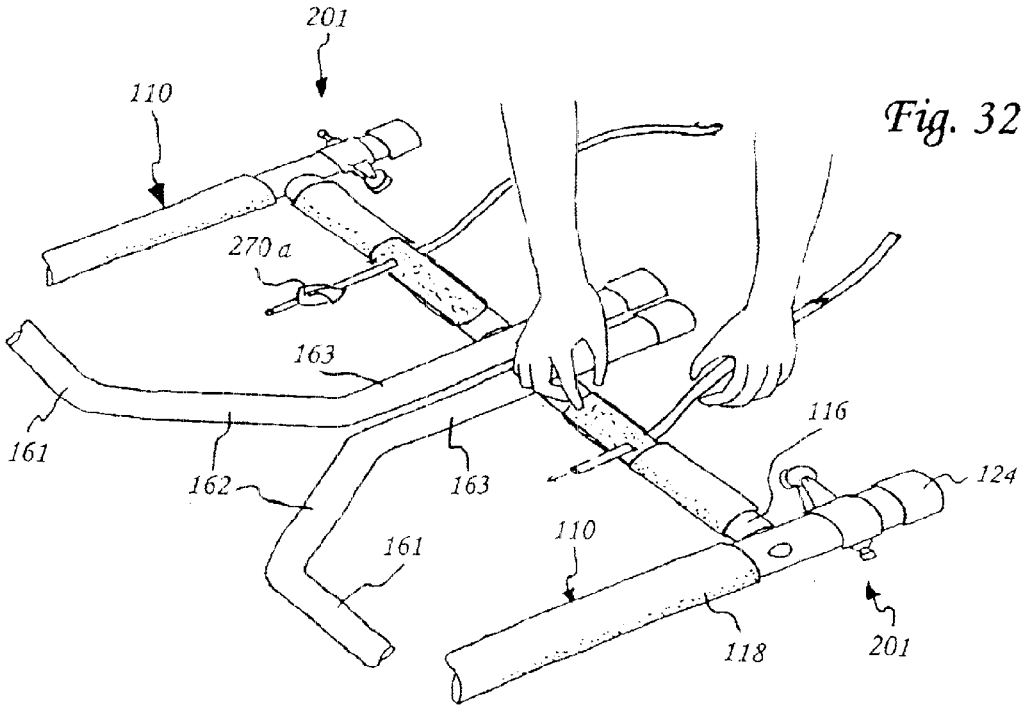
FIG. 32*a* is a partial perspective view thereof showing the insertion of a bungee into the horizontal brace before being tied off.
Figure 32B:
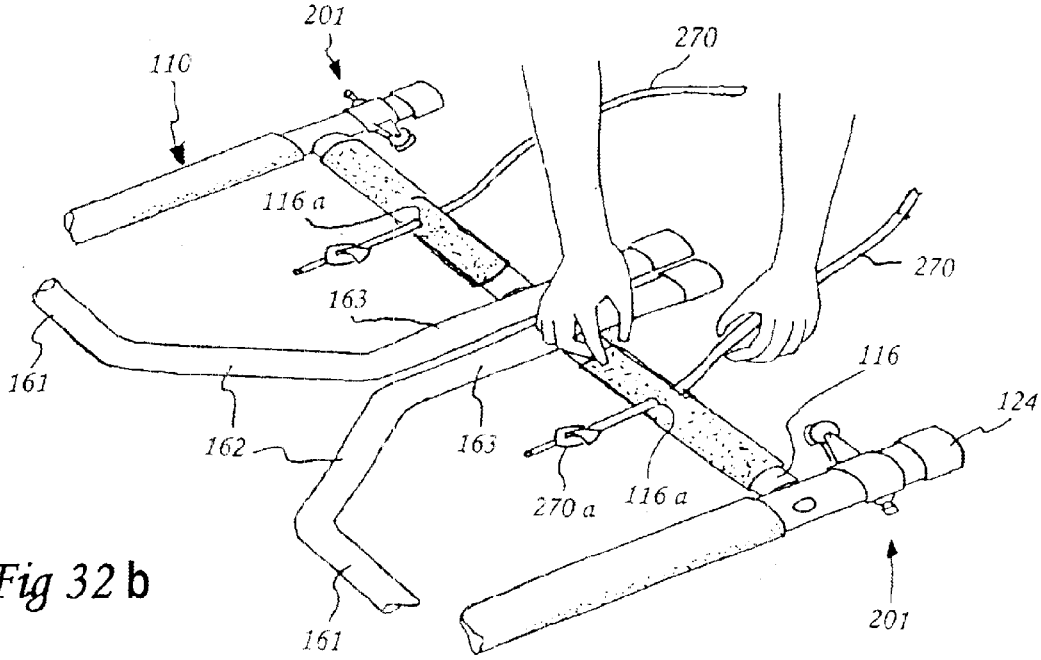
FIG. 32*b* is a partial perspective view thereof showing the insertion of a bungee into the horizontal brace after being tied off.

As shown in FIGS. 32*a*–32*b*, the bungee 270 can be secured to the horizontal braces 116 or other tubing by slipping an end through an opening 116*a* defined through the horizontal brace 116 and tying the end of the cord in a knot 270*a*. In another embodiment, the bungee 270 can include a fastener or clip 270*b* (as shown in FIG. 30), such as a cotter pin, for securing the bungee 270 and preventing it from slipping back through the openings 116*a*. Or, the bungee 270 can be secured to the apparatus 200 by tying the ends around a tube or tubes. The clip 272 allows the bungee 270 to be removed and stored when not in use. In a preferred embodiment, the bungee 270 includes a handle 272 or pad. The handle 272 includes a pair of openings through which the bungee cord 270 extends. The handle 272 can be grasped by folding it around the bungee 270 when doing exercises such as curls (see FIG. 46), or it can serve as a pad for a body part, such as the ankle, when doing certain exercises (see FIG. 40). This type of handle 270 is advantageous because it acts as a pad. A round handle can be used as well, however the pad-type handle 270 is preferably because a round handle tends to roll up the leg when performing leg extensions and the like. To add more resistance to an exercise, more tubing is pulled through openings 116*a*, thereby shortening the useable portion of the bungee cord hh. This provides even more versatility to apparatus 200.

Alternatively, bungee 270 can be secured to the cross brace 131, and more particularly the horizontal cross support 130 of the cross brace 131. In a preferred embodiment, the bungee cord 270 is secured to the cross support 130 by a strap 274 (such as a VELCRO® strap) having a clip 276 thereon. The strap 274 and clip 276 are shown in FIG. 34.

Figure 33:
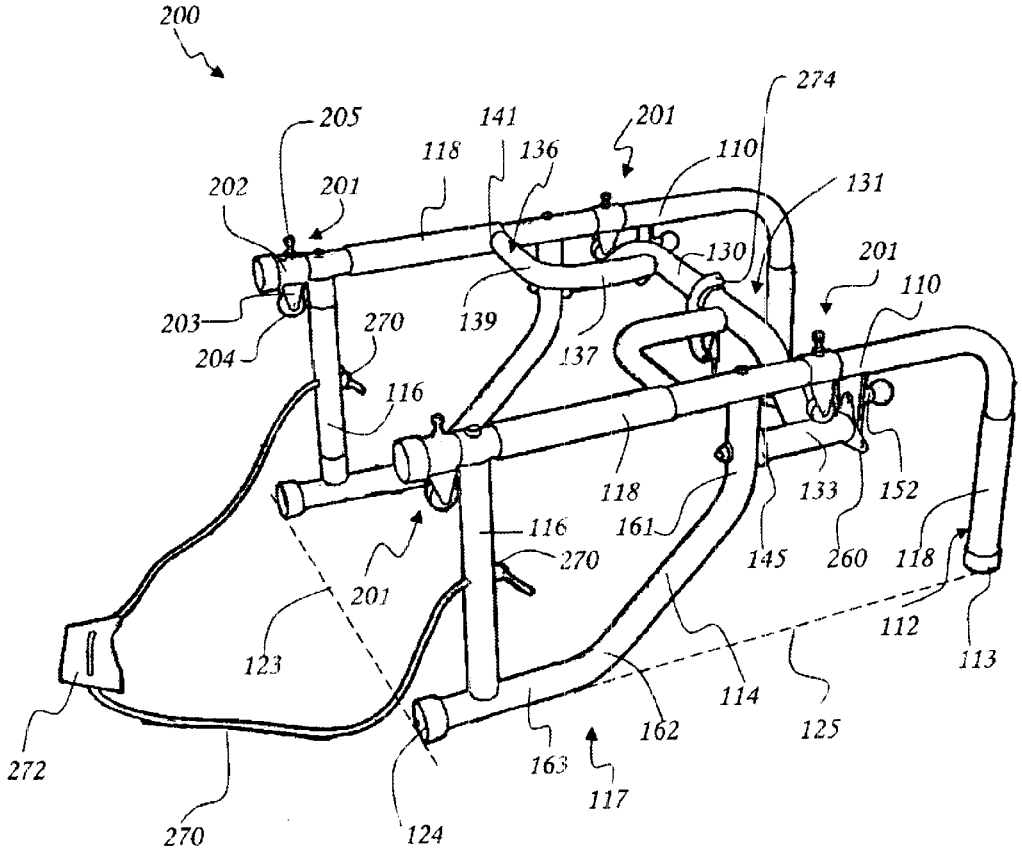
FIG. 33 is a perspective view thereof in the unfolded or erected position with the back plane supported on the floor.

The bungee 270 is useful for strength and toning exercises. It is also useful for rehabilitation after injuries. As described below, most of the bungee exercises can be performed on three levels, 1) with the apparatus 200 in the upright position (as shown in FIG. 27) in the unfolded position, with the back plane 125 supported on the ground (as shown in FIG. 33), and in the folded position (as shown in FIG. 30).

Referring to FIGS. 29 and 34, the apparatus 200 preferably includes a seat attachment 278. The seat attachment 278 can be used for a plurality of different exercises by placing it both on the ground or on the apparatus 200. The seat attachment 278 includes a seat portion 280 and an attachment portion 282. In a preferred embodiment the seat portion 280 has a wedge shape to help prevent the seat portion 280 from slipping out from under the user when performing exercise such as ab rolls, where the bungee 270 is used. Preferably, the attachment portion 282 includes a strap 282*a* that is affixed to the seat portion 280 and a clip 282*b*. The clip 282*b* allows the seat attachment 282 to be attached to different components of the apparatus 200, for example, the bungee cord 270, or clip 276 on the cross brace 131, as shown in FIG. 34. A user can use the seat portion 280 to support many different body parts, such as the butt, elbows, or knees during different exercises.

Figure 35:
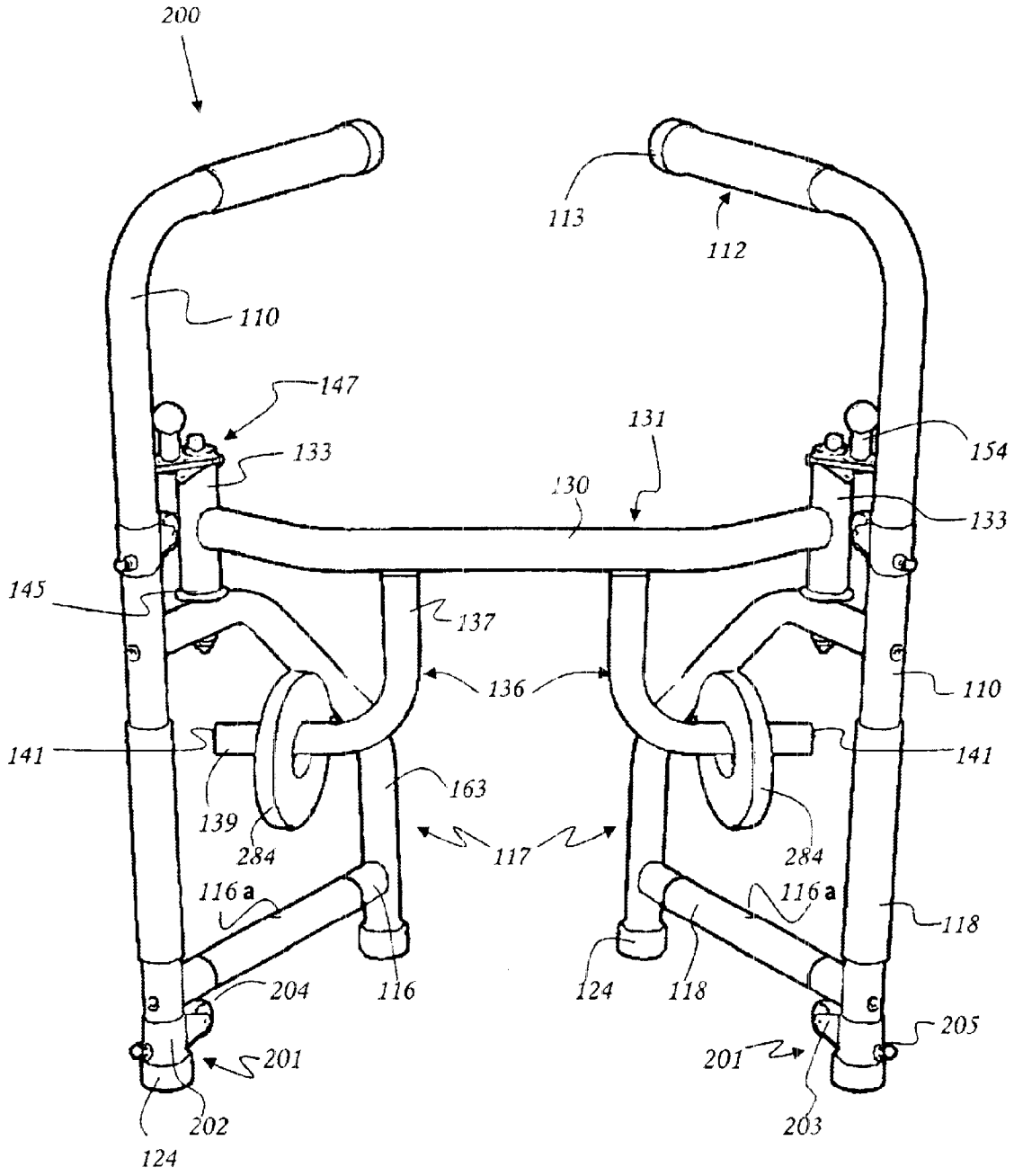
FIG. 35 is a front perspective view thereof in the partially folded position showing the weights placed on the ends of the mid-bars.
Figure 36:
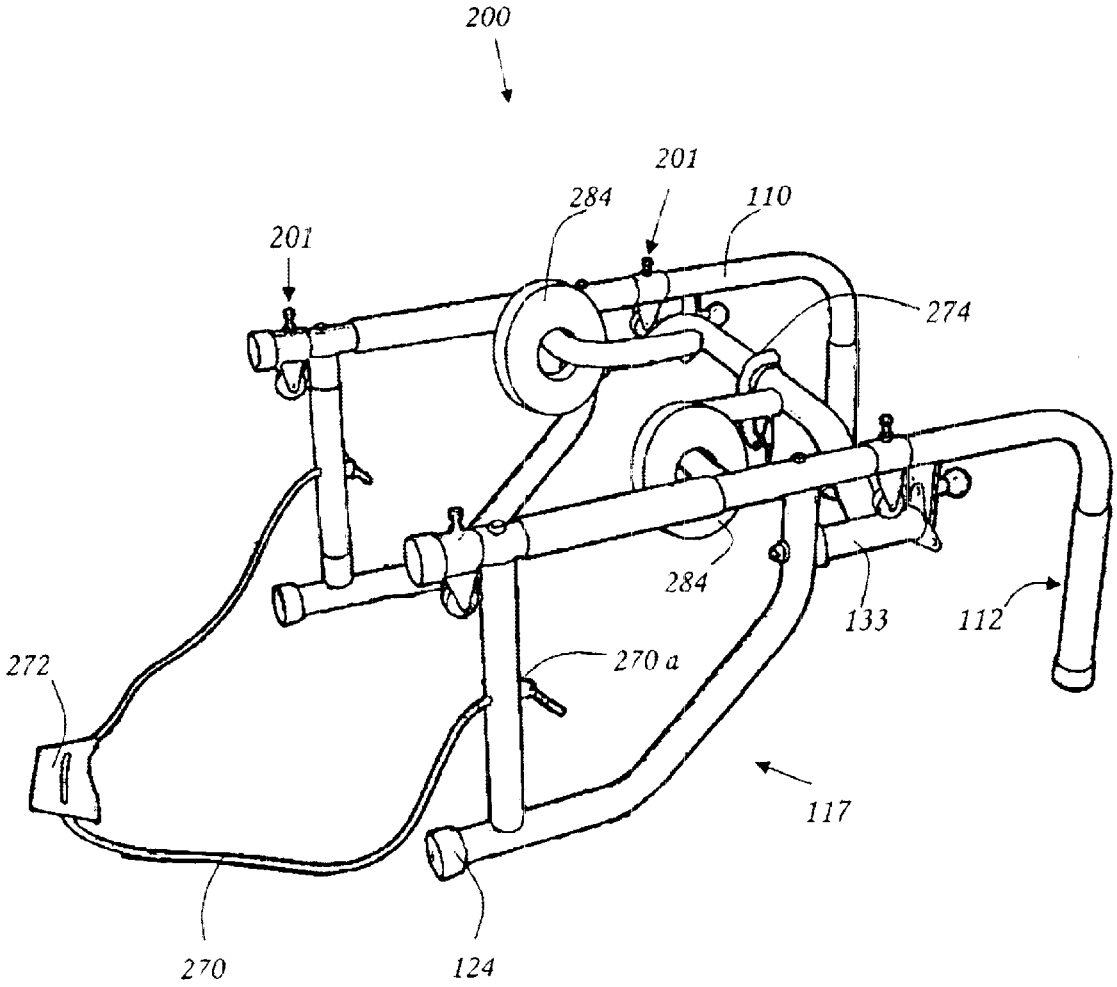
FIG. 36 is a perspective view thereof in the unfolded or erected position with the back plane supported on the floor showing the weights placed on the mid-bars.
Figure 37:
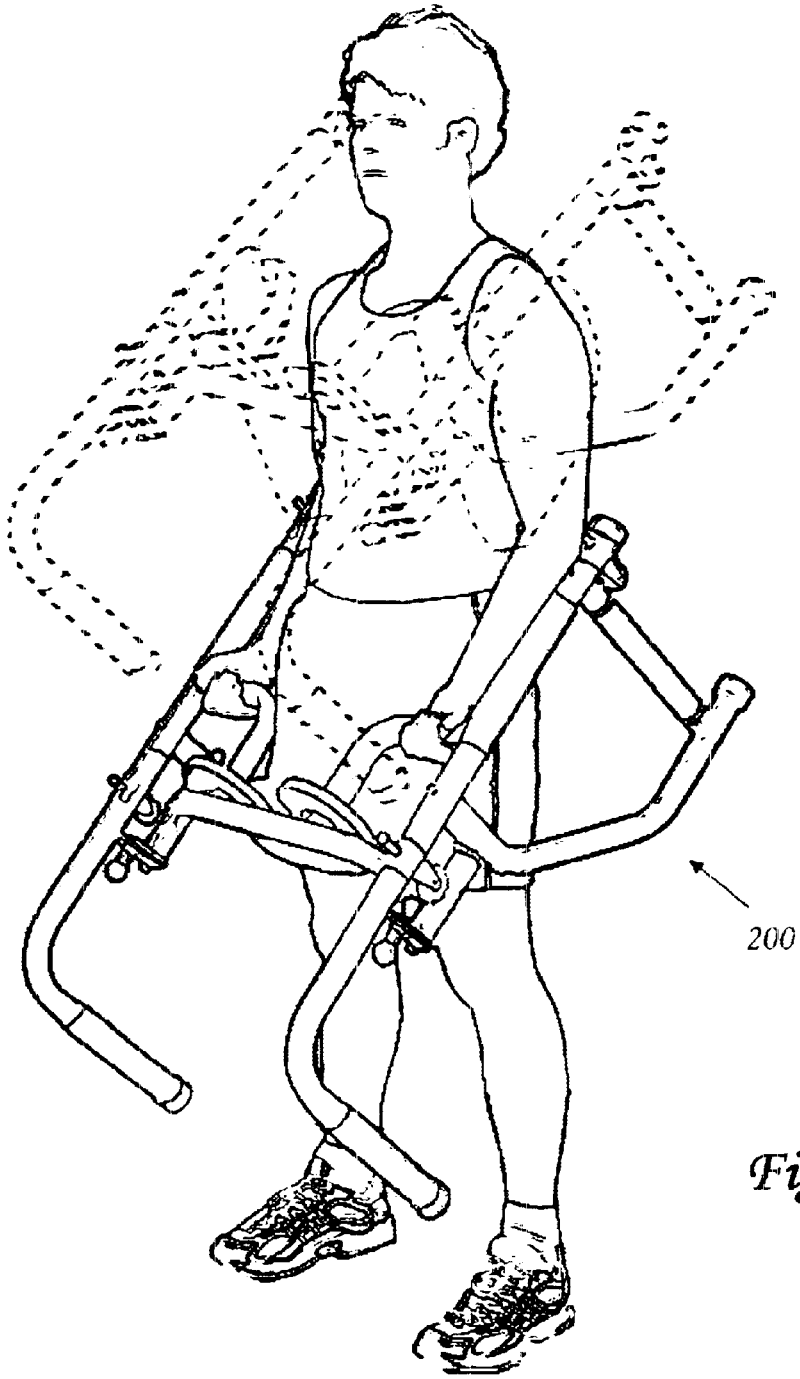
FIG. 37 is a perspective view showing a user curl the apparatus with the weights on the mid-bars
Figure 38:
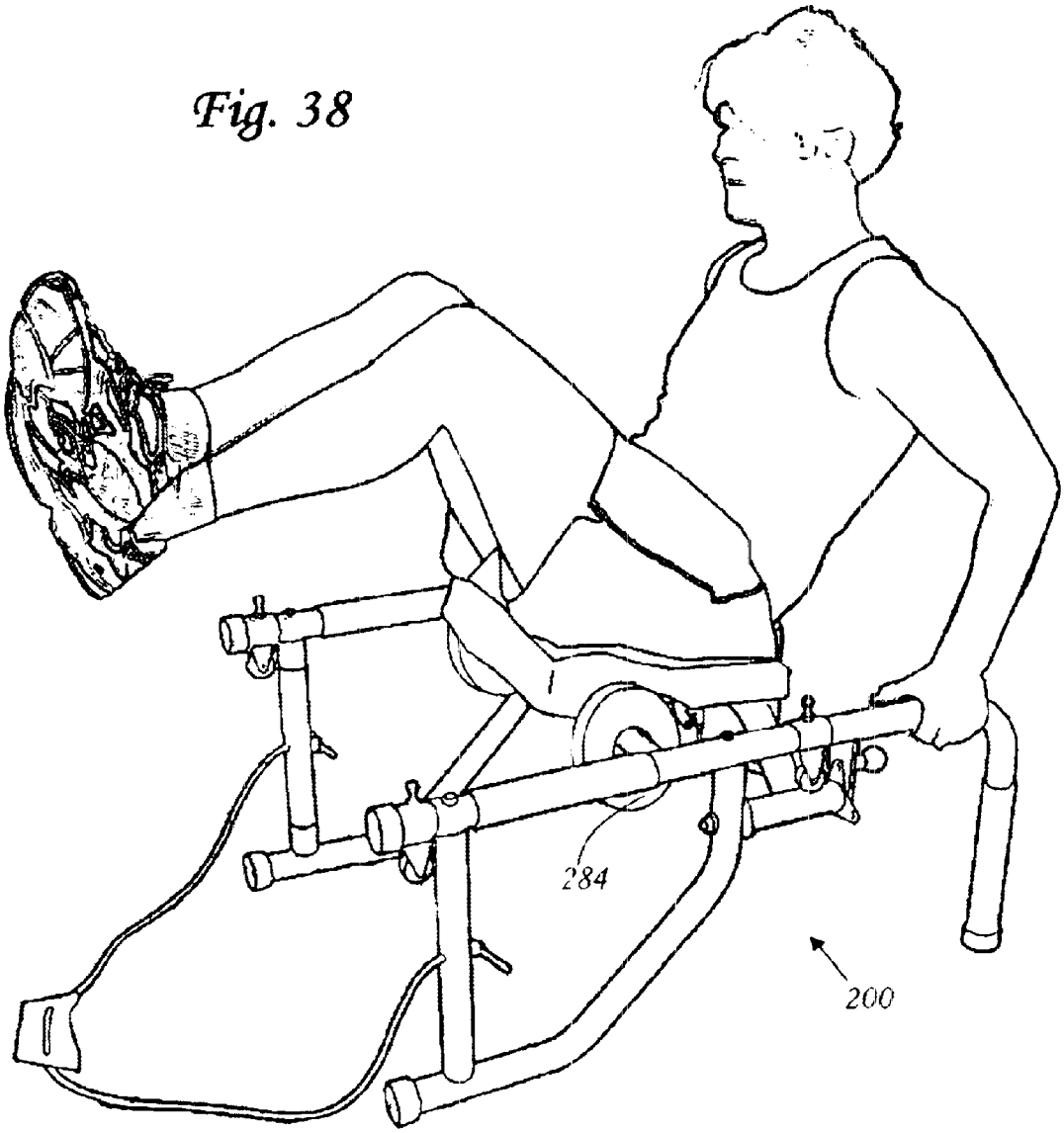
FIG. 38 is a perspective view showing a user performing an exercise on the apparatus with the weights on the mid-bars showing that the weights do not get in the way when performing exercises that do not utilize the weights.

Referring to FIGS. 34–38, to further enhance versatility, weights 284 can be added to the apparatus 200. For those persons that need more weight than the apparatus 200 alone can provide for exercises such as curls (see FIG. 37), upright rows and shoulder presses, weights, such as those shown in the figures are placed on the right angle mid bars 136 when the apparatus 200 is in the folded or partially folded position, as shown in FIG. 35. When the apparatus is unfolded, as described above, the ends 141 of the horizontal mid-bar sections 139 are dimensioned so that with the apparatus 200 in the unfolded or erected condition, the mid-bar ends 141 touch the front vertical supports 110, or handgrips 118 provided on the front vertical supports 110. This prevents the weights 284 from falling off of the mid bars 136. The weights 284 also double as an anchor during exercises using the bungee cord 270. As shown in FIG. 38, the weights 284 can be left on the apparatus 200 when performing other exercises, without getting in the way. Also, the bungee 270 can be placed over the ankles to add resistance for doing the leg extension-type ab crunches shown in FIG. 38.

Figure 39:
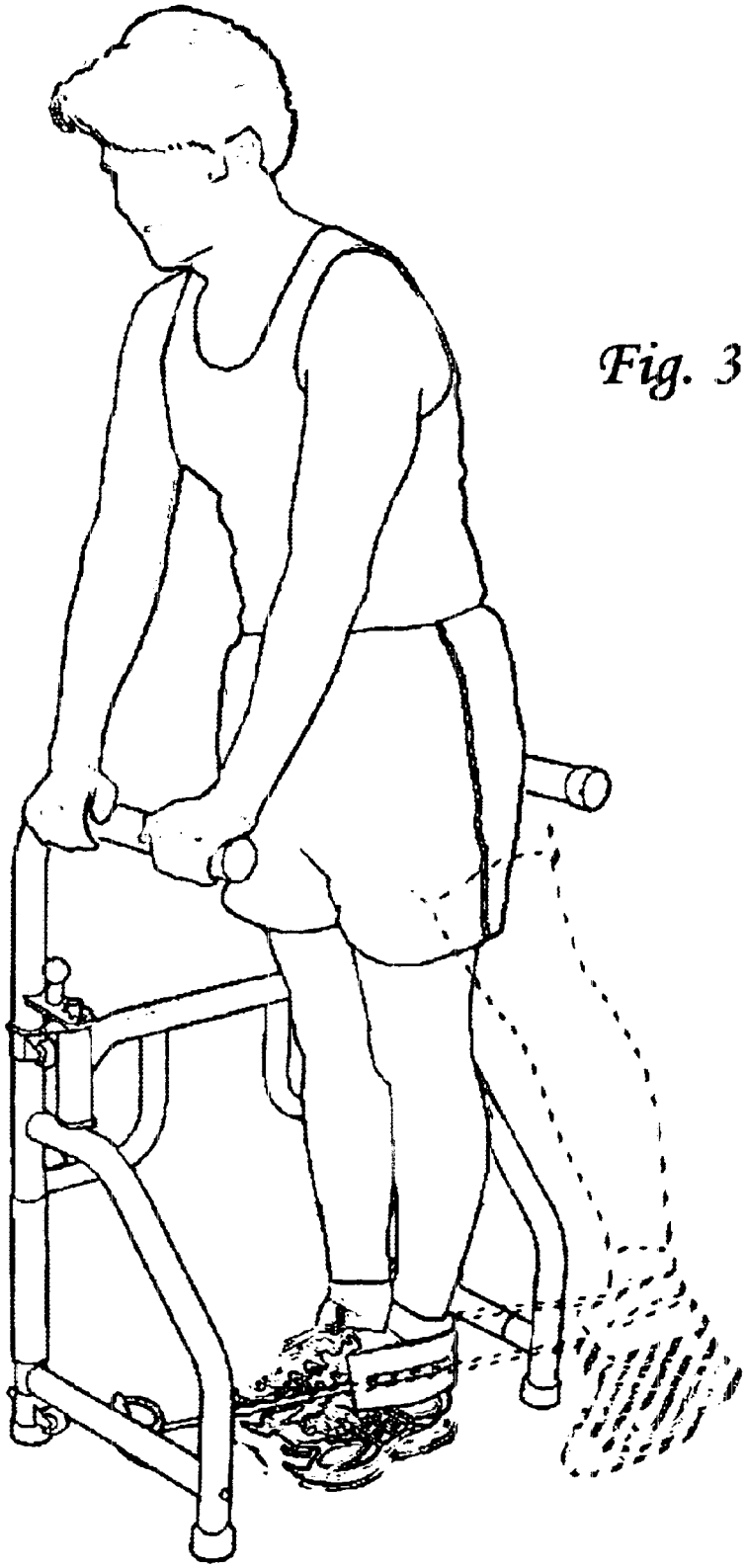
Figure 40:
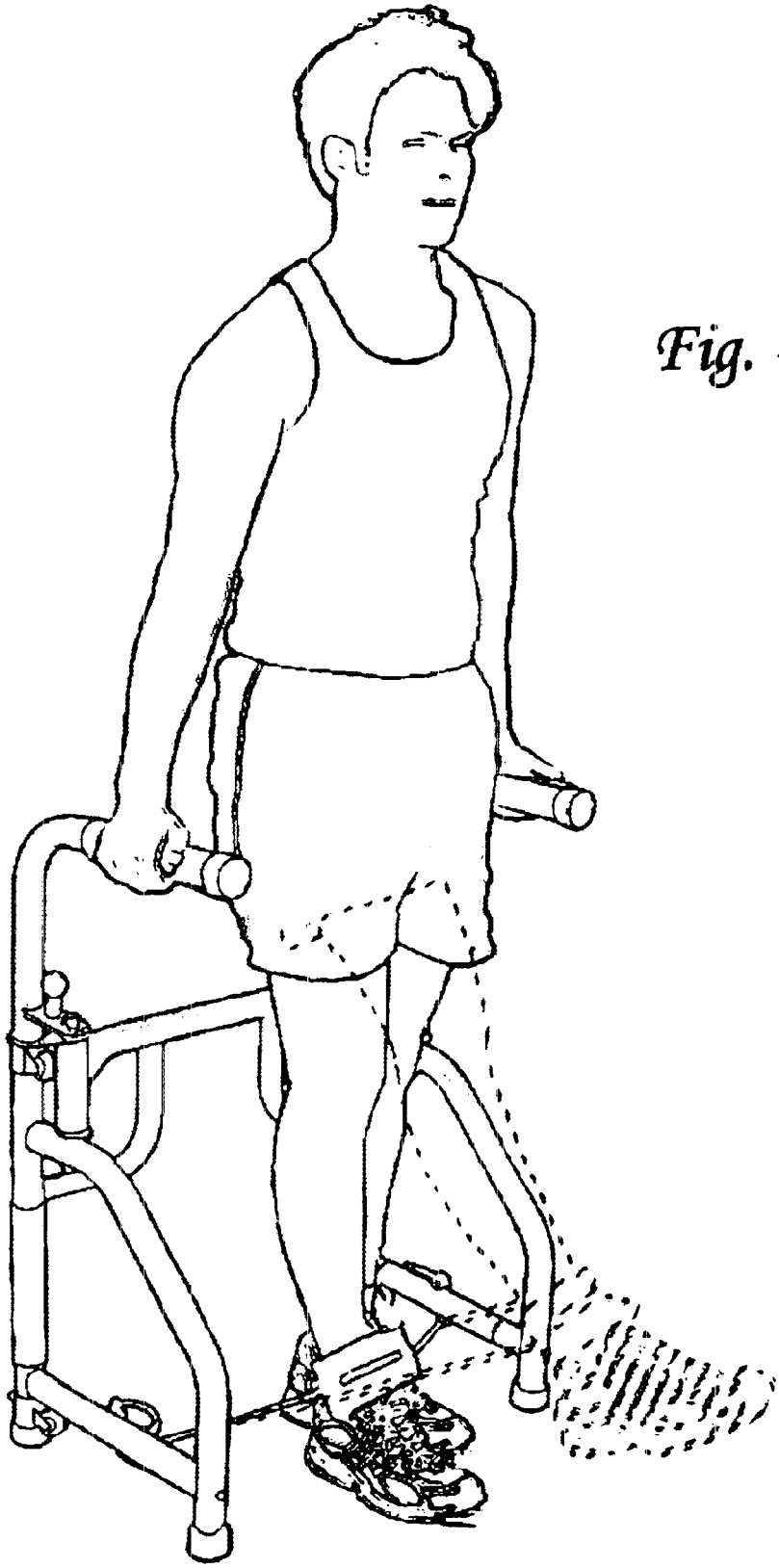
Figure 41:
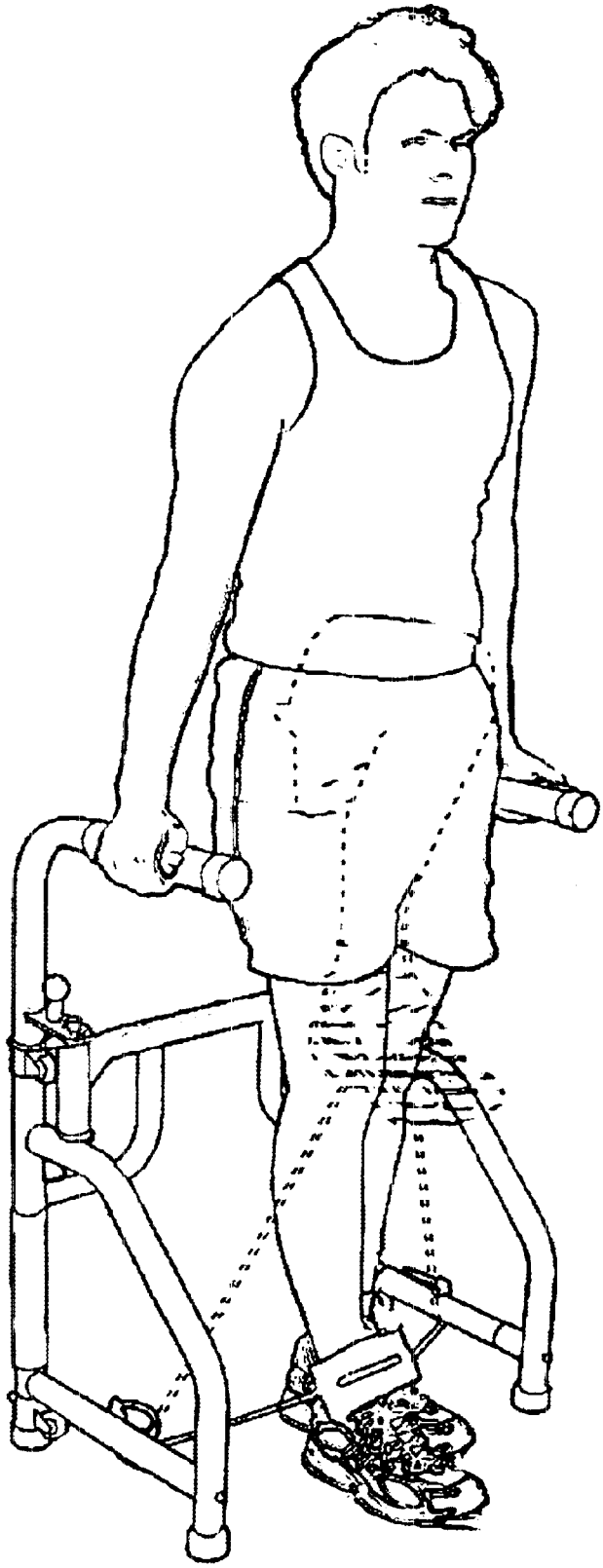
Figure 42:
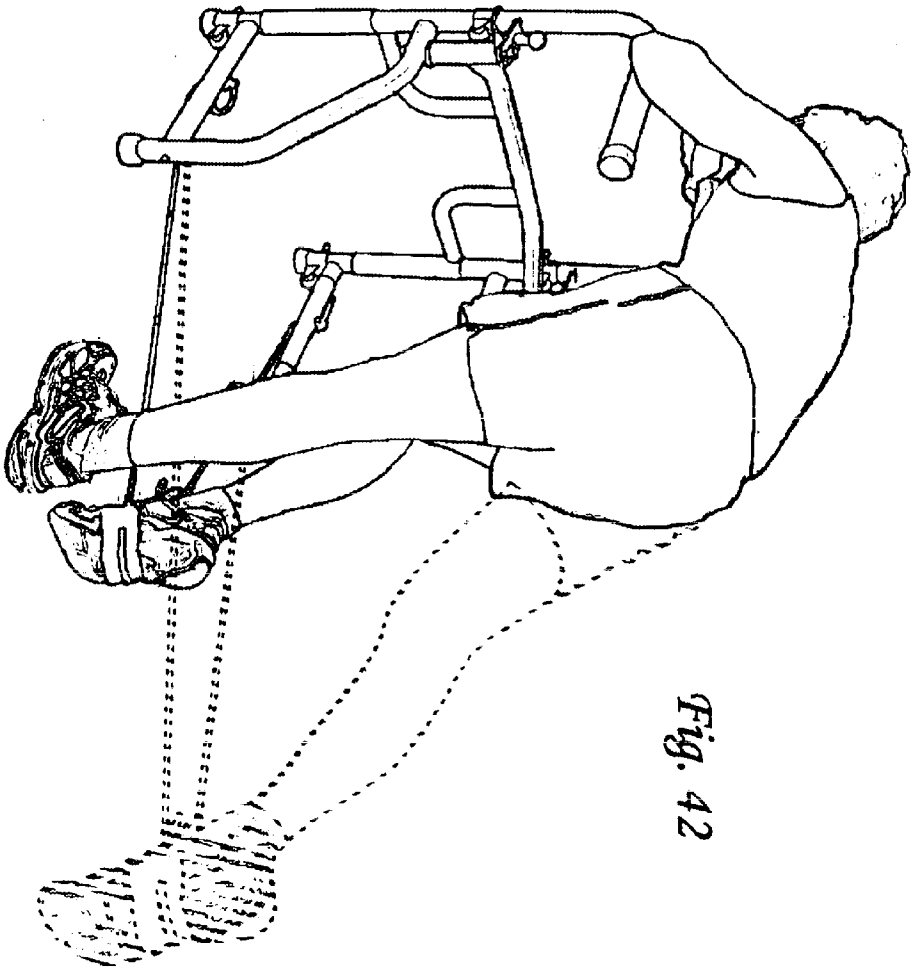
Figure 43:
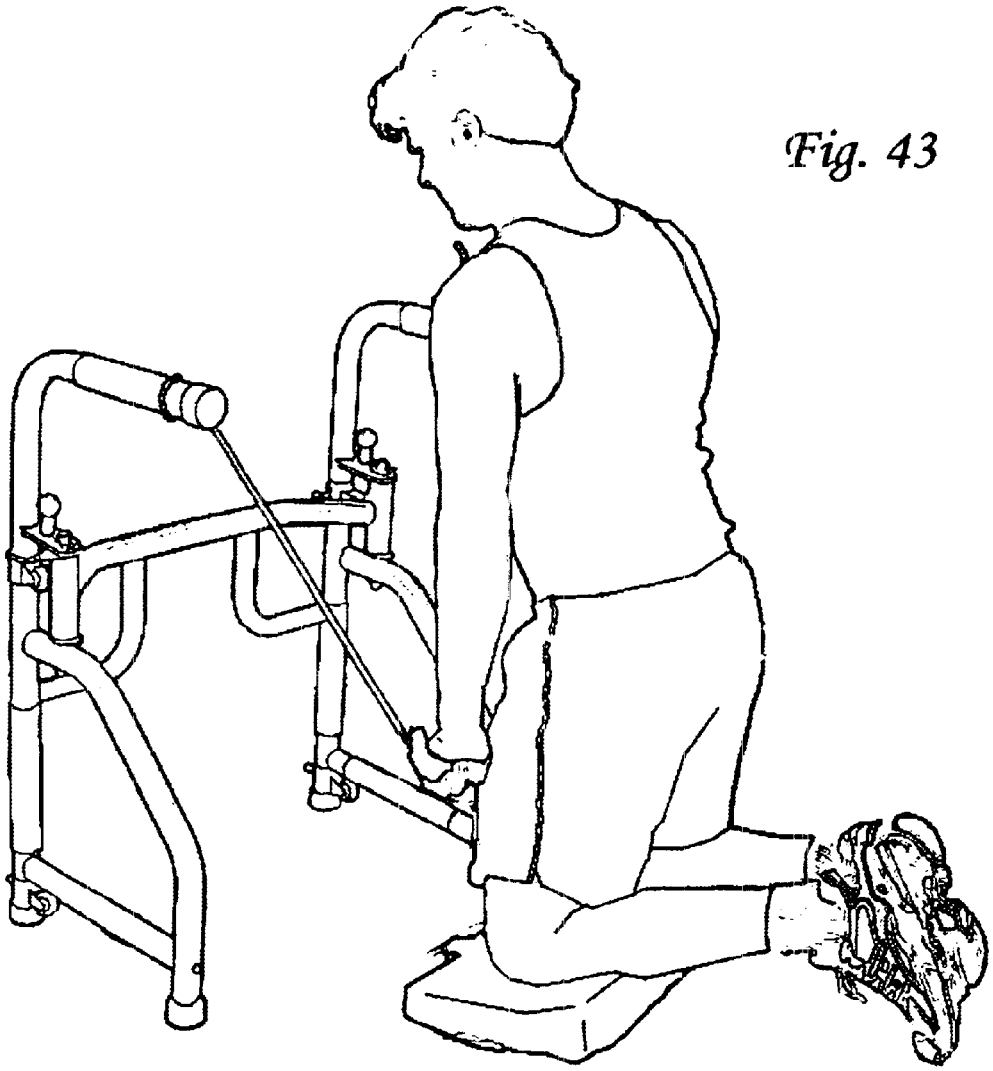

In use, the apparatus 200 operates in a manner similar to the second embodiment 100, as shown in FIGS. 1–7. As shown in FIGS. 8–26, with the apparatus 200 in the unfolded or erected and vertically upright position, the apparatus 200 is useful for performing the exercises listed above with respect to the second embodiment 100 and is also useful for performing a number of exercises using the bungee cord 270. With the apparatus 200 in this position, the user is able to balance himself while performing exercises using the bungee 270. For example the apparatus can be used for performing side or front leg raises, as shown in FIGS. 39 and 40; knee raises for isolating the abs and hip flexors, as shown in FIG. 41 with the user standing between the handlebars 112; or rear leg presses for isolating the gluts, as shown in FIG. 42 with the user leaning on the handlebars 112. As shown in FIG. 43, the bungee 270 can be tied to the handle bars 112 and used for tricep extensions. Note the use of the seat attachment 278 under the knees of the user.

Figure 44:
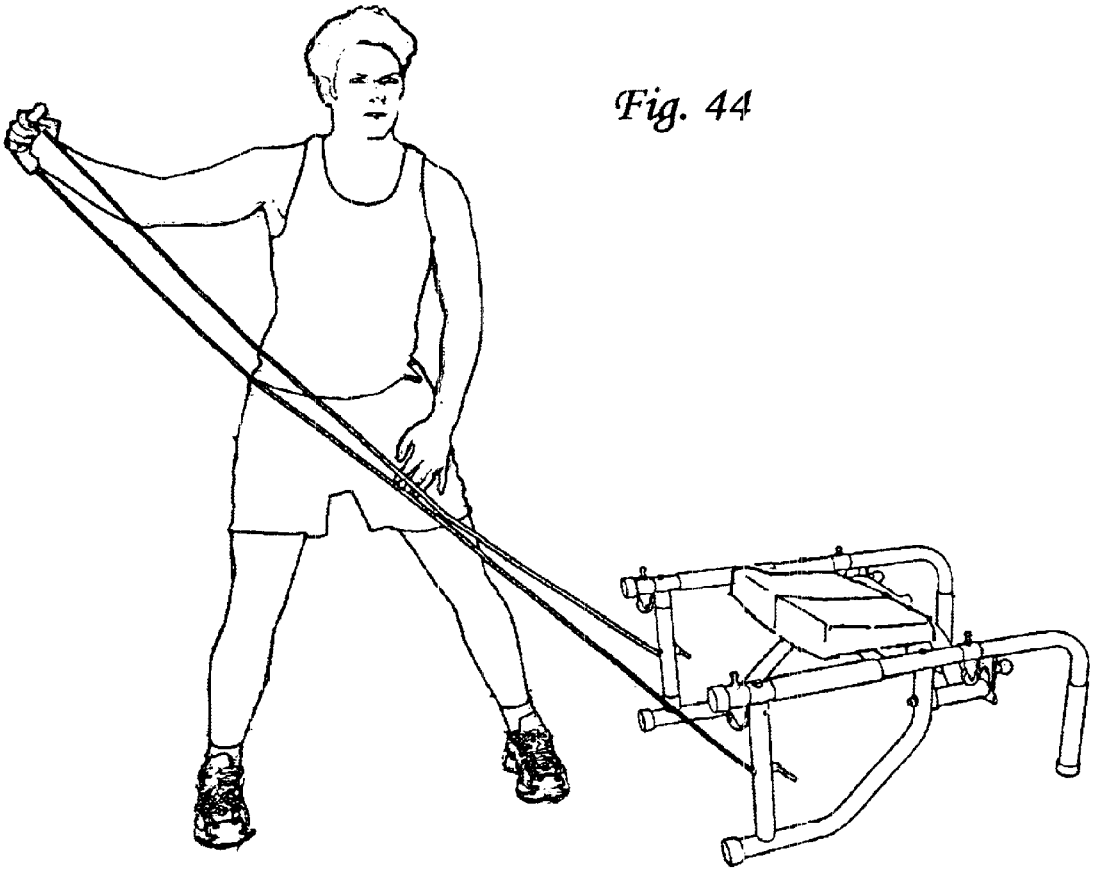
Figure 45:
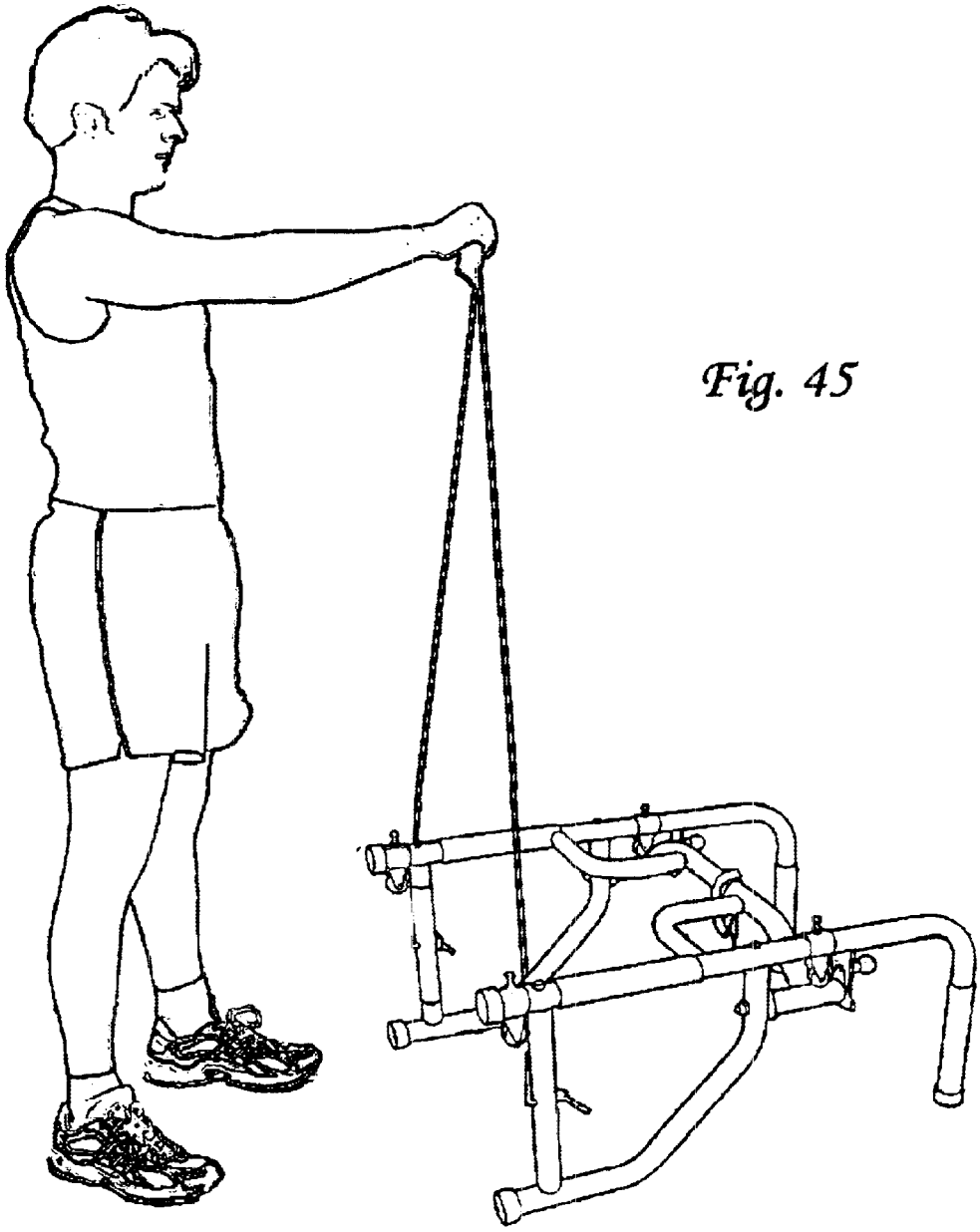
Figure 46:
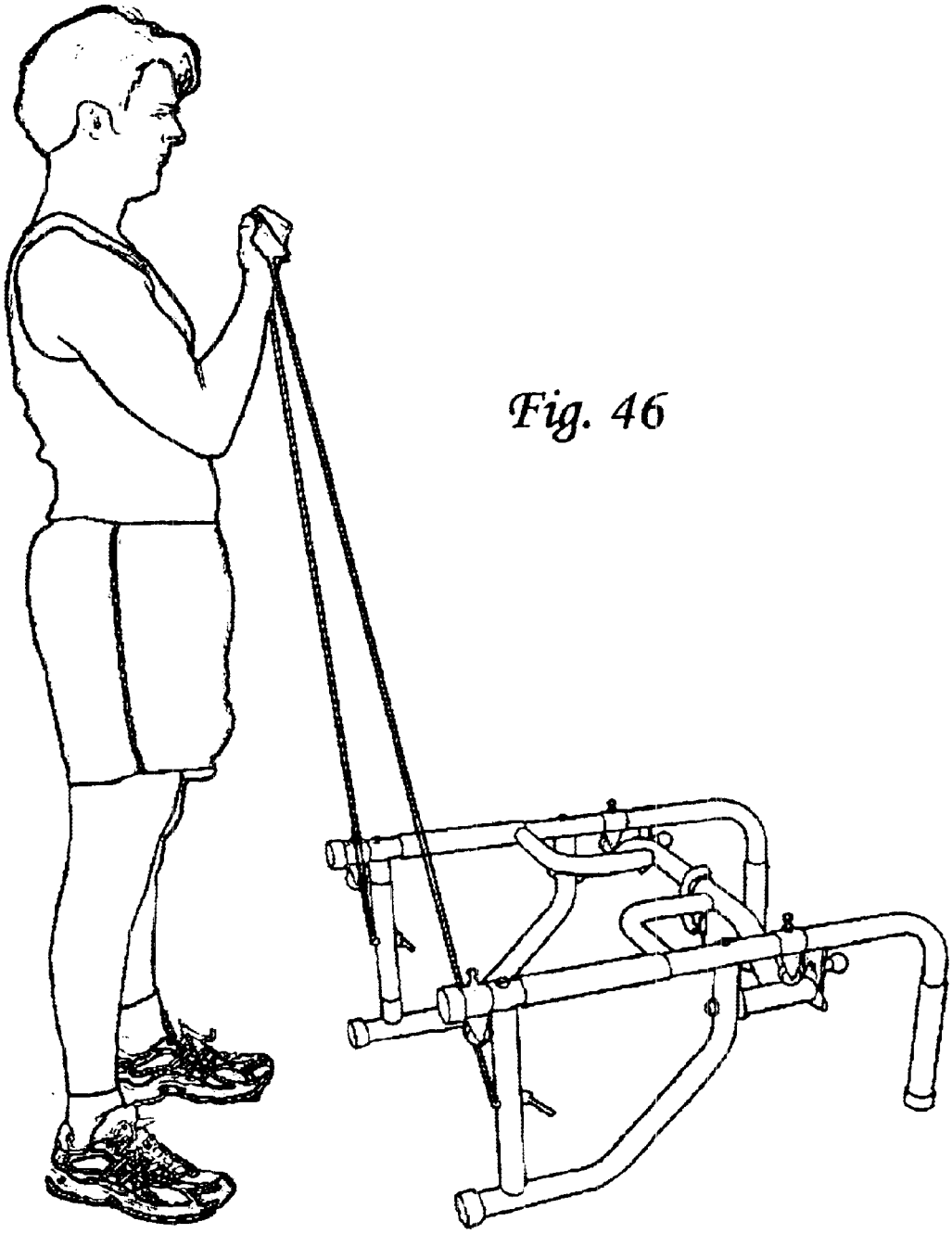
Figure 47:
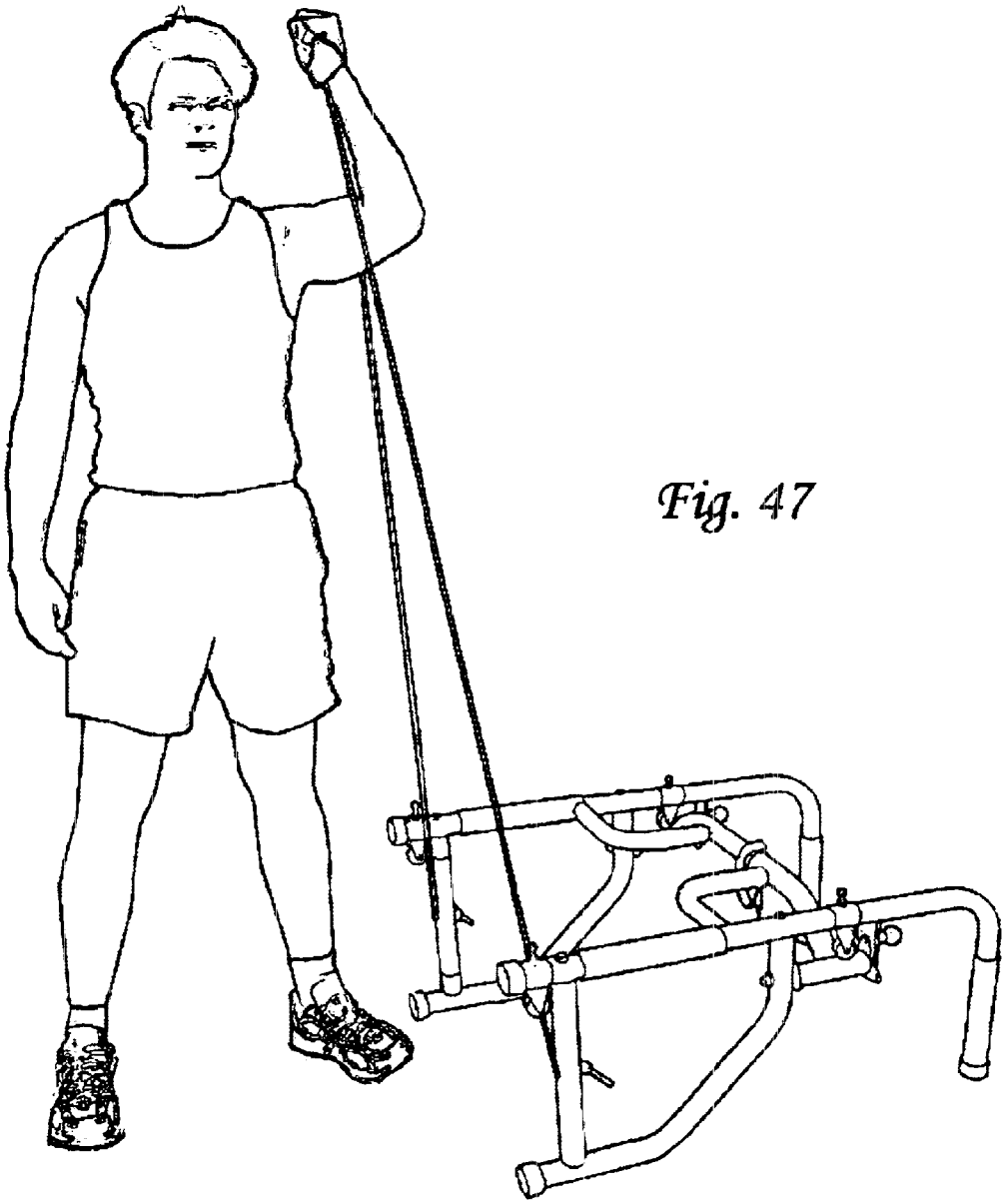
Figure 48:
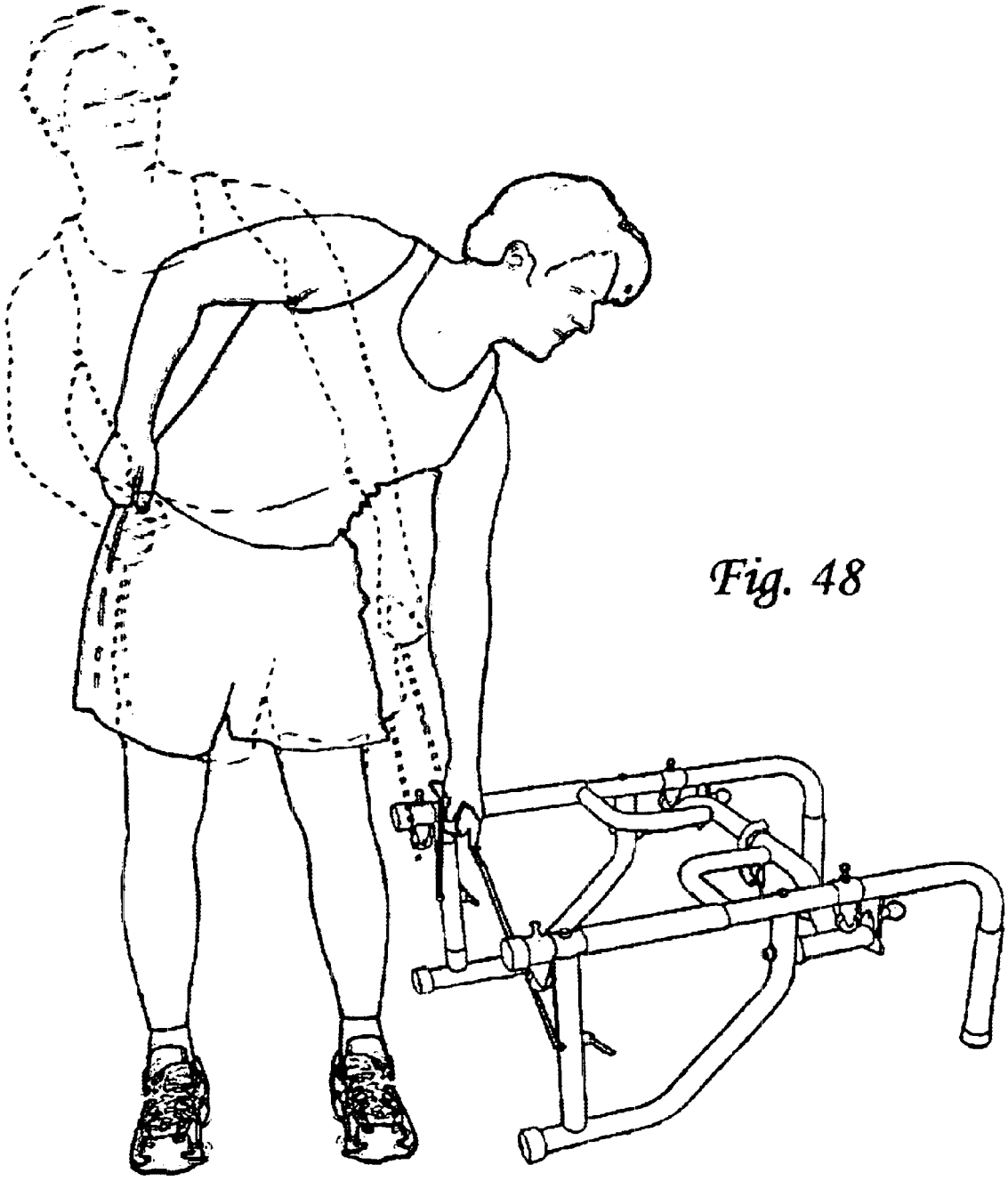
Figure 49:
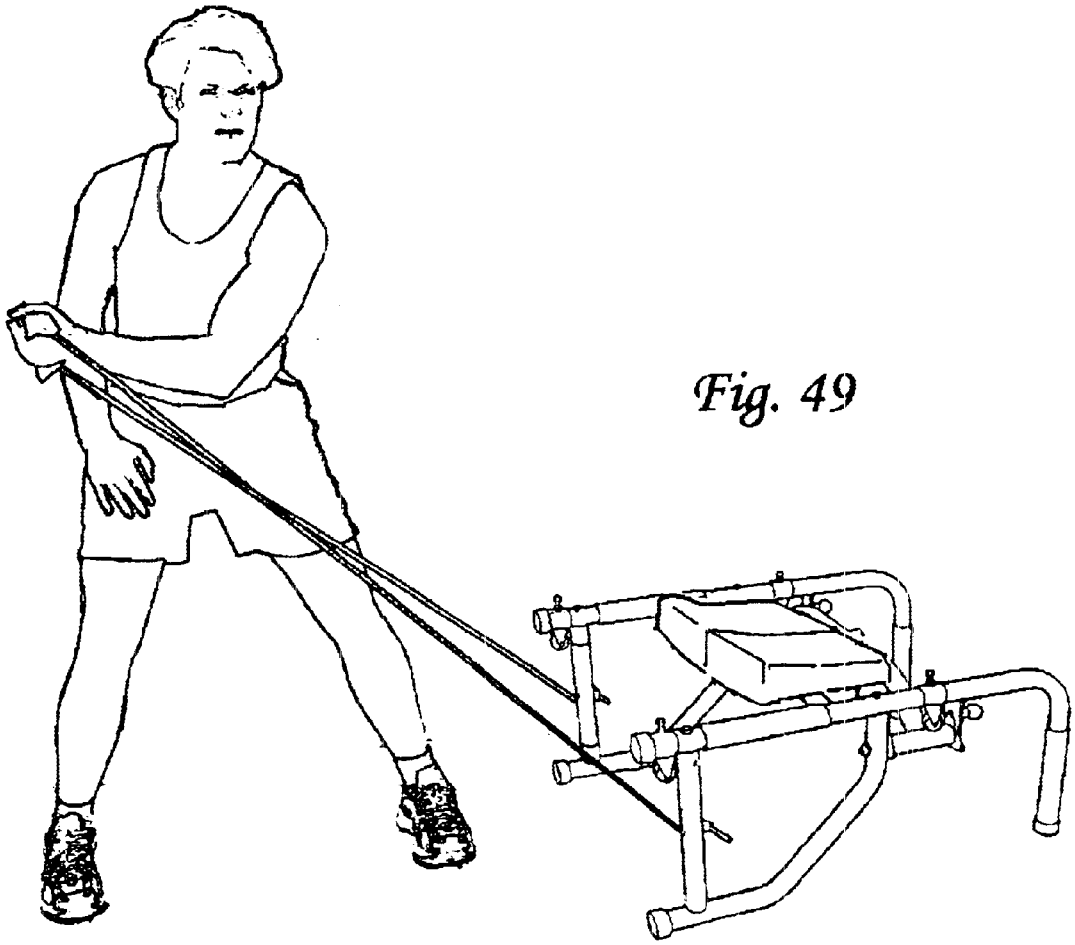
Figure 50:
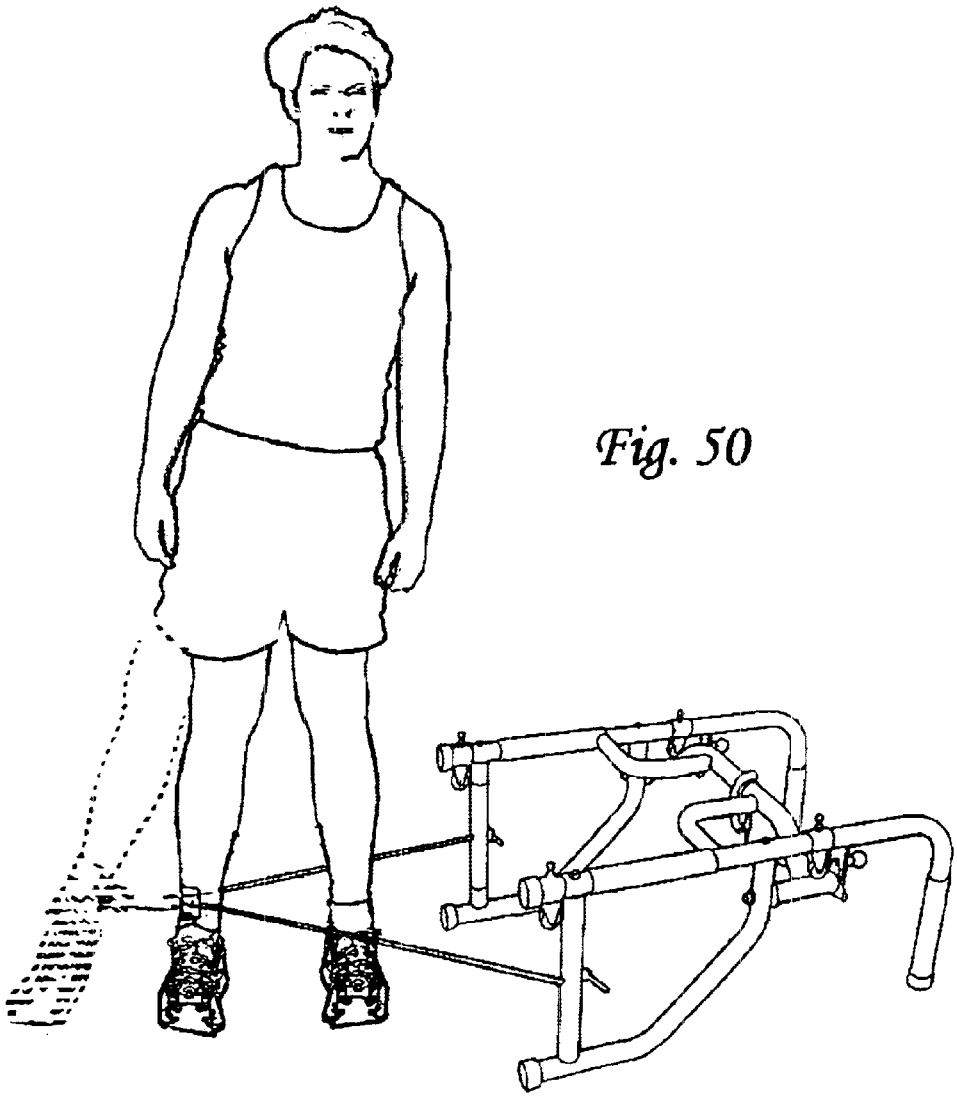
Figure 51:
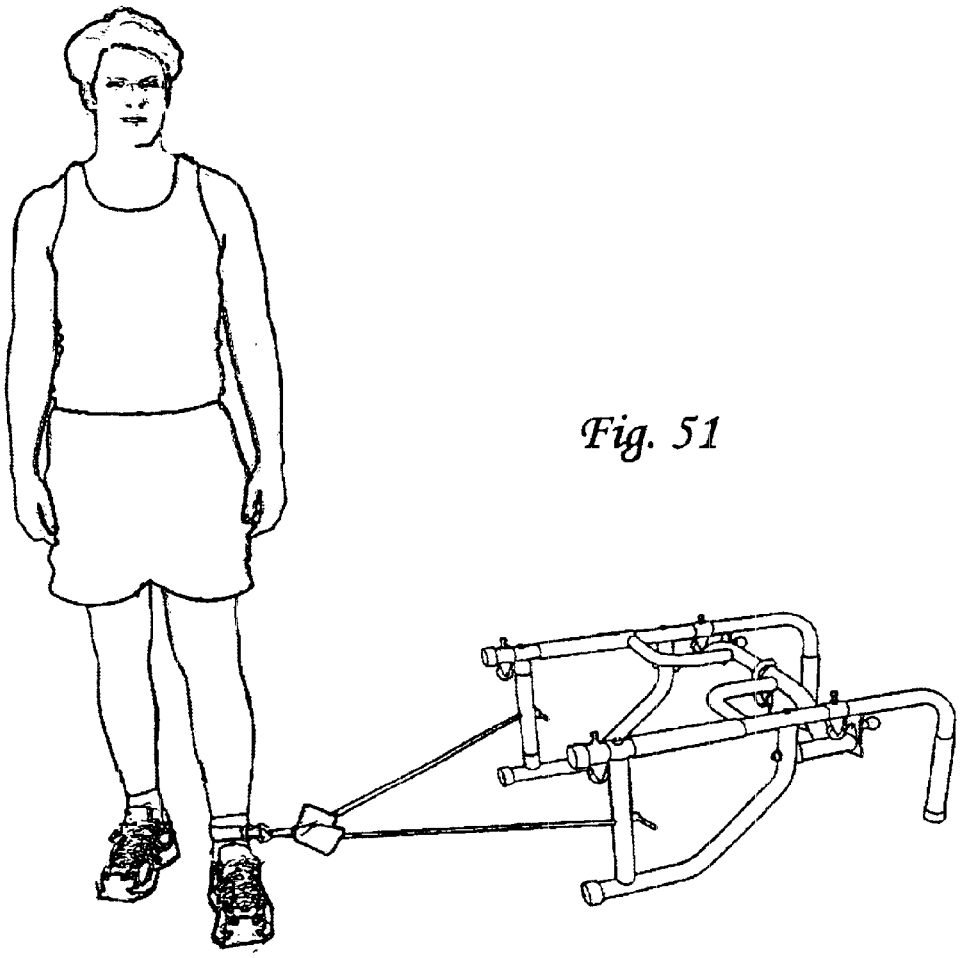

With the apparatus 200 in the unfolded or erected position, and with the back plane 125 supported on the floor, the apparatus 200 is useful for performing the exercises listed above with respect to the second embodiment 100 and is also useful for performing a number of exercises using the bungee cord 270. For example, when the user stands adjacent to the bottom of the apparatus 200 and grasps the handle 272 of the bungee 270, the apparatus 200 is useful for performing an exercise for isolating the rear deltoid, as shown in FIG. 44; for performing shoulder raises, as shown in FIG. 45; curls, as shown in FIG. 46; overhead shoulder presses, as shown in FIG. 47; side bends, as shown in FIG. 48 (a long section of the bungee 270 must be pulled through openings 116*a* to perform this exercise); and butterflies for working the pectorals, as shown in FIG. 49. When the user stands adjacent to the bottom of the apparatus 200 and places his ankle against the handle/pad 272 of the bungee 270, the apparatus is useful for performing leg extensions, as shown in FIGS. 50 and 51. As shown in FIG. 51, strap 274 can be placed around the ankle and clipped (using clip 276) to the bungee 270 for performing the leg extensions or other exercises.

Figure 52:
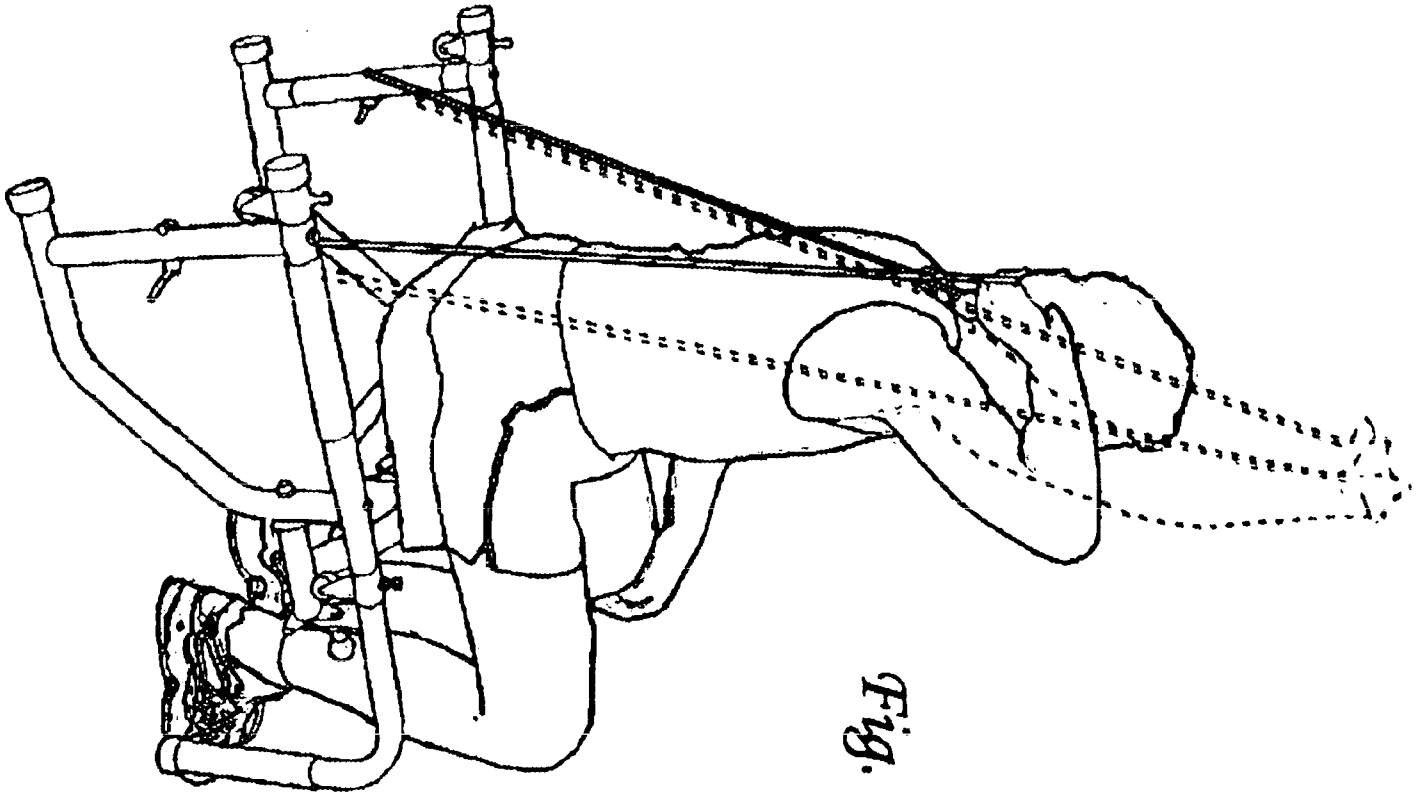
Figure 53:
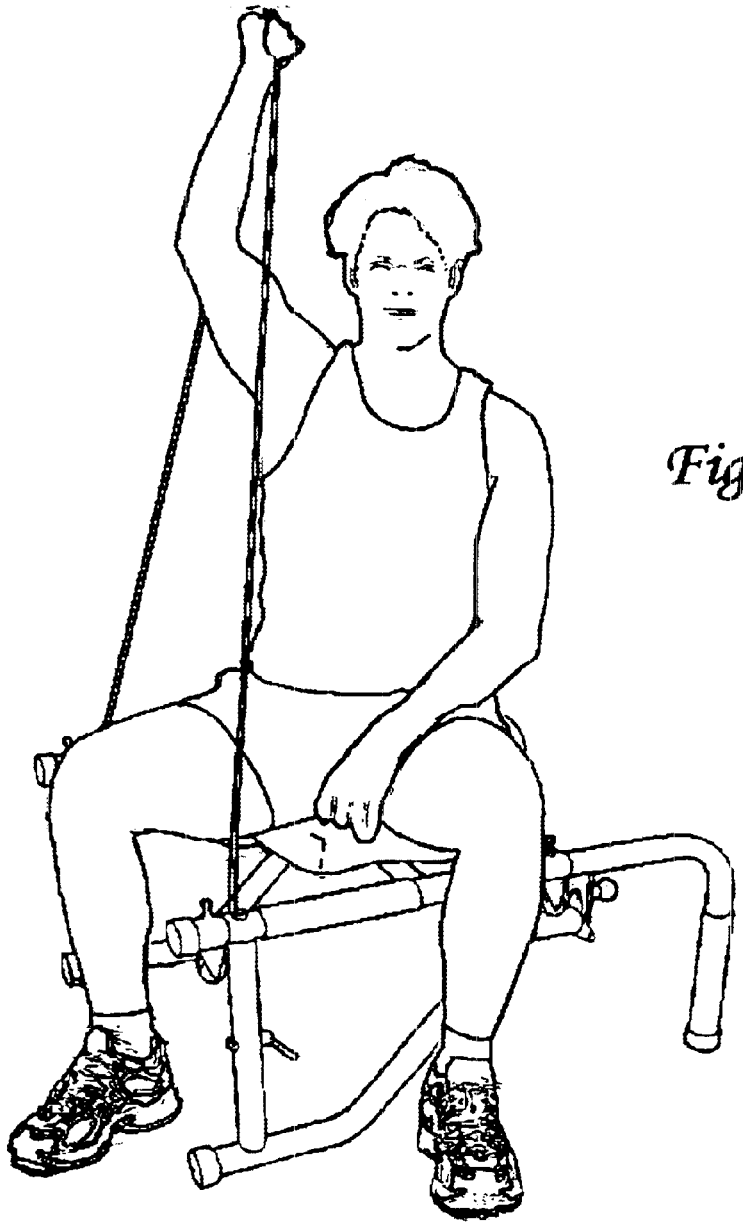
Figure 54:
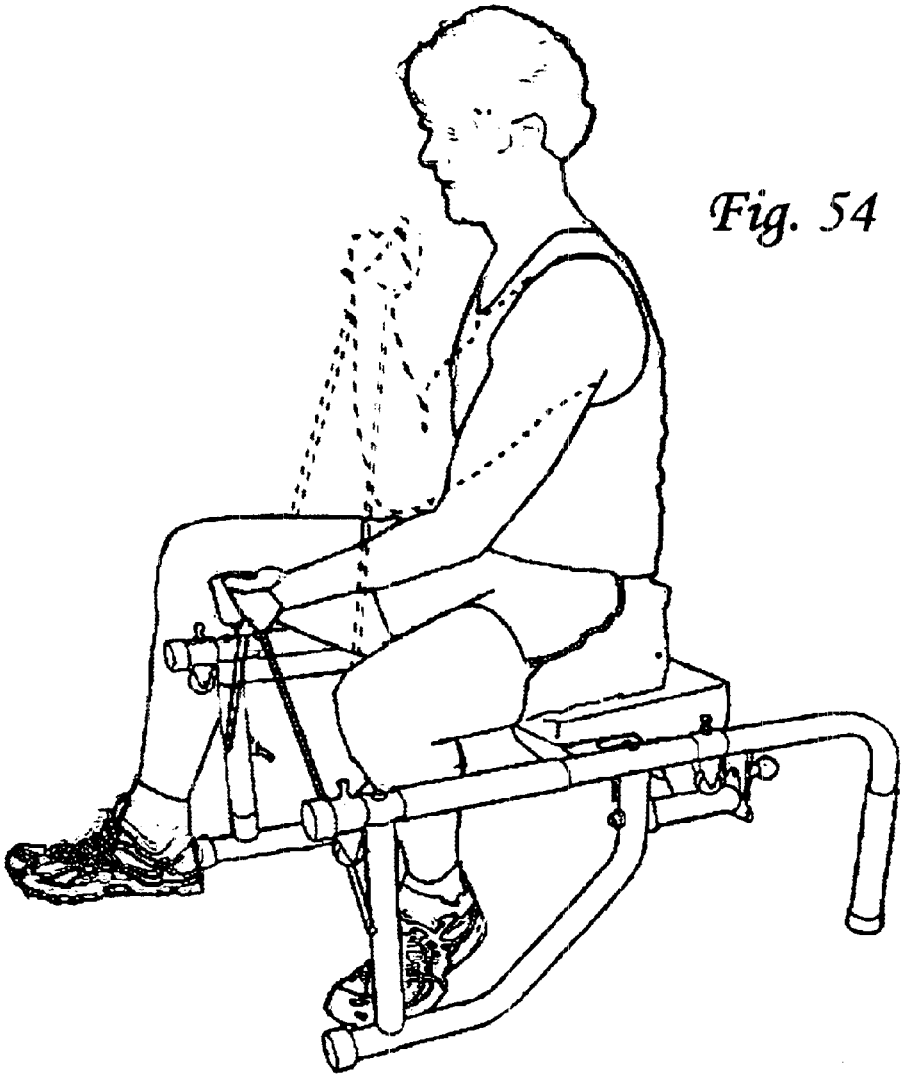
Figure 55:
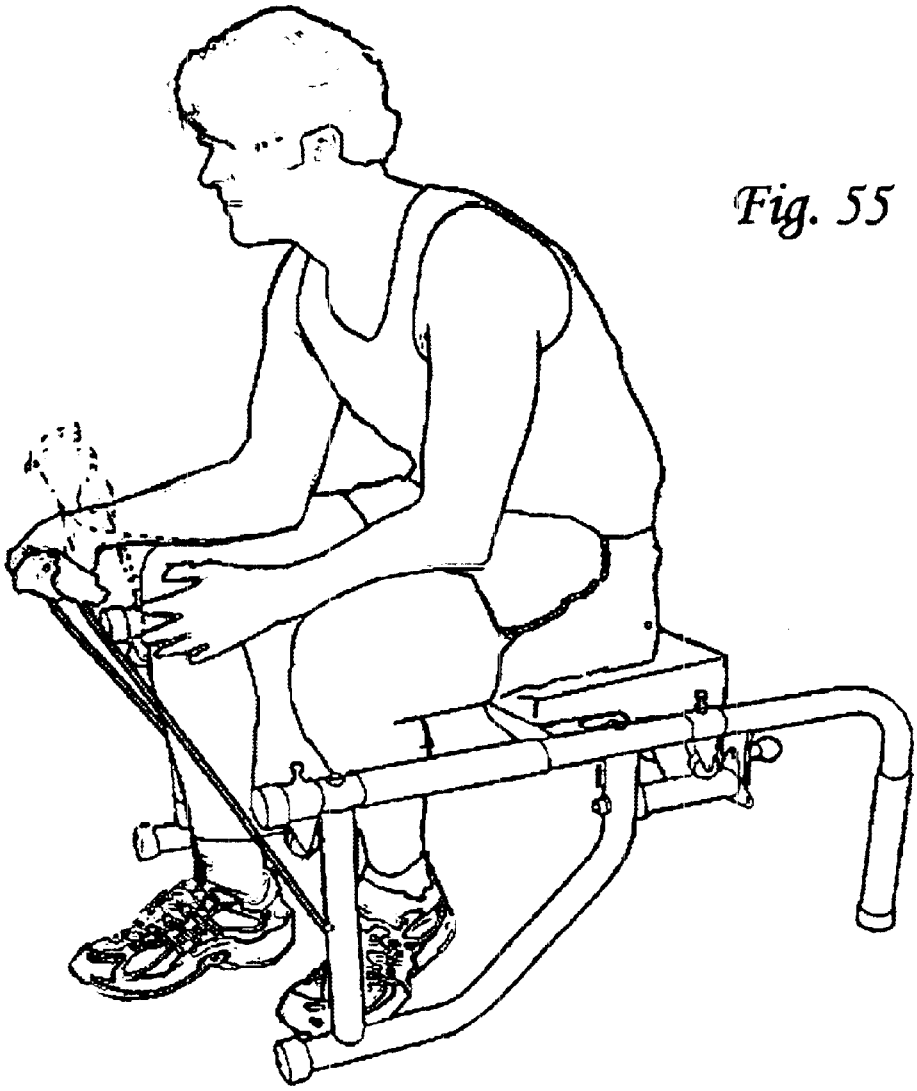
Figure 56:
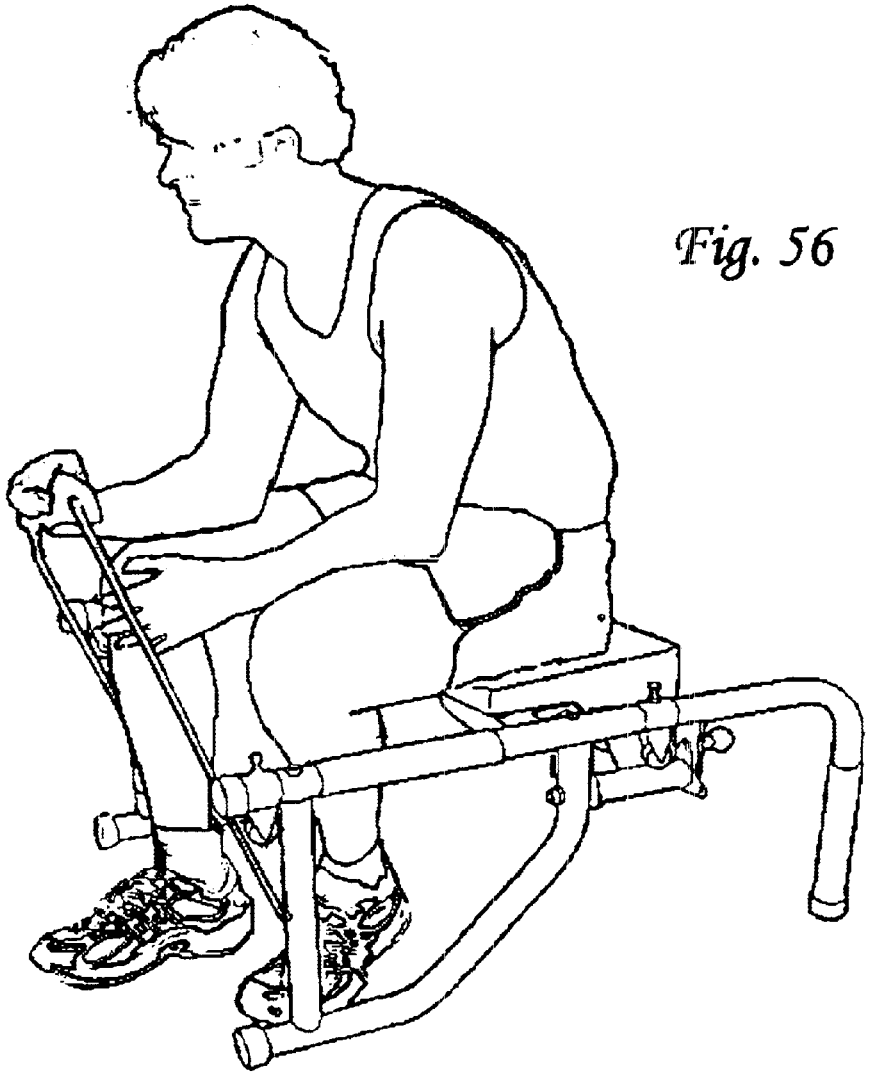
Figure 57:
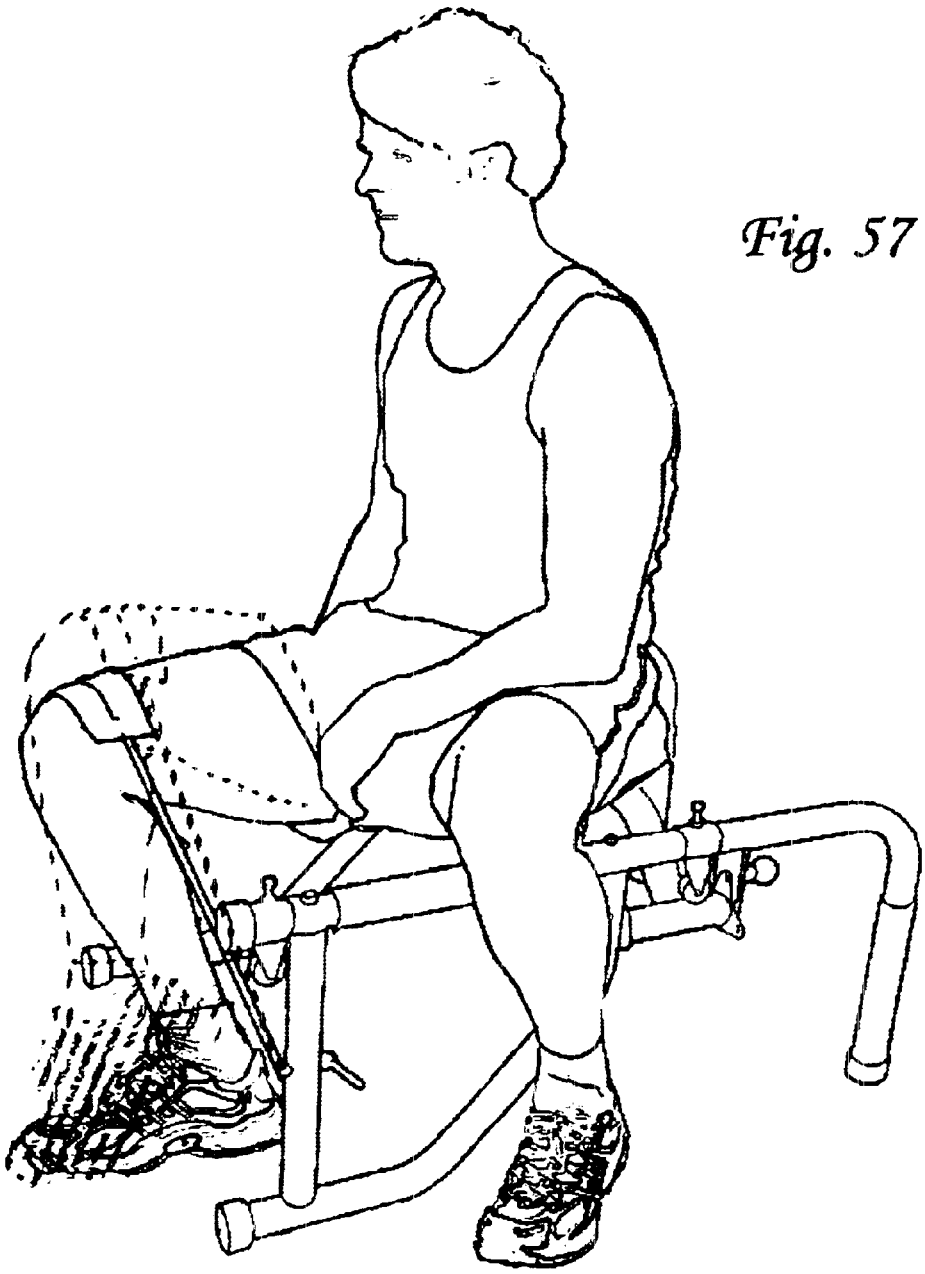
Figure 58:
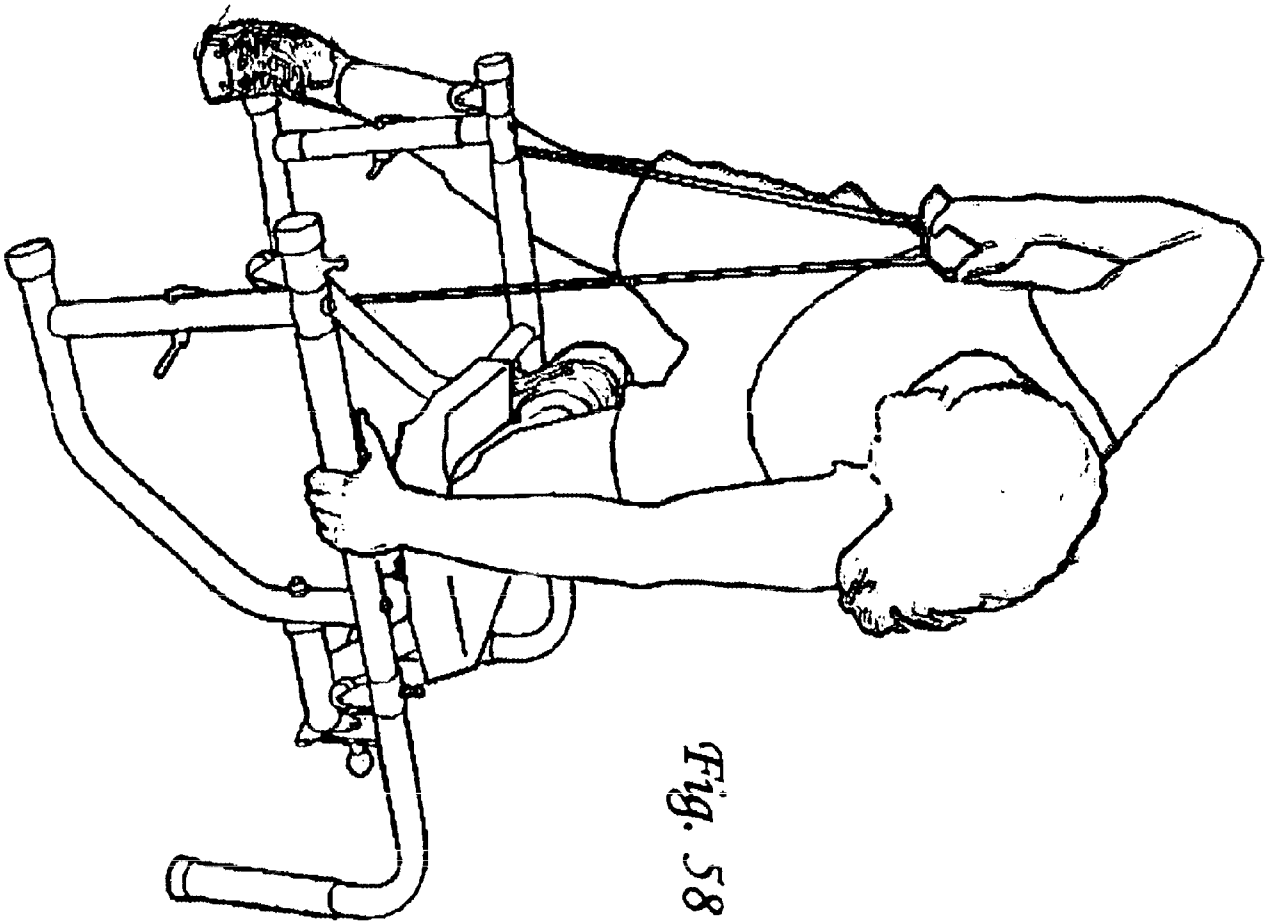
Figure 59:
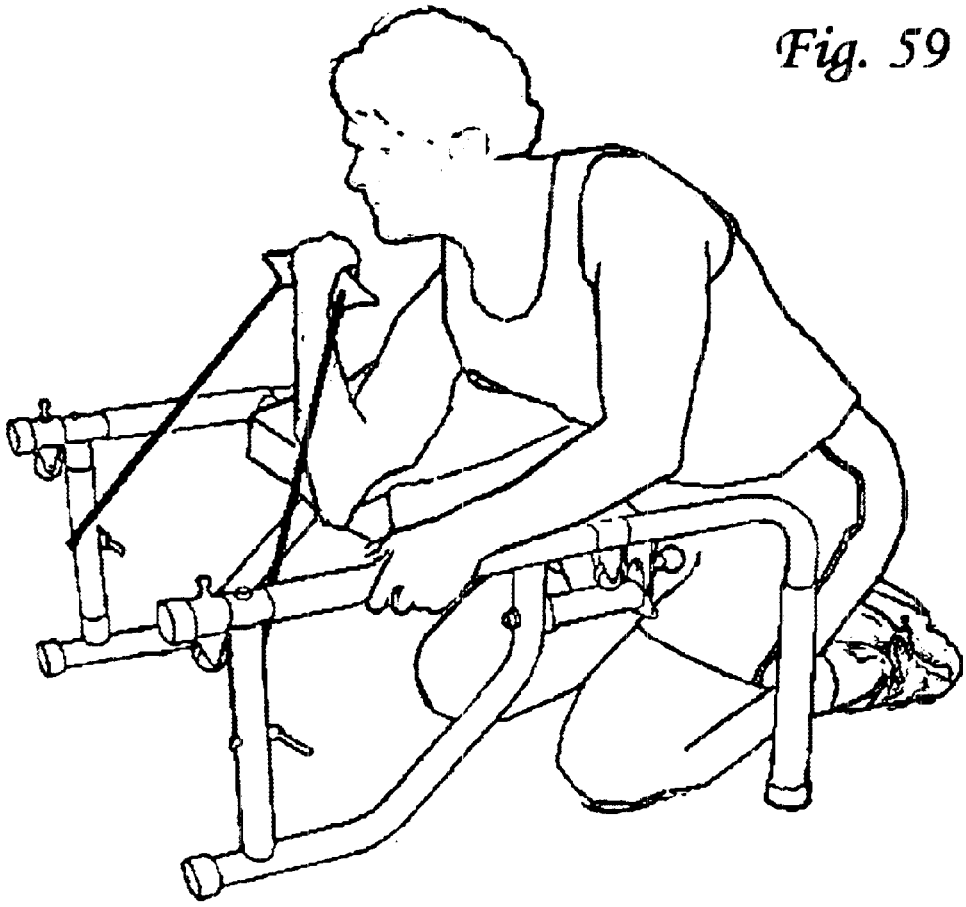

With the apparatus 200 in the unfolded or erected position, and with the back plane 125 supported on the floor, the apparatus 200 can also be used as a workout bench. The seat attachment 278 is placed on the cross brace 131 and mid bars 136 and acts as a seat for the user. In this position, the apparatus is useful for overhead tricep extensions, as shown in FIG. 52; shoulder presses, as shown in FIG. 53; curls, as shown in FIG. 54; wrist curls, as shown in FIG. 55; reverse wrist curls, as shown in FIG. 56; calf raises with the bungee on the user's thigh, as shown in FIG. 57; or bent over rows, as shown in FIG. 58. When the apparatus 200 is in this position, the seat attachment 278 can also be used as an elbow pad for preacher curls, as shown in FIG. 59. Preacher curls isolate the bicep because it eliminates body swing.

Figure 60:
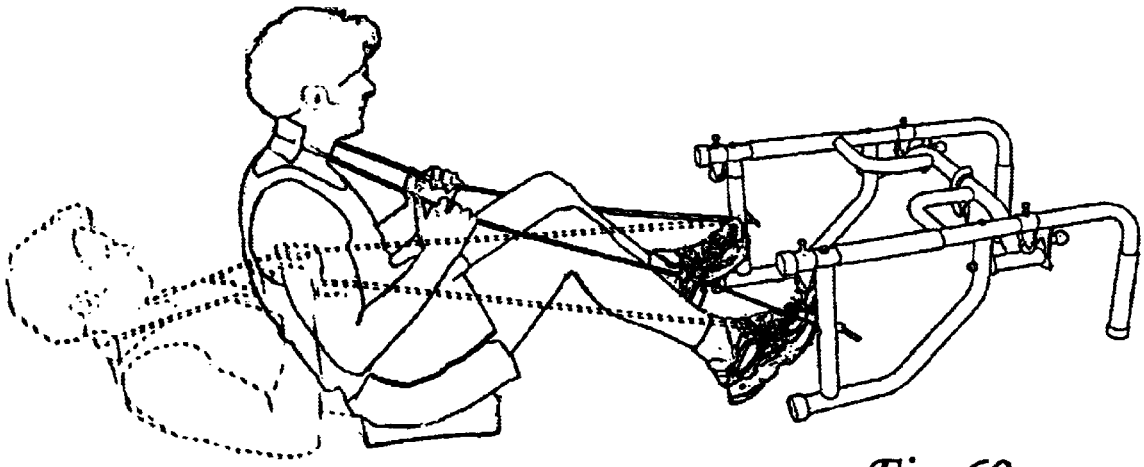
Figure 61:
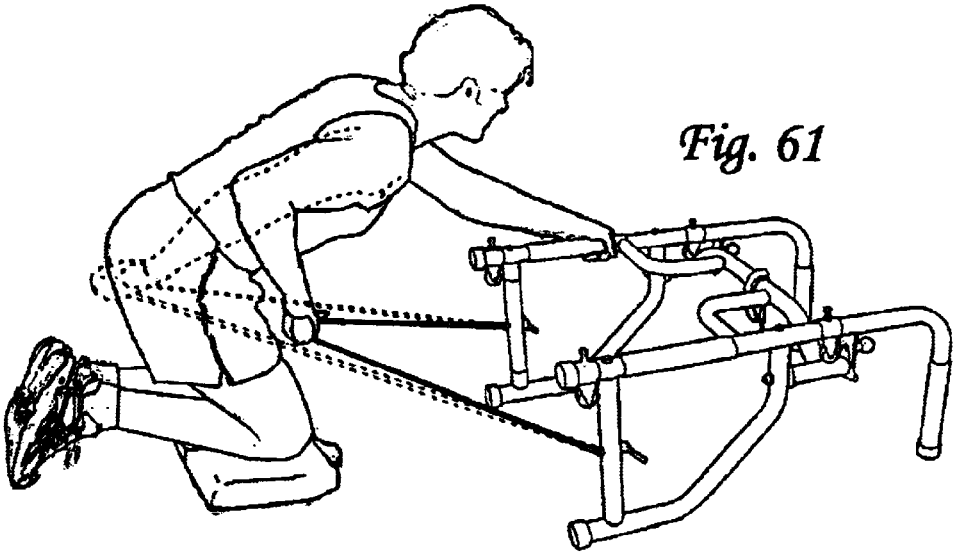
Figure 62:
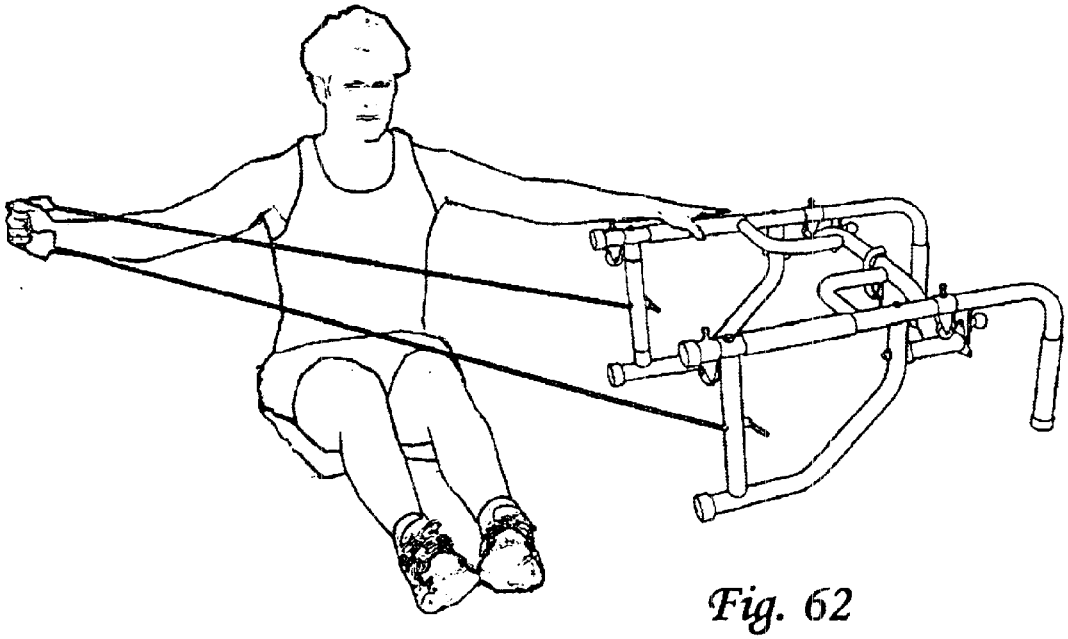
Figure 63:
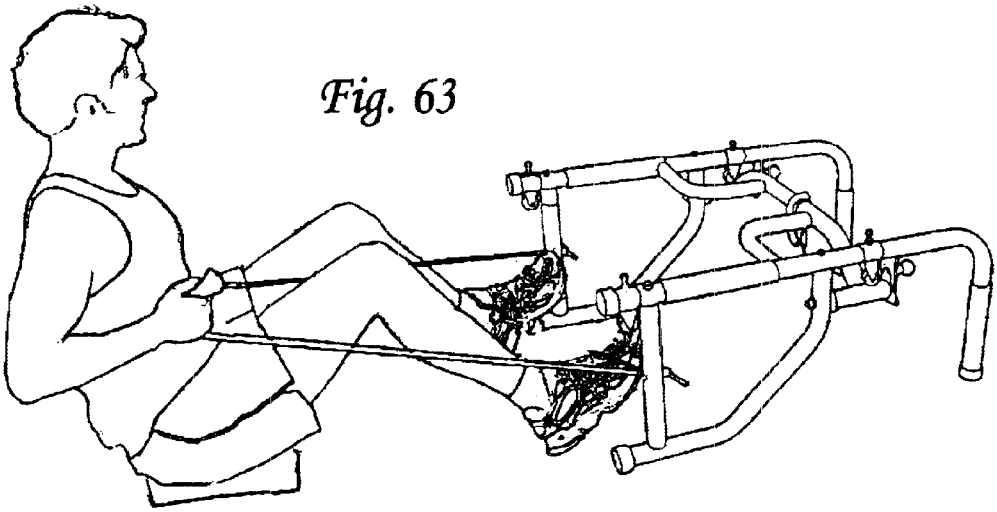
Figure 64:
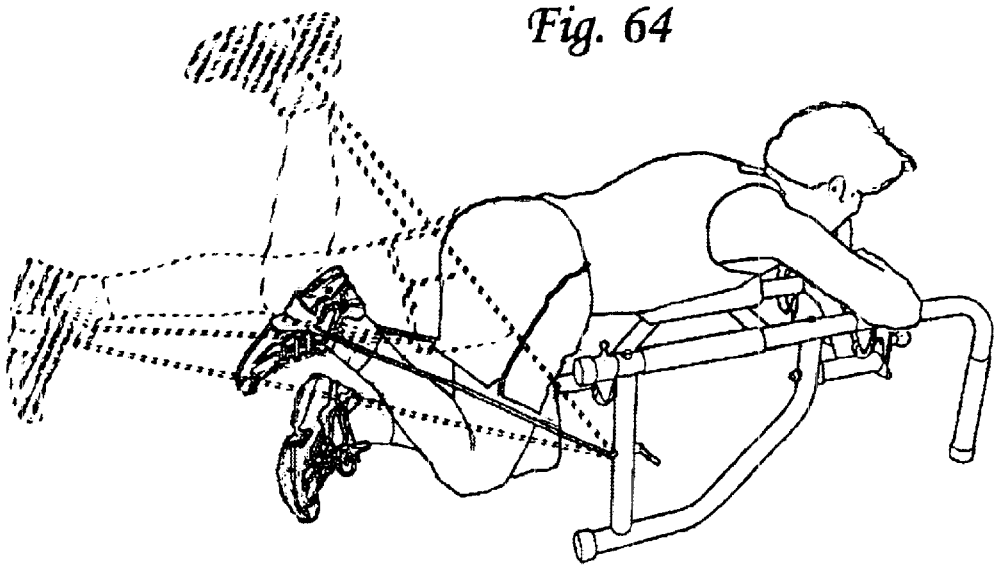
Figure 65:
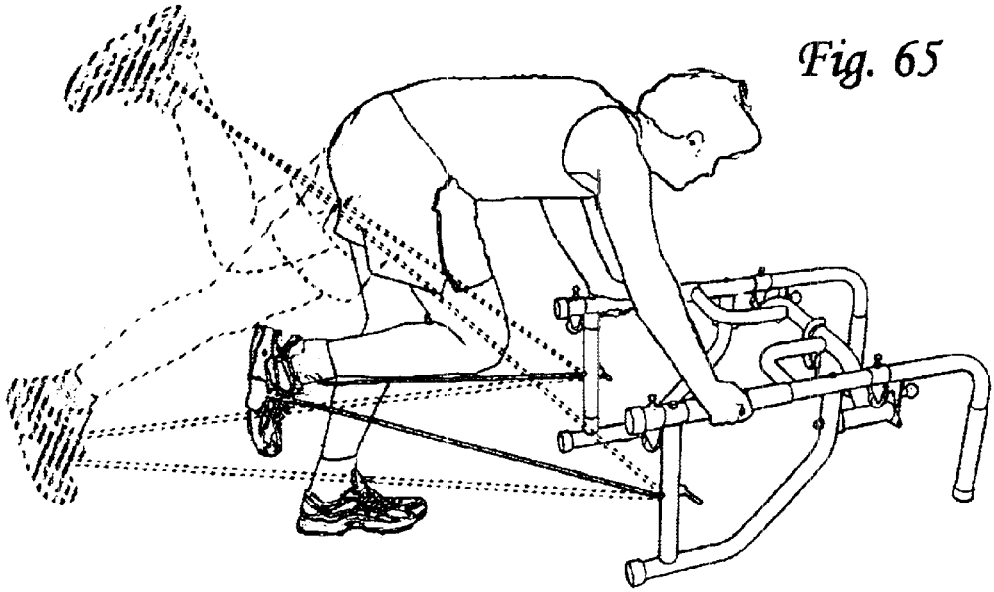
Figure 66:
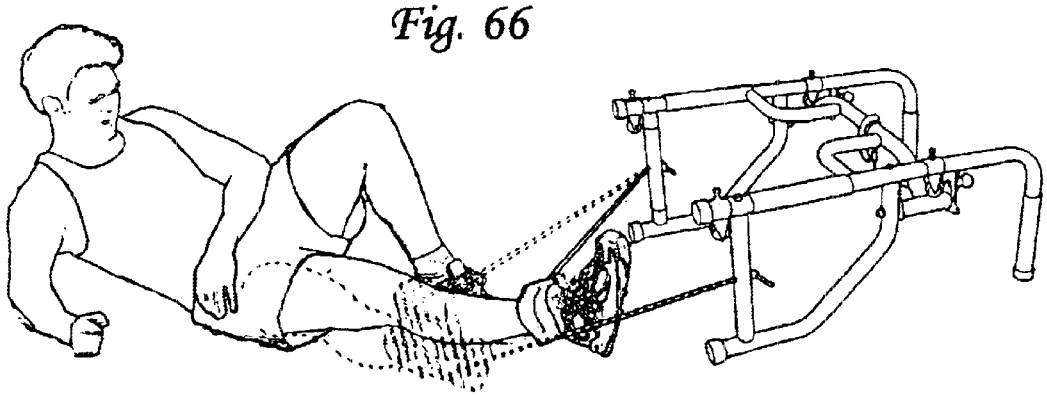
Figure 67:
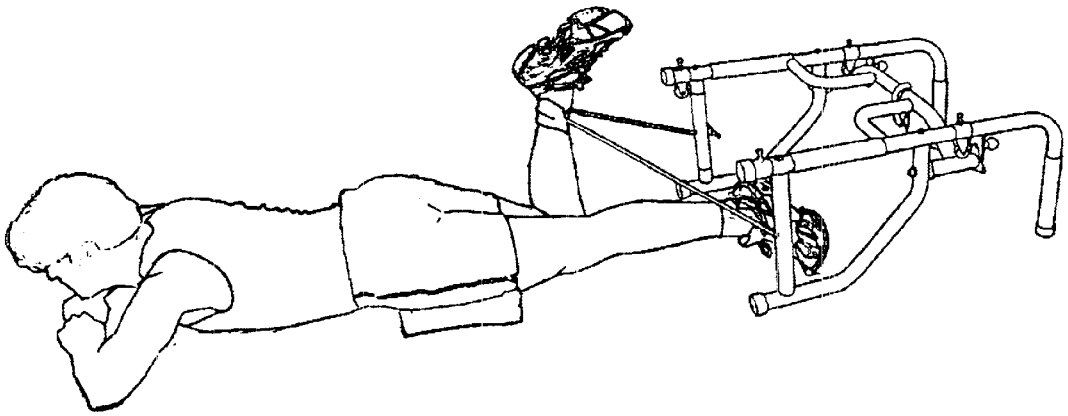
Figure 68:
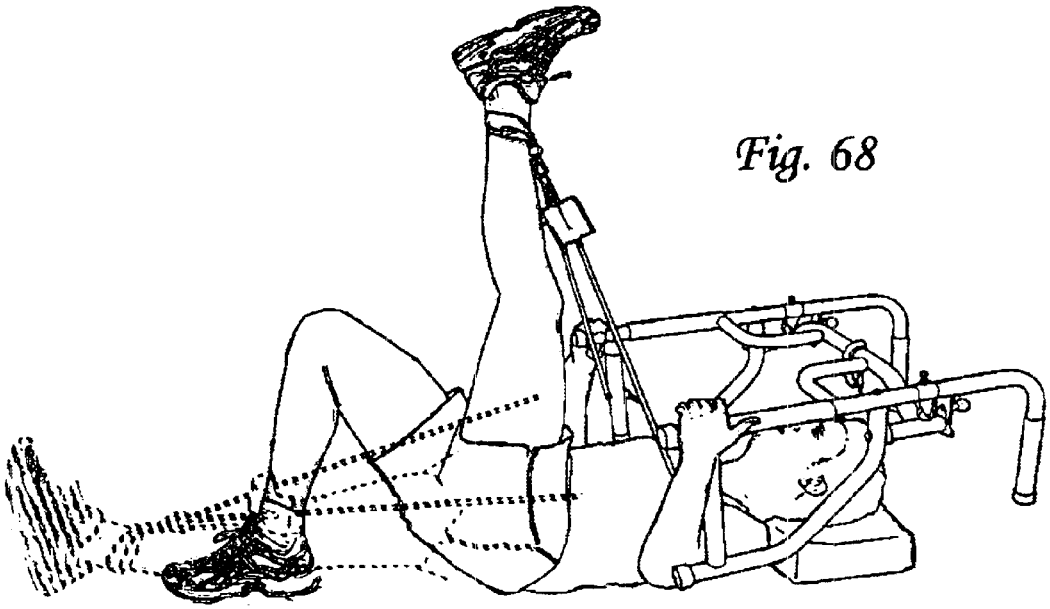
Figure 69:
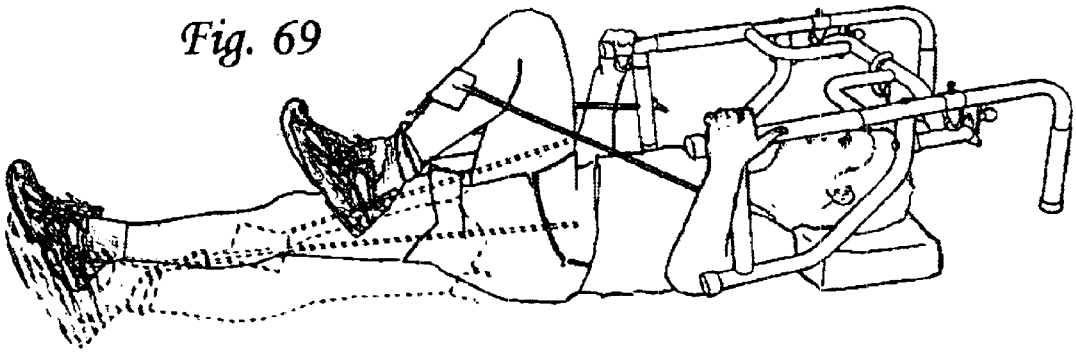
Figure 70:
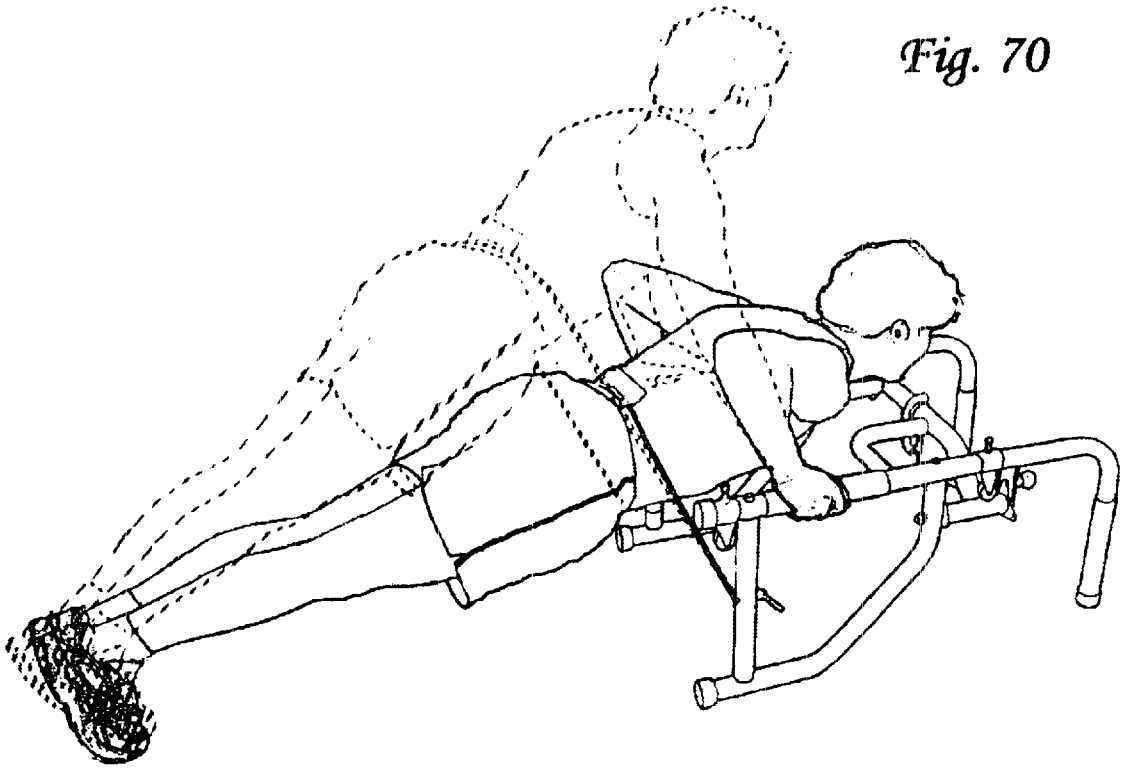
Figure 71:
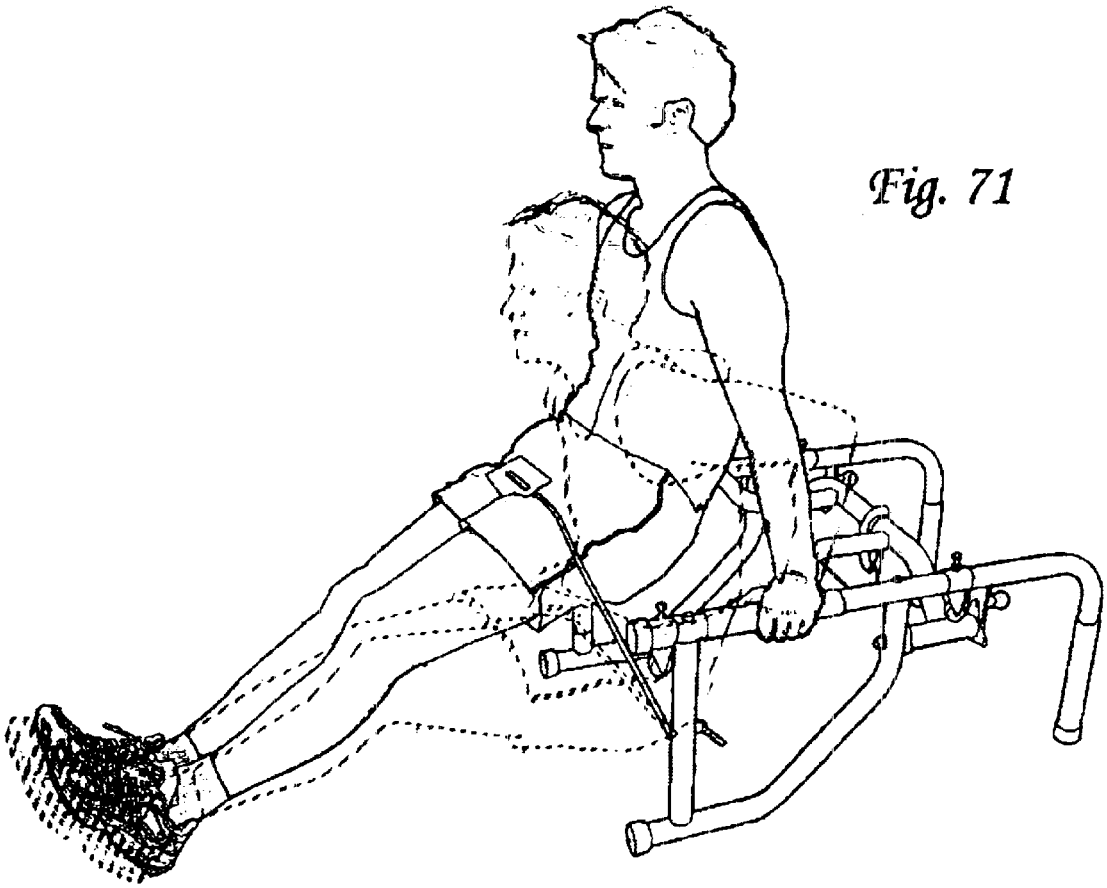

With the apparatus 200 in the unfolded or erected position, and with the back plane 125 supported on the floor, the apparatus 200 is also useful for a number of other exercises where the user is either seated or kneeling on the floor with the seat attachment under the butt, knees or other body part for comfort. Obviously the seat attachment 278 is not necessary for these exercises. For example, the apparatus is useful for performing an exercise where the bungee is placed against the back of the neck for working the back and for aiding in the performance of abs without placing a strain on the neck, as shown in FIG. 60; kneeling tricep extensions, as shown in FIG. 61; seated rear delts, as shown in FIG. 62, seated rows, as shown in FIG. 63; kneeling rear leg press while leaning on the apparatus 200 (note that the seat attachment 178 can be used under the chest or knees), as shown in FIG. 64; standing gluts with the users hands on the grips 118 on the front vertical support 110, as shown in FIG. 65; seated side leg extensions, as shown in FIG. 66; and leg curls, as shown in FIG. 67. The seat attachment 278 can also be used as a head rest when performing such exercises as leg pull downs; as shown in FIG. 68 and leg extensions, as shown in FIG. 69. The bungee 270 can also be used for added resistance during when performing such exercises as push ups with the user's hands on the handgrips 118 on the front vertical supports, as shown in FIG. 70, and dips with the user's hands on the handgrips 118 on the front vertical supports, as shown in FIG. 71.

Figure 72A:
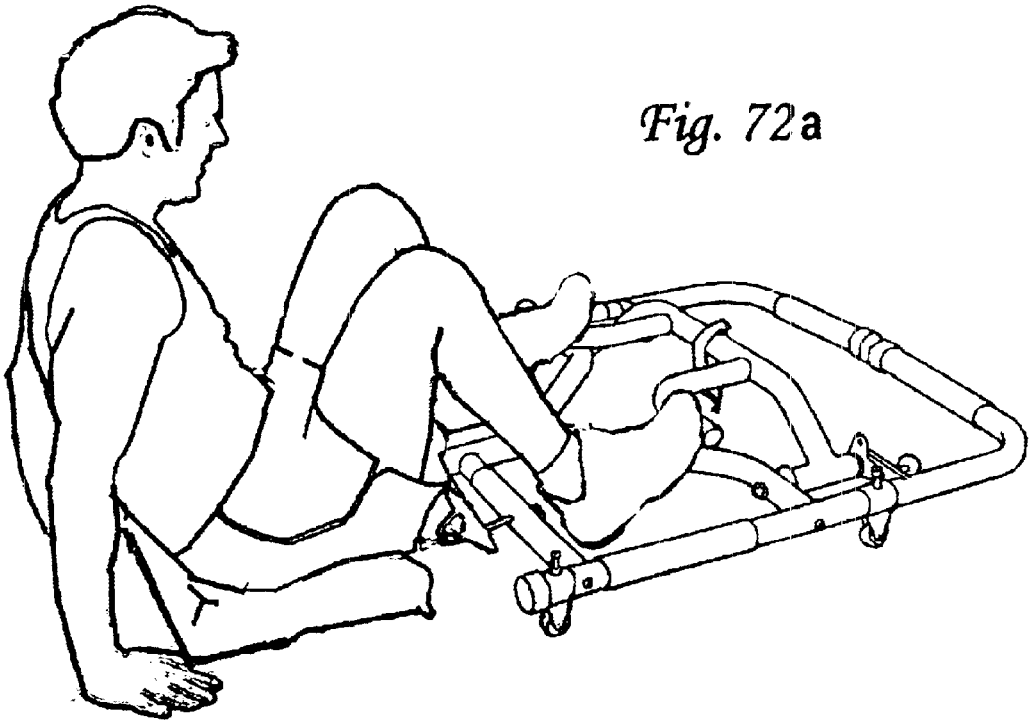
Figure 72B:
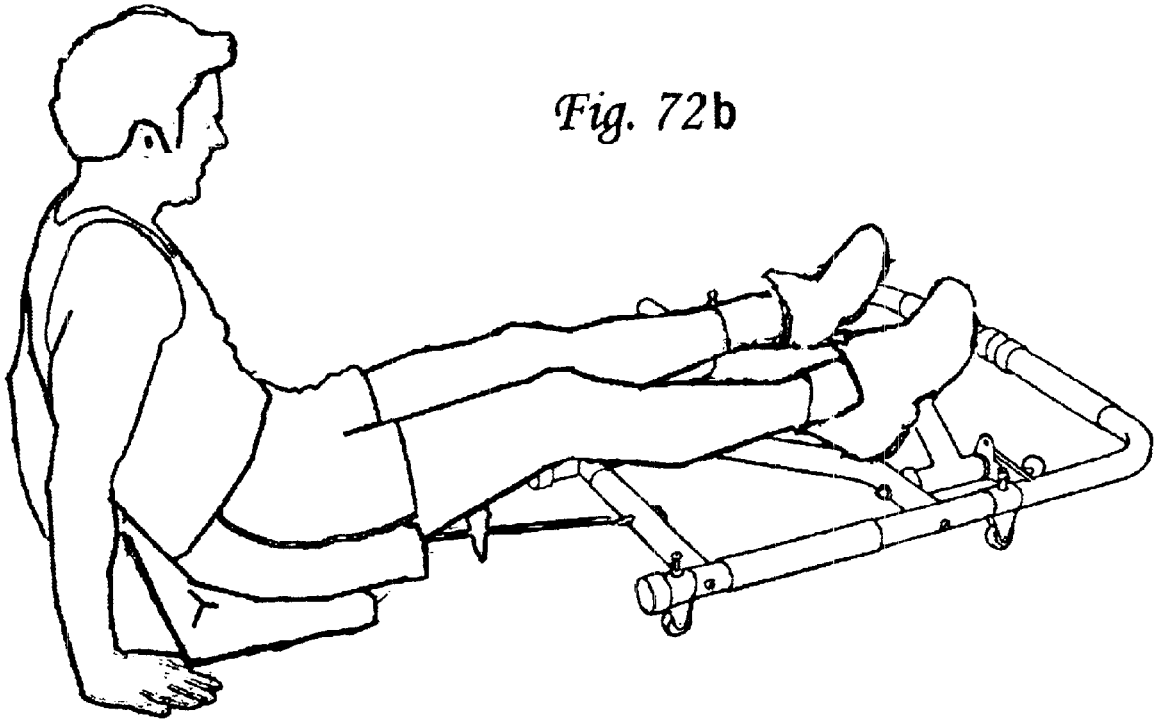
Figure 73A:
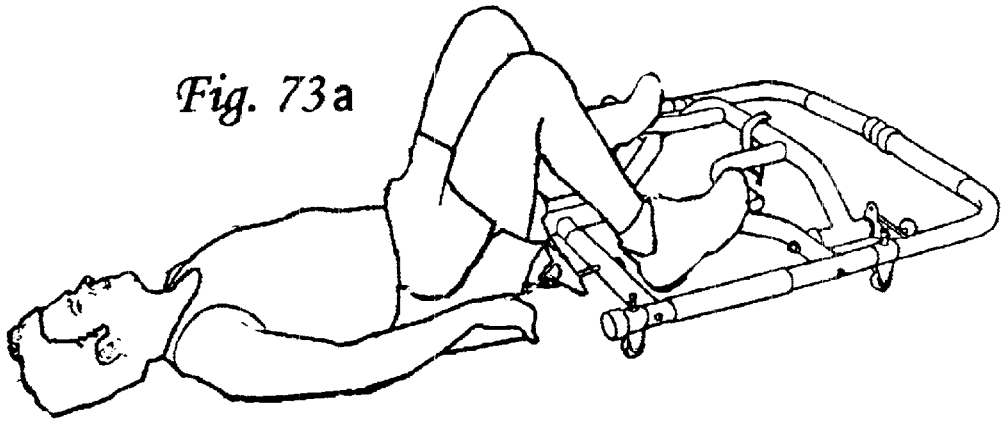
Figure 73B:
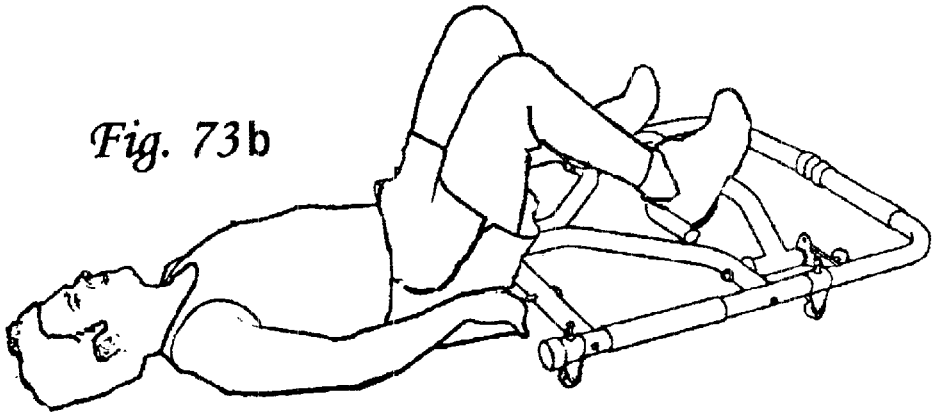
Figure 73C:
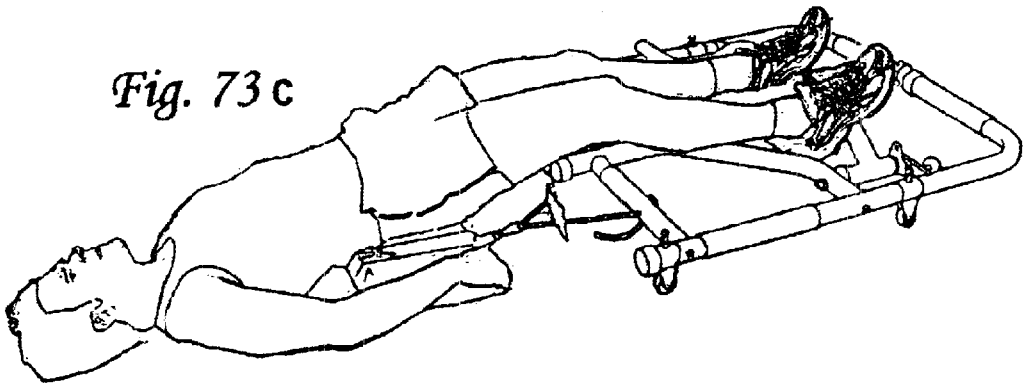

Referring to FIGS. 72*a*–74*d*, with the rollers in the contact position and the apparatus 200 in the folded or collapsed position the apparatus 200 is useful for a number of different exercises with or without the bungee 270. The bungee is useful for added resistance in these "rolling" exercise. To utilize the bungee 270, the attachment portion 282 of the seat attachment 278 is clipped to the bungee 270 and the user places his weight on the seat portion 280 to provide an anchor. In this position, the apparatus is useful for seated leg extensions, which isolate the abs and certain of the leg muscles) with the user's feet against the horizontal mid-bar section 139 of the mid-bars 136, as shown in FIGS. 72*a* (starting position) and 72*b* (finishing position) (in an alternative embodiment, the feet can be placed against the horizontal braces 116); or lying leg extensions, as shown in FIGS. 73*a* (starting position with the user's feet against the horizontal mid-bar section 139 of the mid-bars 136), 73*b* (starting position with the users feet against the cross brace 131) and 73*c* (finishing position with the user's feet against the cross brace 131).

Figure 74A:
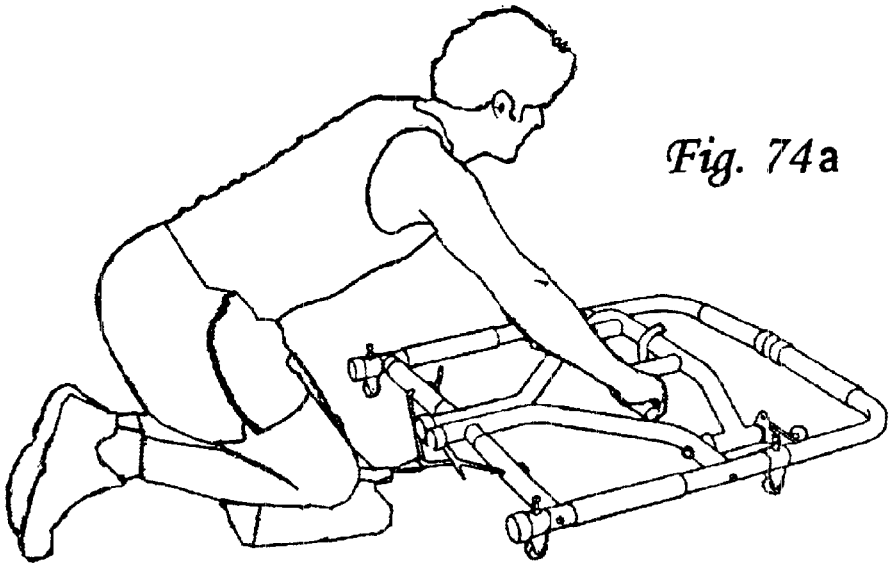
Figure 74B:
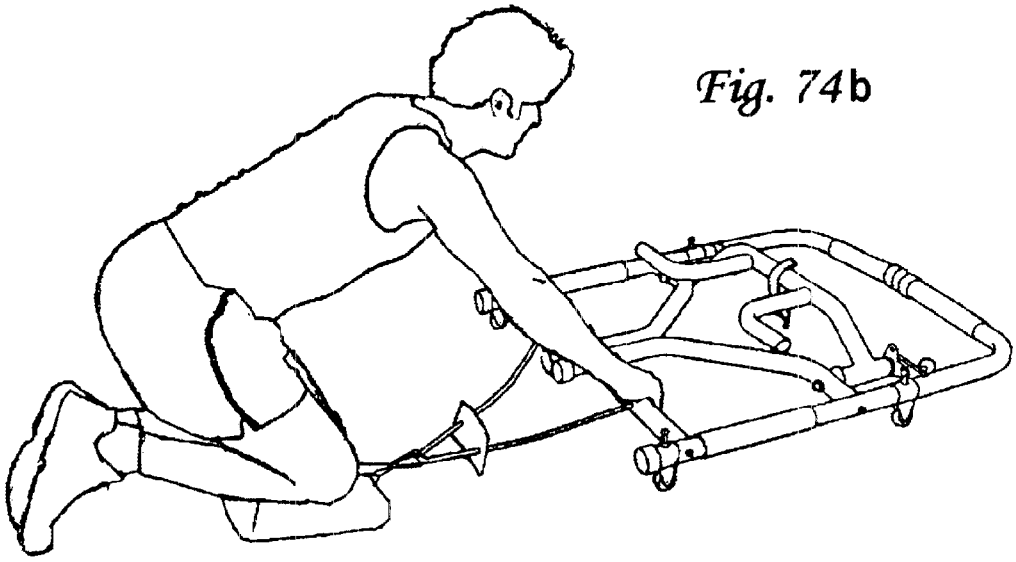

In this position, the apparatus 200 is also useful for ab rolls. To perform ab rolls, the user places his knees on the seat portion 280 and grasps the horizontal mid-bar section 139 of the mid-bars 136, as shown in FIG. 74*a* or the grips 118 on the horizontal braces 116, as shown in FIG. 74*b*. The user then extends his arms forwardly, thereby rolling the wheels 204 on the ground and stretching the bungee 270, as shown in FIGS. 74*c* and 74*d*. During ab rolls the bungee cord 270 helps bring the apparatus 200 back to the start position. To make the exercise easier, the user can place his hands on the horizontal mid-bar section 139 of the mid-bars 136 and his elbows on the grips 118 on the horizontal braces 116.

Figure 75A:
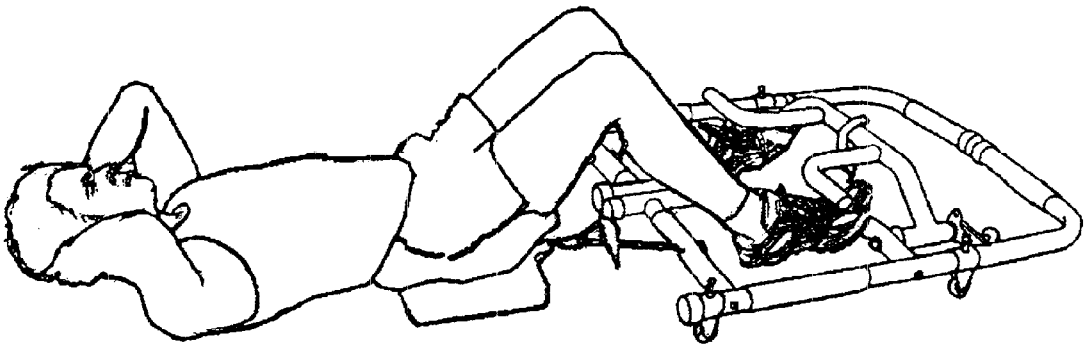
Figure 75B:
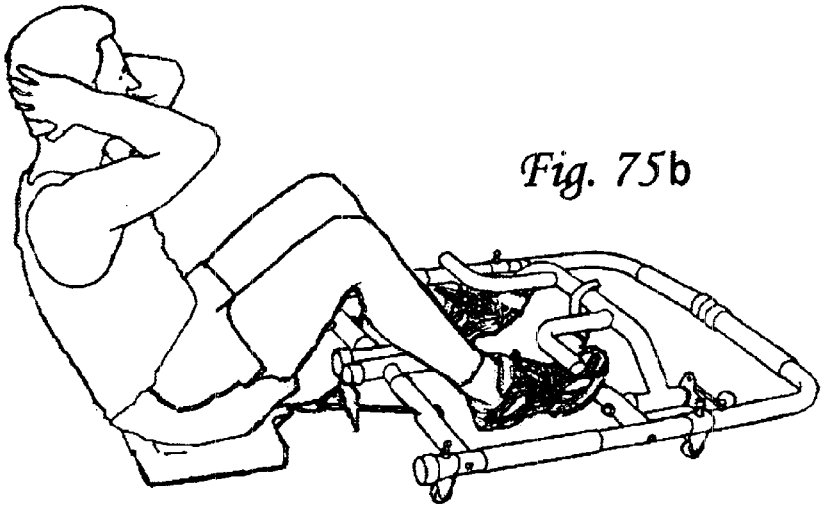

As shown in FIGS. 75*a* and 75*b* the apparatus 200 can also be used as an anchor for performing situps with the user's toes under the horizontal mid-bar section 139 of the mid-bars 136.

Figure 76:
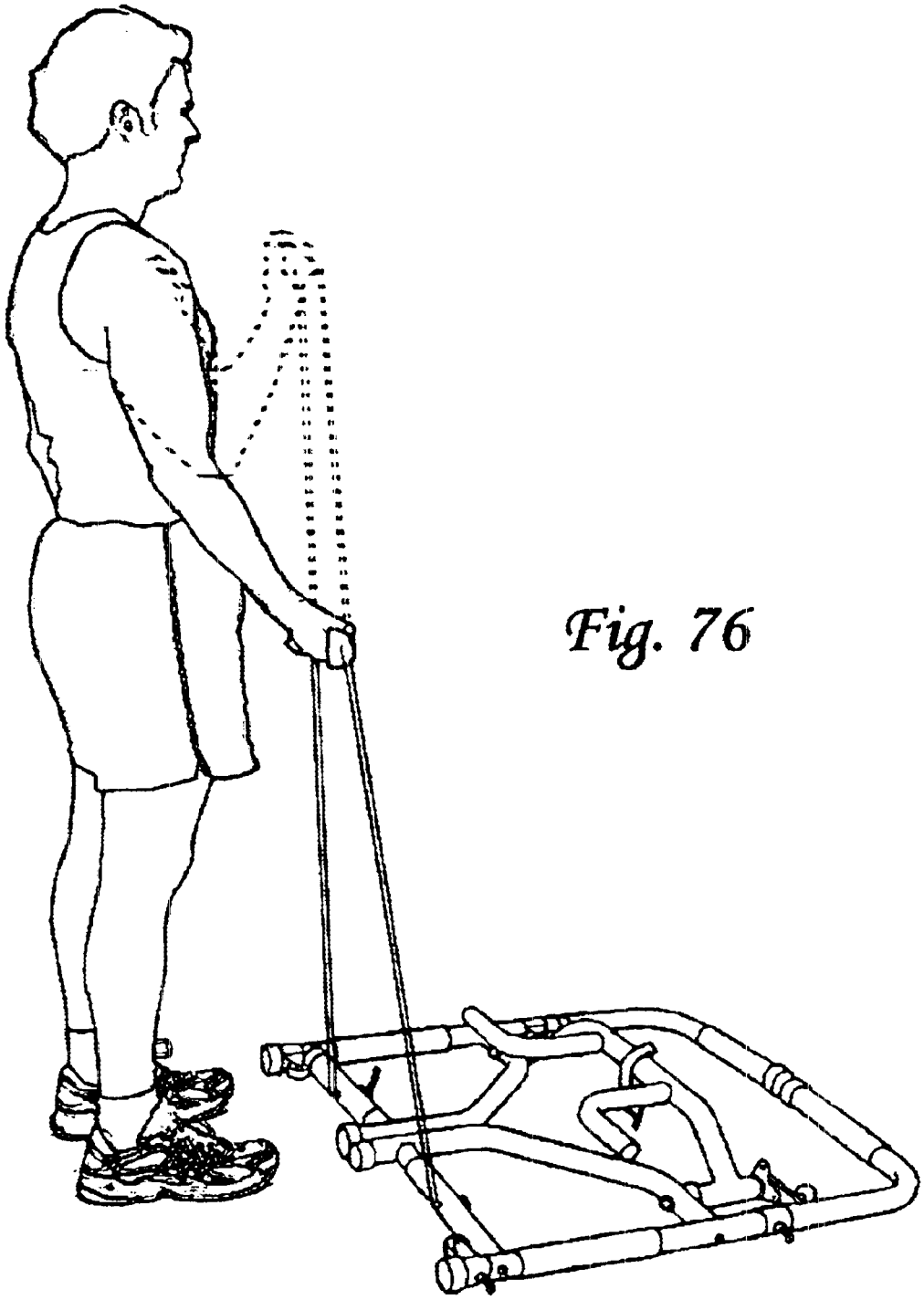
Figure 77:
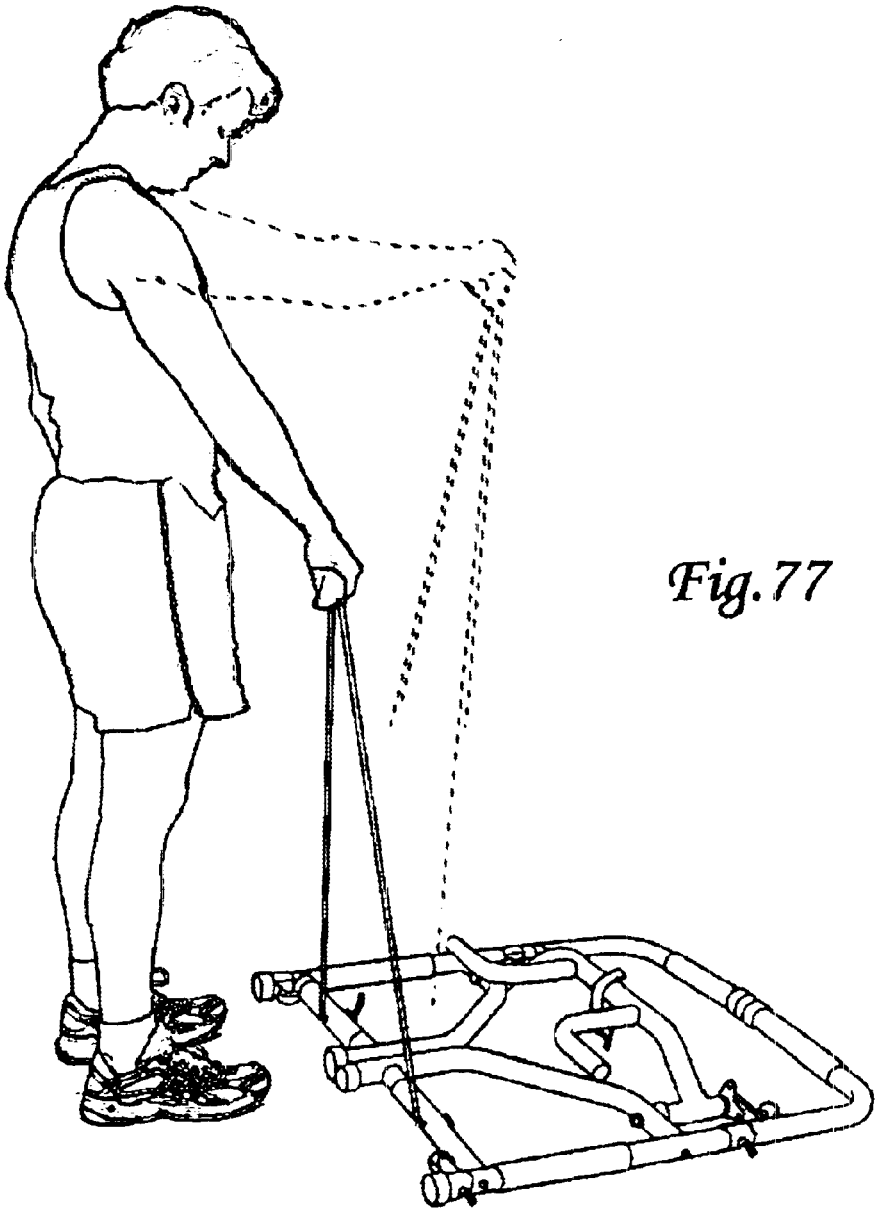
Figure 78:
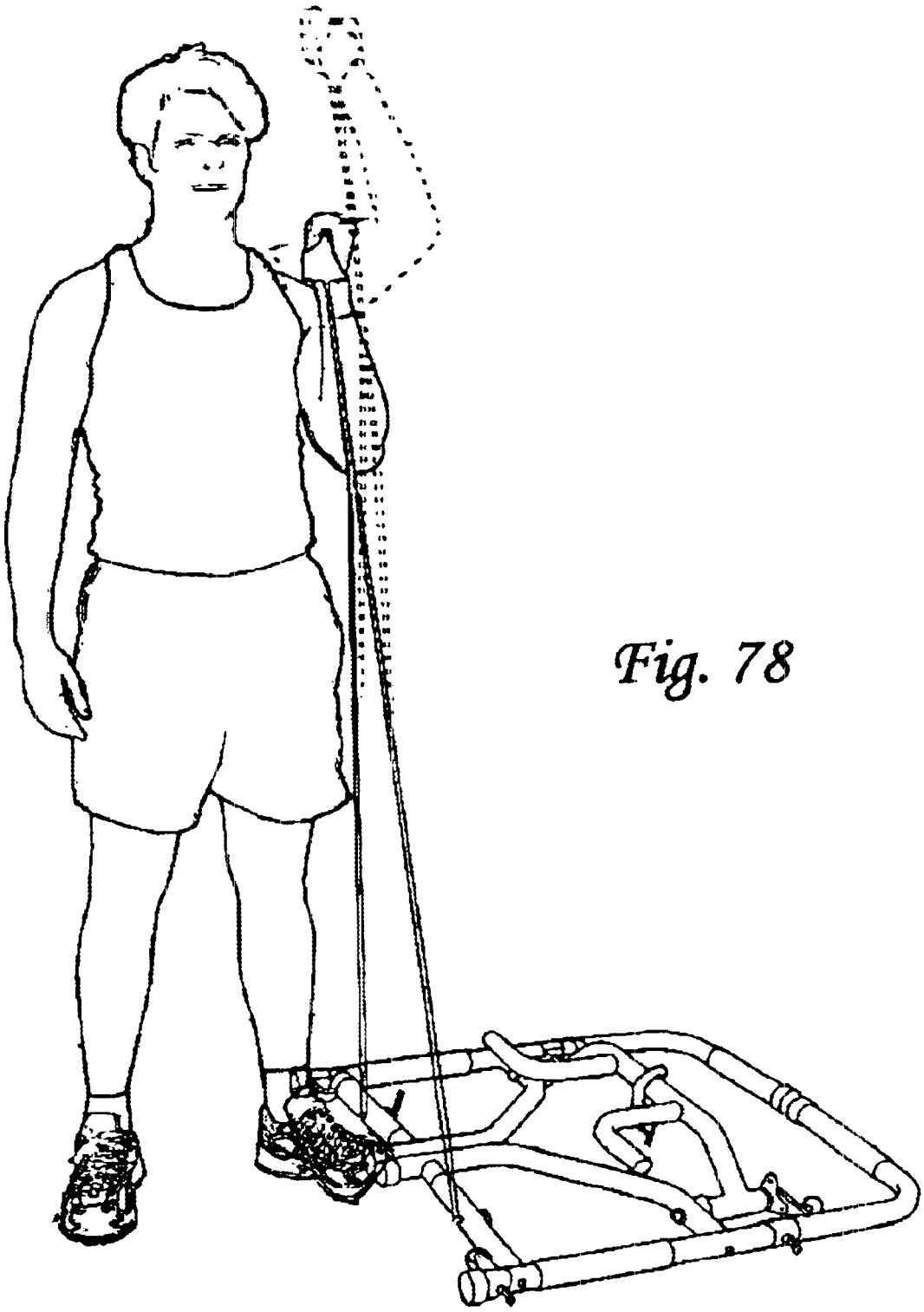
Figure 79:
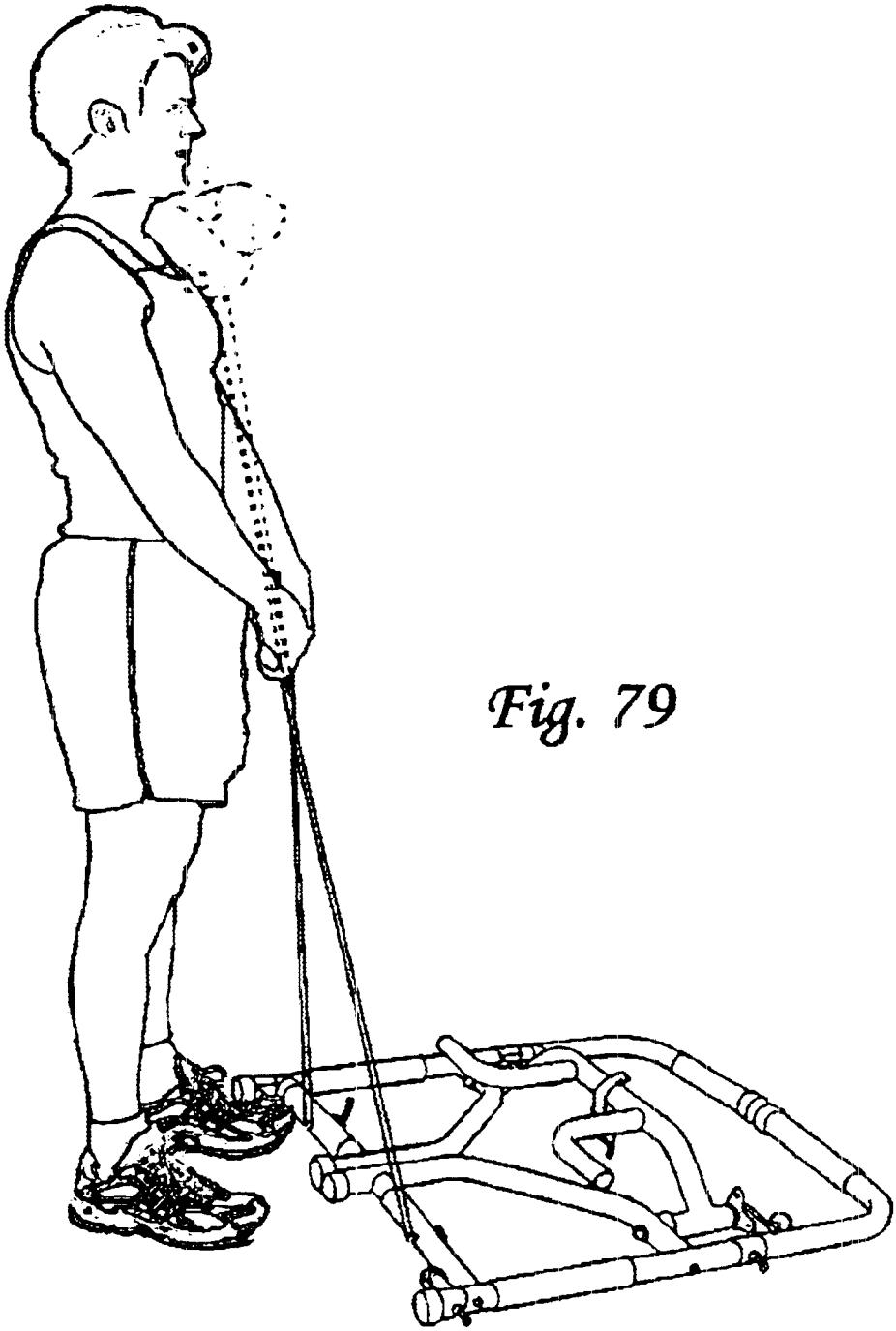
Figure 80A:
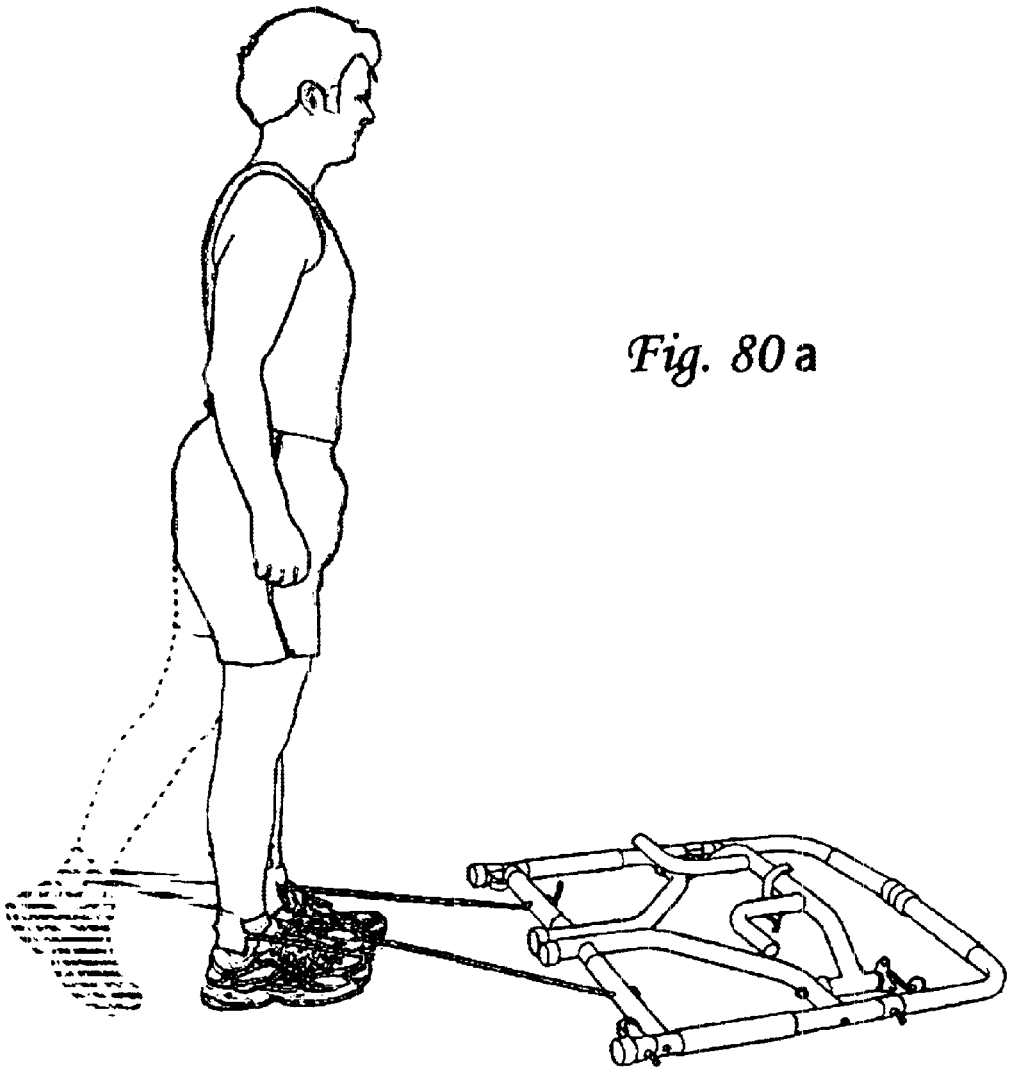
Figure 80C:
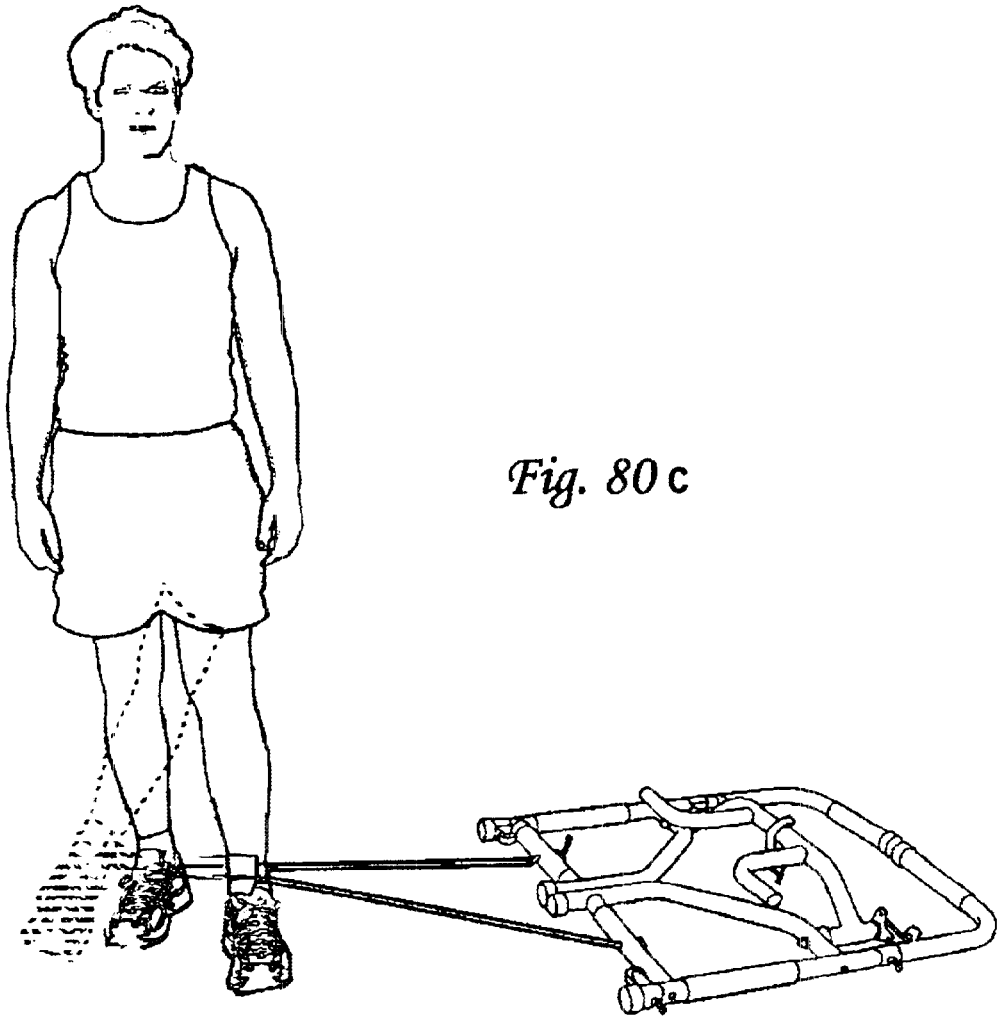

With the rollers in the non-contact position and the apparatus 200 in the folded or collapsed position the apparatus 200 is useful for a number of different exercises utilizing the bungee 270. For example, when the user stands adjacent to the bottom of the apparatus 200 and grasps the handle 272 of the bungee 270, the apparatus 200 is useful for performing curls, as shown in FIG. 76; straight arm raises, as shown in FIG. 77; military presses, as shown in FIG. 78; or upright rows, as shown in FIG. 79. When the user stands adjacent to the bottom of the apparatus 200 and places his ankle against the handle/pad 272 of the bungee 270, the apparatus is useful for performing different types of leg extensions (front, rear or side), as shown in FIGS. 80*a*–80*d*. The user can also perform regular push-ups and beginner push-ups with his hands on the horizontal mid-bar section 139 of the mid-bars 136, as shown in FIGS. 81 and 82. The seat attachment 278 can be placed under the user's knees for beginner pushups. It will be appreciated that having the rollers 201 in the non-contact position prevents the apparatus 200 from rolling while performing exercises such as push-ups.

Preferably, the apparatus weighs from 20–50 pounds, more preferably from 25–35 pounds and most preferably approximately 27 pounds. The side frames and cross brace are preferably 0.090 wall steel tubes, 1½ inch O.D.

The apparatus 1, 100, 200 can be quickly set up to do "supersets". It provides a fast and intense method of training. The user does 2–3 sets back to back before resting. The variations of ab rolls, leg presses, extensions and raises, curls, tricep extensions and other upper body exercises is beneficial for fast, effective training. Supersets cut out a lot of rest period time, making for fast exercising.

Although particular embodiments of the present invention has been described in the foregoing detailed description, it will be understood by one of ordinary skill in the art that the invention is capable of numerous modifications without departing from the scope of the invention. It will also be understood that a skilled artisan will be able to come up with numerous more exercises that can be performed using the apparatus 1, 100, 200. Performance of all such exercises is within the scope of the invention. The invention, therefore, should not be restricted, except by the following claims, and their equivalents.

What is claimed is:

1. A foldable and portable exercise apparatus, comprising:

first and second side frames pivotable between open and closed positions;

at least two rollers pivotable between a first position and a second position, wherein one of the at least two rollers is attached to a first side frame and another of the at least two rollers is attached to the second side frame;

a bungee cord attached to the first and second side frames; and a cross brace having a first end and an opposing second end, wherein the cross brace has a pair of spaced apart rigid mid bars joined to and extending perpendicularly downward from the cross brace, wherein the first side frame is pivotally attached to the first end of the cross brace, wherein the second side frame is pivotally attached to the second end of the cross brace, the first and second side frames each including a front vertical support, wherein each side frame has a top horizontal handle bar cantilevered off of the front vertical support of each side frame, and wherein the first and second side frames can be locked in the open or closed positions.

2. The exercise apparatus of claim 1 wherein the at least two rollers each include a tubular portion with a wheel rotatably mounted thereto.

3. The exercise apparatus of claim 2 wherein the rollers further includes a locking member, whereby the rollers can be locked in the first and second positions.

4. The exercise apparatus of claim 3 wherein the tubular portion of the rollers includes an opening therein, and wherein the locking member is received in the hole to engage the side frame.

5. The exercise apparatus of claim 4 wherein the opening in the tubular portion is threaded and wherein the locking member is threadedly received in the opening.

6. The exercise apparatus of claim 1 wherein the at least two rollers are pivotally received on the front vertical supports of the first and second side frames respectively.

7. The exercise apparatus of claim 6 wherein the at least two rollers are spaced apart between about 20" and about 30".

8. The exercise apparatus of claim 6 wherein the apparatus includes at least four rollers.

9. The exercise apparatus of claim 1 wherein the first and second side frames each include a bottom horizontal brace extending from the front horizontal support, wherein the bottom horizontal braces each include an opening defined therethrough, and wherein the opposite ends of the bungee cord each extend through one of the openings.

10. The exercise apparatus of claim 9 wherein the resistance of the bungee cord is adjustable by pulling more of the cord through the openings in the bottom horizontal braces.

11. The exercise apparatus of claim 1 wherein the bungee cord includes a handle and a seat attachment secured thereto.

12. The exercise apparatus of claim 11 wherein the seat attachment is formed in the shape of a wedge.

13. The exercise apparatus of claim 1 wherein the rigid mid bars include a vertical section and a horizontal section, and wherein at least one weight is disposed on each of the rigid mid bars.

14. An exercise apparatus comprising:

a) cross brace having a first end and an opposing second end, wherein the cross brace has a pair of spaced apart rigid mid bars joined to and extending perpendicularly downward from the cross brace, b) a first side frame pivotally attached to the first end of the cross brace, c) a second side frame pivotally attached to the second end of the cross brace, wherein each side frame has a top horizontal brace support acting as a handle bar, a bottom horizontal brace support having an opening defined therethrough, a front vertical support linking the top horizontal brace support to the bottom horizontal brace support, and a rear vertical support linking the front vertical support to the bottom horizontal brace support, the first side frame and the second side frame pivotable with respect to the cross brace to open and closed positions, wherein the first and second side frames can be locked in the open or closed positions, e) a bungee cord having opposite ends received in the openings in the bottom horizontal braces and secured thereto, wherein the bungee cord includes a seat attachment secured thereto, and f) at least four rollers pivotable between a first position and a second position, wherein each roller includes, i) a tubular portion having an opening therein, ii) a wheel housing with a wheel rotatably mounted thereto, and iii) a locking member received in the opening in the tubular portion and for locking the rollers in the first and second positions, wherein at least two of the rollers are received on one front vertical support and wherein at least two of the rollers are received on the other front vertical support.

15. The exercise apparatus of claim 13 wherein the opening in the tubular portion is threaded and wherein the locking member is threadedly received in the opening.

16. A method for performing an ab roll using an apparatus including a cross brace having a opposing first and second ends, and first and second side frames pivotally connected to the opposite ends of the cross brace, wherein each side frame has at least two rollers extending therefrom, the method comprising the steps of a) folding the first and second side frames into a folded position, b) placing the rollers on a generally flat surface, c) placing the users knees on the generally flat surface, d) grasping the apparatus, and e) rolling the apparatus forwardly.

17. The method of claim 16 further comprising the step of pivoting the rollers from a non-contact position to a contact position.

18. The method of claim 16 further comprising the step of locking the side frames into the folded position.

19. The method of claim 16 wherein the apparatus further comprises a bungee cord having a seat attachment secured thereto, and wherein the method further includes the step of placing the seat attachment between the user's knees and the generally flat surface, and wherein the step of stretching the bungee cord when the apparatus is rolled forwardly.

* * * * *